US006601740B1

(12) United States Patent
Clive

(10) Patent No.: US 6,601,740 B1
(45) Date of Patent: Aug. 5, 2003

(54) CLOSURE DEVICE

(76) Inventor: John Philip Clive, Flat i, 3 Greville Place, London NW6 5JP (GB)

( * ) Notice: Subject to any disclaimer, the term of this patent is extended or adjusted under 35 U.S.C. 154(b) by 0 days.

(21) Appl. No.: 09/807,065

(22) PCT Filed: Oct. 13, 1999

(86) PCT No.: PCT/GB99/03395

§ 371 (c)(1),
(2), (4) Date: Jul. 2, 2001

(87) PCT Pub. No.: WO00/23344

PCT Pub. Date: Apr. 27, 2000

(30) Foreign Application Priority Data

Oct. 16, 1998 (GB) ..... 9822719
Feb. 17, 1999 (GB) ..... 9903660

(51) Int. Cl.[7] ..... B67D 3/00
(52) U.S. Cl. ..... 222/484; 222/519; 222/571
(58) Field of Search ..... 222/519, 481.5, 222/571, 484

(56) References Cited

U.S. PATENT DOCUMENTS

| | | | | |
|---|---|---|---|---|
| 77,378 | A | 4/1868 | How | |
| 772,707 | A | 10/1904 | Elfstrand | |
| 1,023,735 | A | 4/1912 | Hager | |
| 2,056,170 | A | 10/1936 | Deschner | |
| 2,165,825 | A | 7/1939 | Von Bültzingslöwen | |
| 2,424,101 | A | 7/1947 | Lari | |
| 2,772,037 | A | 11/1956 | Rieke | |
| 2,790,582 | A | 4/1957 | Halpern | |
| 2,919,057 | A | 12/1959 | Halpern | |
| 3,140,799 | A * | 7/1964 | Mehr | 222/131 |
| 3,690,520 | A | 9/1972 | Sarris | |
| 3,834,597 | A | 9/1974 | Guala | |
| 3,873,005 | A | 3/1975 | Hazard | |
| 3,915,359 | A | 10/1975 | Feldman | |
| 3,955,712 | A * | 5/1976 | Santore | 222/484 |
| 4,022,357 | A | 5/1977 | Dwinell | |
| 4,105,141 | A | 8/1978 | Lane et al. | |
| 4,128,189 | A | 12/1978 | Baxter | |
| 4,241,855 | A | 12/1980 | Yoshioka | |
| 4,294,382 | A | 10/1981 | Summers et al. | |
| 4,550,862 | A | 11/1985 | Barker et al. | |
| 4,597,508 | A | 7/1986 | MacLarty | |
| 4,781,313 | A | 11/1988 | Verheyen | |
| 4,802,610 | A | 2/1989 | Cheek et al. | |
| 4,807,785 | A | 2/1989 | Pritchett | |

(List continued on next page.)

FOREIGN PATENT DOCUMENTS

| | | |
|---|---|---|
| CH | 365660 | 12/1962 |
| FR | 2 246 461 | 5/1975 |
| GB | 718 897 | 11/1954 |
| GB | 1 044 517 | 10/1966 |
| GB | 1 445 376 | 8/1976 |
| GB | 2 014 115 | 8/1979 |
| WO | WO 87/01677 | 3/1987 |
| WO | WO 90/08098 | 7/1990 |

*Primary Examiner*—Philippe Derakshani
(74) *Attorney, Agent, or Firm*—Flynn, Thiel, Boutell & Tanis, P.C.

(57) ABSTRACT

A closure device has a hollow body with a side opening for liquid, an open end, and a closure end portion, and is slidably engaged in an end-piece screw-threadedly engaged on the end part of a neck of a bottle. The closure device seals the bottle when pressed down into the neck until its closure end portion seals against a ridge defining the end mouth of the outlet conduit constituted by the neck and its end-piece. When the device is raised to engage a lower bead in a groove of the end-piece, liquid can be poured out of the bottle by way of the interior of the hollow body and the opening while air enters the bottle by way of an air inlet region and venting passages leading to an air outlet port. An inner barrier to liquid is formed by contact between the widest part of a skirt of the hollow body and the internal surface of the neck.

79 Claims, 31 Drawing Sheets

U.S. PATENT DOCUMENTS

| | | | |
|---|---|---|---|
| 4,971,230 | A | 11/1990 | Clubb et al. |
| 4,974,749 | A | 12/1990 | Mon |
| 4,979,655 | A | 12/1990 | Gallucci |
| 4,982,882 | A | 1/1991 | Gueret |
| 4,989,757 | A | 2/1991 | Krall |
| 4,998,988 | A | 3/1991 | Zinnbauer |
| 5,145,094 | A | 9/1992 | Perlmutter |
| 5,199,613 | A | 4/1993 | Magrath et al. |
| 5,390,828 | A | 2/1995 | Gross |
| 5,419,378 | A | 5/1995 | Law |
| 5,605,254 | A | 2/1997 | Wagner, III et al. |
| 5,620,117 | A | 4/1997 | Bieze et al. |
| 5,649,650 | A | 7/1997 | Klauke |
| 5,794,803 | A | 8/1998 | Sprick |

* cited by examiner

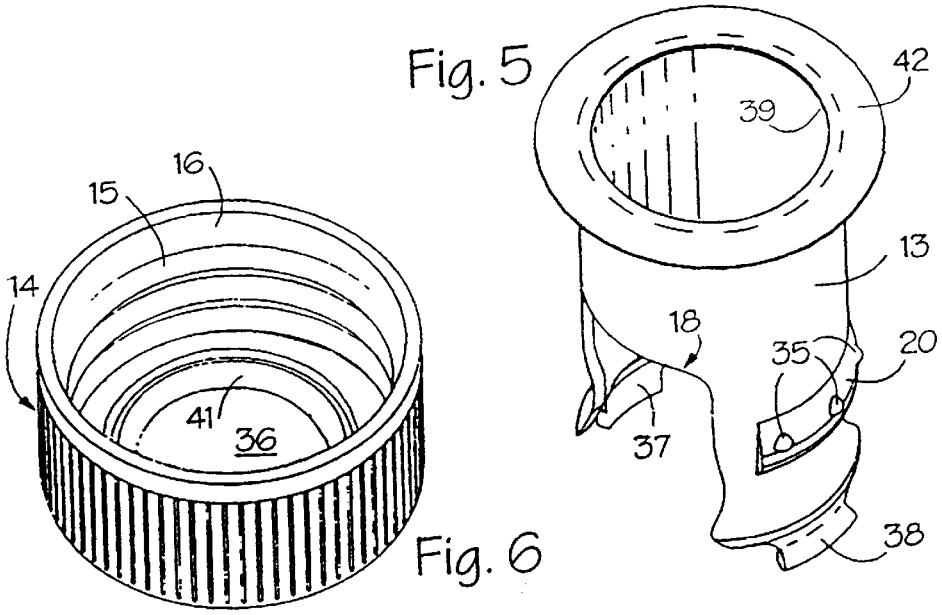
Fig. 5
42
39
13
18
35
20
37
38
16
15
14
41
36
Fig. 6
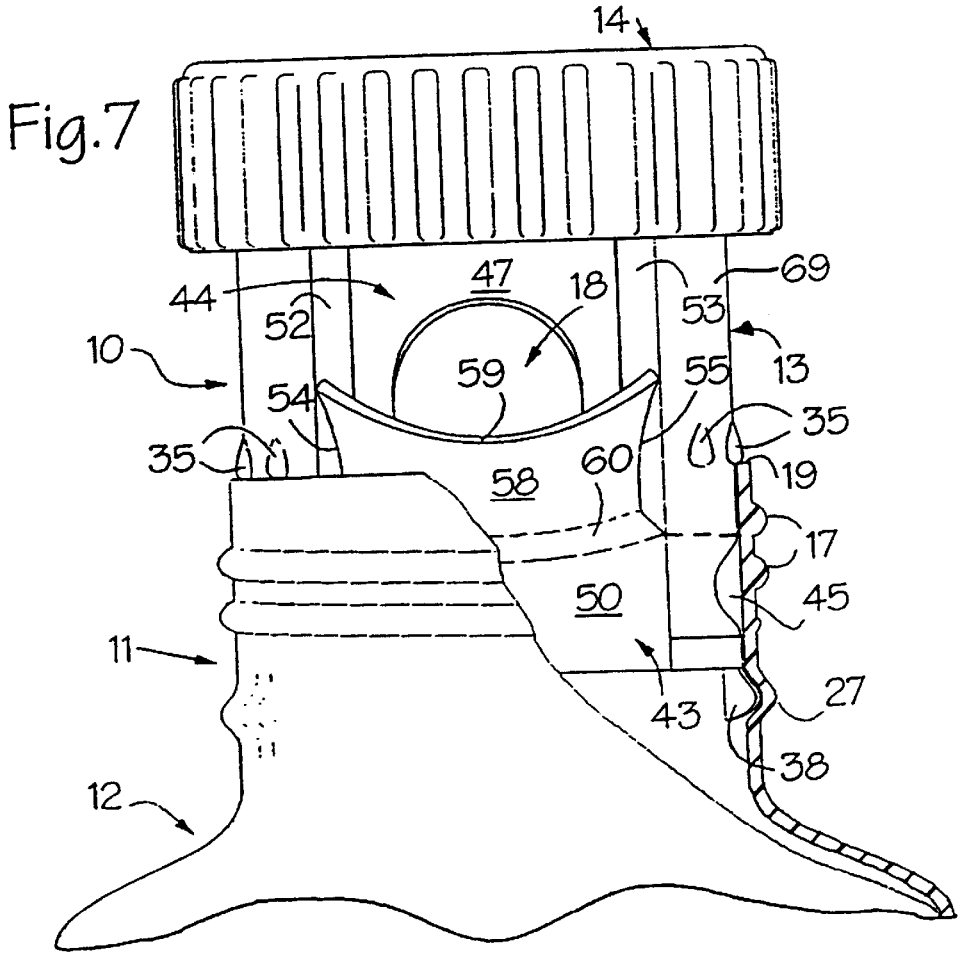
Fig.7
14
47
18
69
44
52
53
10
59
55
13
54
35
35
60
19
58
17
50
45
11
43
27
38
12

Fig. 8
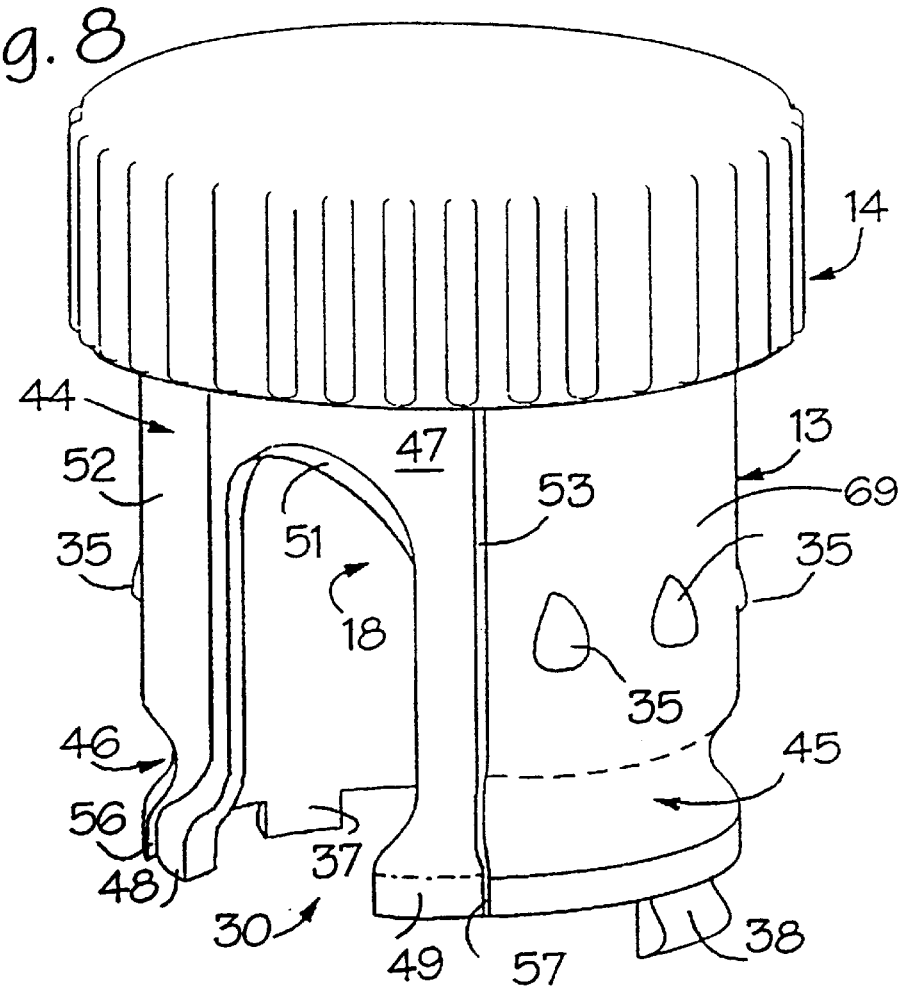
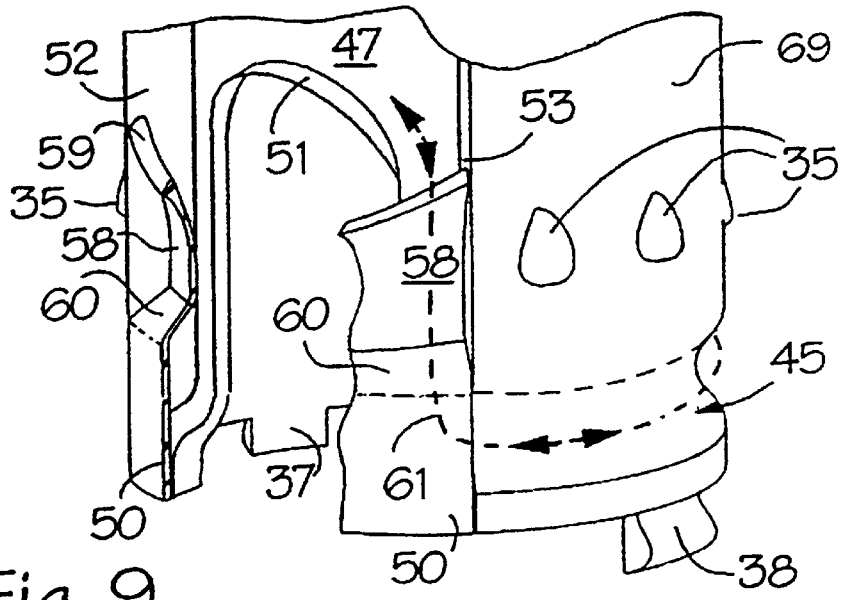
Fig. 9

Fig. 10
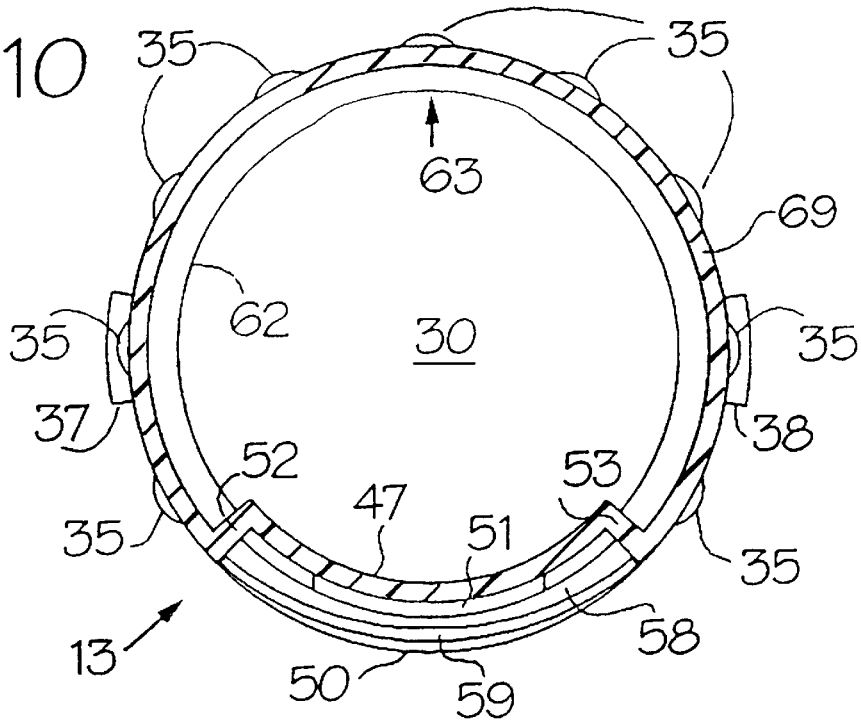
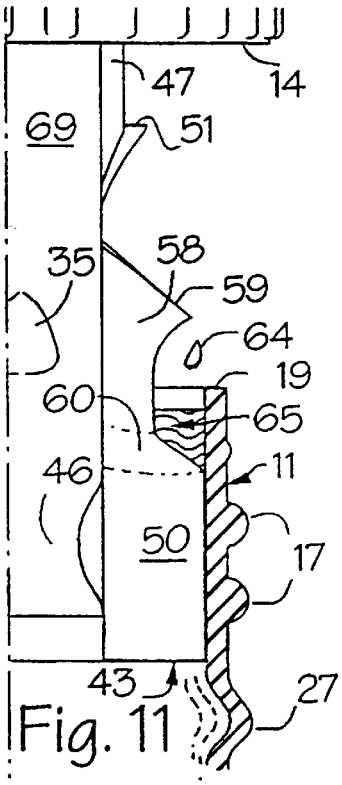
Fig. 11
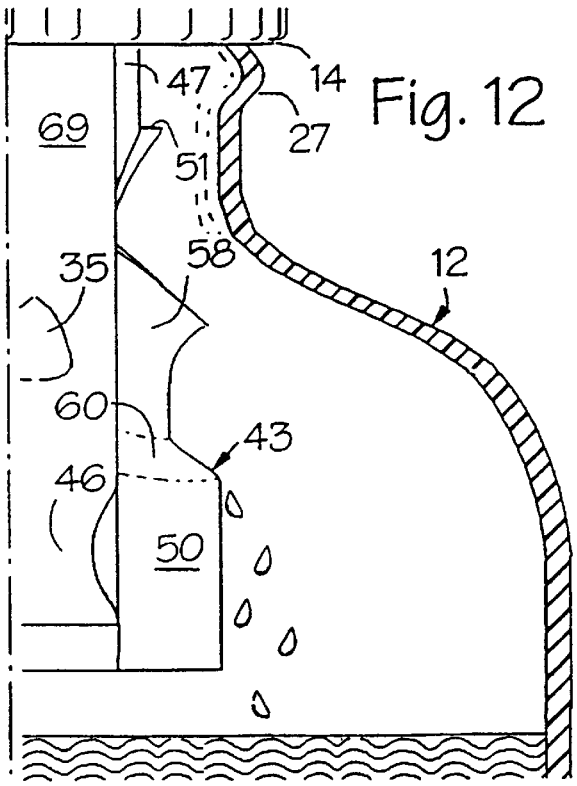
Fig. 12

CLOSURE DEVICE

This invention relates to a closure device for an outlet conduit of a container for flowable material.

Problems associated with the obtaining of a controlled flow of liquid from an unvented container having an outlet conduit with a closure device have been considered for many decades. Early examples of attempts to solve these problems are described in U.S. Pat. No. 77,378, of 1868, and U.S. Pat. No. 772,707 of 1904.

U.S. Pat. No. 2,424,101, issued in 1947, describes a valved, slidable discharge tube for use with barrels containing liquids such as oil, gasoline, alcohol, or any type of solvent. The discharge tube is intended to eliminate the need for a vent hole in the barrel. One of the examples of the discharge tube described has a cylindrical hollow body formed of three parts, two of which have the same diameter, and the third having a slightly smaller diameter. One larger diameter part and the smaller diameter part are fixed together end to end, and the other larger diameter part, which is closed at one end by an externally screw-threaded cap, is retained for partial rotation on the smaller diameter part. The barrel is provided with an internally extending outlet conduit in which the discharge tube is slidably mounted. The mouth of the outlet conduit is defined by an internally screw threaded ring set in the wall of the barrel, the internal screw thread receiving the cap of the discharge tube to seal the outlet conduit. The smaller diameter part and the rotatable larger diameter part have respective large side openings which can be brought into register with one another by rotating the rotatable part when the cap has been disengaged from the ring. A partition is secured within the two parts which are fixed together and defines an air passage extending from the outermost portion of the side opening in the smaller diameter part to the opposite side of the open end of the larger part within the barrel. The innermost end of the discharge tube, which is its open end, has an external projection for engaging between axially directed teeth formed at the innermost end of the outlet conduit to ensure that the side opening in the smaller diameter part faces vertically downwards when the discharge tube is pulled out to the discharging position. It is stated that the division of the discharge tube into a lower discharge passage and an upper venting passage is due, not so much to the partition, but principally to the presence of a grid, formed of longitudinal and transverse vanes at the side opening in the smaller diameter part, and to the general construction of the device with a larger diameter, straight and unobstructed form and large side opening.

Other attempts to solve problems in pouring are described in U.S. Pat. No. 2,772,037, issued in 1956, U.S. Pat. No. 2,790,582, issued in 1957, U.S. Pat. No. 2,919,057, issued in 1959, and U.S. Pat. No. 4,597,508, issued in 1986.

The use of a side opening for liquid, or other coherent flowable material, and an air passage with an outlet port on the opposite side of the closure device from the side opening, can provide a vertically downwards flow from the side opening. However, known closure devices which have an inlet for air which is also on the opposite side of the closure device from the side opening suffer the disadvantage that the contents of the container may spurt out through the air inlet when the container is tilted. Also, a full bottle with such a closure device will tend to leak through the air passage until the atmosphere can communicate with the air space formed in the bottle during a pouring operation, with the result that the liquid contents will run over the outside of the closure device and drip off inconveniently. Furthermore, the direct flow of liquid through the air passage can result in significant glugging, and therefore an erratic stream from the intended liquid outlet, as air attempts to enter the bottle through this outlet. The structure of the discharge tube of U.S. Pat. No. 2,424,101 circumvents the problem of spurting but is complex, formed from many separate parts, and is not suitable for use with bottles.

It is therefore an object of the present invention to provide a closure device for the outlet conduit of a container for coherent flowable material, where, in use, the closure device provides an outlet aperture for coherent flowable material to be poured out of the container, and allows for venting to introduce air into the container to replace coherent flowable material poured out, with the flow of the material being in the form of a stream having a predictable, substantially stable trajectory from the outlet aperture while outflow of the material from the means allowing venting takes place without entailing a separate stream of the material following a different trajectory from the device.

It is a further object of the invention to provide a combination of an improved closure device and an insert for the neck of a bottle, the insert being locatable in the neck of the bottle to define therewith an outlet conduit, and the closure device providing an outlet aperture for the contents of the bottle and cooperating with the insert to allow air to enter the bottle to replace contents poured out.

Another object of the invention is to provide a container having an outlet conduit which cooperates with a closure device to provide a venting passageway when the closure device, which includes a side outlet opening, is positioned to allow the coherent flowable material to be poured out through an outlet aperture defined at least in part by the side outlet opening.

Yet another object of the invention is to provide a combination of an improved closure device and an end-piece for the neck of a bottle or another conduit structure, the end-piece being locatable at the free end of the neck of the bottle or other conduit structure to define an end mouth of an outlet conduit, and the closure device providing an outlet aperture for the contents of the bottle or other container and cooperating with the outlet conduit to allow air to enter the bottle or container to replace contents poured out through the outlet aperture.

The present invention and preferred embodiments thereof are defined in the claims hereinafter to which reference should now be made.

A preferred embodiment of the invention provides a closure device for a container that includes an outlet conduit with an end mouth, the closure device having a closure end portion, an open end, and a hollow body extending from the closure end portion to the said open end, and the hollow body defining a side outlet opening. The closure device is arranged at least partly within the outlet conduit. The closure device can be set in a closing position in which the closure end portion seals the outlet conduit, and the closure device can be positioned for a pouring operation with the closure end portion spaced away from the end mouth of the outlet conduit so that the side outlet opening or part of the side outlet opening is exposed beyond the end mouth to define an outlet aperture for permitting a coherent flowable material to leave the container through the closure device. The hollow body and the outlet conduit cooperate, when the closure device is positioned for a pouring operation, to define at least part of a venting passageway through which air enters the container when coherent flowable material is poured out through the closure device. The venting passageway has an air outlet port adjacent the open end of the closure device, and an air inlet region adjoining the outlet aperture. The air outlet port is provided at a position which is displaced circumferentially of the hollow body as far as possible from the position of the air inlet region, namely on the opposite side of the hollow body from the outlet aperture. The hollow body and the outlet conduit cooperate, when the closure device is positioned for a pouring operation, to form inner and outer fluid barrier means defining at least the said part of the venting passageway. The outer fluid barrier means extend from the said inlet region to the said outlet port, and define an outer boundary of the said outlet port. During a pouring operation the outer barrier means prevent coherent flowable material in the container from flowing directly between the hollow body and the outlet conduit from the air outlet port except through the venting passageway. The inner fluid barrier means extend from the said inlet region to the said outlet port, and define an inner boundary of the said inlet region. During a pouring operation the inner barrier means prevent coherent flowable material in the container from flowing into the air inlet region except through the venting passageway. The side outlet opening may merge with the open end of the closure device. The hollow body is shaped to set back at least part of the periphery of side outlet opening radially relative to the said end mouth when the closure device is positioned for a pouring operation. The hollow body may include a drip apron between the side outlet opening and an adjacent part of the outlet conduit, the drip apron having a lip for defining the lower edge of the outlet aperture during a pouring operation and a barrier portion shaped and arranged for engaging the interior of the outlet conduit during a pouring operation with the hollow body, including the drip apron, cooperating with the outlet conduit to form a temporary reservoir for collecting drips of coherent flowable material during a pouring operation, and the barrier portion being positioned out of contact with the interior of the outlet conduit when the closure device is in the closing position, whereby coherent flowable material collected in the temporary reservoir is released to the interior of the container. The inlet region of the venting passageway is partitioned from the outlet conduit by the drip apron. The barrier portion of the drip apron forms part of the inner barrier means. Preferably the hollow body and the outlet conduit are adapted to cooperate to locate the closure device in a position for a pouring operation.

The outlet conduit may comprise a neck with a hollow insert located therein and defining the said end mouth. The insert may include inner annular means for cooperating with the hollow body to form the venting passageway. Furthermore, the end mouth of the outlet conduit may be defined by an annular portion of the insert extending axially beyond the position of a radially outwardly directed locating flange of the insert bearing on a rim at the end of the neck, the said annular portion being spaced radially inwardly from the flange by an annular trough formed in the insert.

Alternatively, the outlet conduit may comprise a neck with an end-piece secured thereto and defining the said end mouth. The end-piece may include inner annular means for cooperating with the hollow body to form the venting passageway. Furthermore, the end mouth of the outlet conduit may be defined by an annular portion of the end-piece extending axially beyond the position of a radially inwardly directed locating flange of the end-piece bearing on a rim at the end of the neck.

Whatever the nature of the outlet conduit, it is preferred that the interior of the outlet conduit be provided with annular means for cooperating with the closure device, or present a substantially cylindrical surface of circular cross section. Where annular means are provided, the annular means may include at least one annular recess, and/or at least one annular projection.

In a preferred closure device the hollow body tapers inwardly adjacent to the open end thereof to facilitate initial insertion of the closure device into the outlet conduit.

In some preferred embodiments described hereinafter with reference to the drawings, the hollow body and the outlet conduit cooperate, when the closure device is positioned for a pouring operation, to define at least part of a further venting passageway through which air enters the container when coherent flowable material is poured out through the closure device, the further venting passageway having an air outlet port which is disposed adjacent the open end of the closure device and on the opposite side of the hollow body from the outlet aperture, and an air inlet region adjoining the outlet aperture. The air outlet ports of the passageways are preferably combined to form a common air outlet port.

The respective air inlet regions of the venting passageways may be disposed at opposite sides of the said outlet opening in the circumferential sense of the hollow body, and may each extend in the axial direction of the hollow body from an end of the respective part of the passageway. The said parts of the venting passageways are preferably arcuate and extend around respective diametrically opposite extents of a circumference of the hollow body. The common outlet port may be in the form of a cut out in the hollow body, the cut out merging with the open end of the hollow body.

Where the side outlet opening of the hollow body is separated from the open end of the hollow body by a wall of the hollow body which bounds the said inlet region of the venting passageway when the closure device is in a position for a pouring operation, the said inlet region and the said outlet port may communicate through two branches of the venting passageway, the two branches being disposed at opposite sides of the hollow body. The hollow body and the outlet conduit may cooperate, when the closure device is positioned for a pouring operation, to form inner and outer fluid barriers means, the inner fluid barrier means bounding the inlet region and the two branches of the venting passageway, and the outer fluid barrier means bounding the outlet port and the two branches of the venting passageway.

Preferably the inner and outer fluid barrier means extend circumferentially around the hollow body whereby the two branches of the venting passageway are arcuate, the said wall is set back radially from the inner periphery of the outlet conduit, and the side outlet opening of the hollow body is wholly exposed beyond the end mouth when the closure device is in the position for a pouring operation.

One preferred embodiment of the invention also provides a bottle having an outlet conduit with an end mouth, and a closure device having a closure end portion, an open end, and a hollow body extending from the closure end portion to the said open end. The closure device is adapted to cooperate with the outlet conduit with the device disposed at least partly within the conduit both for closing the outlet conduit and for permitting a coherent flowable material to leave the bottle through the outlet conduit and the closure device. The hollow body defines a side outlet opening. The closure device is settable in a closing position in which the closure end portion seals the outlet conduit and is positionable for a pouring operation with the closure end portion spaced away from the end mouth of the outlet conduit and at least part of the side outlet opening exposed beyond the end mouth to define an outlet aperture for the coherent flowable material from the bottle. The hollow body and the outlet conduit cooperate to define a venting passageway through which air enters the bottle when coherent flowable material is poured out through the outlet aperture. The venting passageway has an inlet region adjoining the outlet aperture and communicating with an outlet port disposed adjacent the open end of the device and on the opposite side of the hollow body from the outlet aperture. The outlet conduit may be provided solely by a neck of the bottle, or by the combination of a neck of the bottle and an end-piece which defines the end mouth.

In a preferred embodiment of the invention, the outlet conduit and the hollow body may be shaped to define therebetween the venting passageway through which air enters the container when coherent flowable material is poured out through the outlet aperture. The hollow body and the outlet conduit are then shaped to cooperate and provide inner and outer barrier means spaced apart along the outlet conduit, the inner barrier means defining an inner boundary of the air inlet region, and the outer barrier means defining an outer boundary of the air outlet port. The outlet port may comprise a cut out at the open end of the hollow body. The closure end portion of the closure device may comprise a cap with an internally screw-threaded skirt, and the container be provided with an external screw thread at the end mouth for cooperation with the screw-threaded skirt when the closure device is in the closing position. The hollow body of the closure device may have a radially outwardly extending flange arranged to serve as a sealing liner within the cap.

Where a drip apron is provided by the hollow body of the closure device between an exposable portion of the side outlet opening and the open end of the hollow body, the drip apron is configured to cooperate with the outlet conduit or neck of the container to form a temporary reservoir for coherent flowable material after a pouring operation when the closure end portion is spaced away from the end mouth, and to release coherent flowable material accumulated in the temporary reservoir to the interior of the container when the closure device is reset in the closing position. The drip apron extends over the or each inlet region of the or each venting passageway, and may extend to the open end of the hollow body.

The barrier means may include an internal flange of the container defining the said end mouth, and at least one external flange provided on the hollow body and arranged to engage with the outlet conduit of the container when the closure device is in a position for a pouring operation.

It should be noted that well known forms of bottle or other container for liquids, sauces, etc. can be provided with or become part of an embodiment with a combination of inventive closure device and an end-piece or a hollow insert, as will be described by way of example hereinafter.

The invention will now be described by way of example with reference to the accompanying drawings, in which:

FIG. 5 is a perspective view of a part of the second closure device;

FIG. 6 is a perspective view of another part of the second closure device;

FIG. 7 is a side view, partly broken away and partly in axial section, of a third embodiment of the invention, showing a third closure device in a position for a pouring operation in a bottle;

FIG. 8 is a perspective view of a part of the third closure device;

FIG. 9 is a fragmentary, partly broken away perspective view of the third closure device;

FIG. 10 is a radial cross-sectional view of part of the third closure device;

FIG. 11 is a side view of part of the third closure device and a sectional view of the neck of a bottle with the closure device in a position for a pouring operation;

FIG. 12 is a side view of part of the third closure device and a sectional view of part of a bottle with the closure device set in a sealing position;

Figure 1:
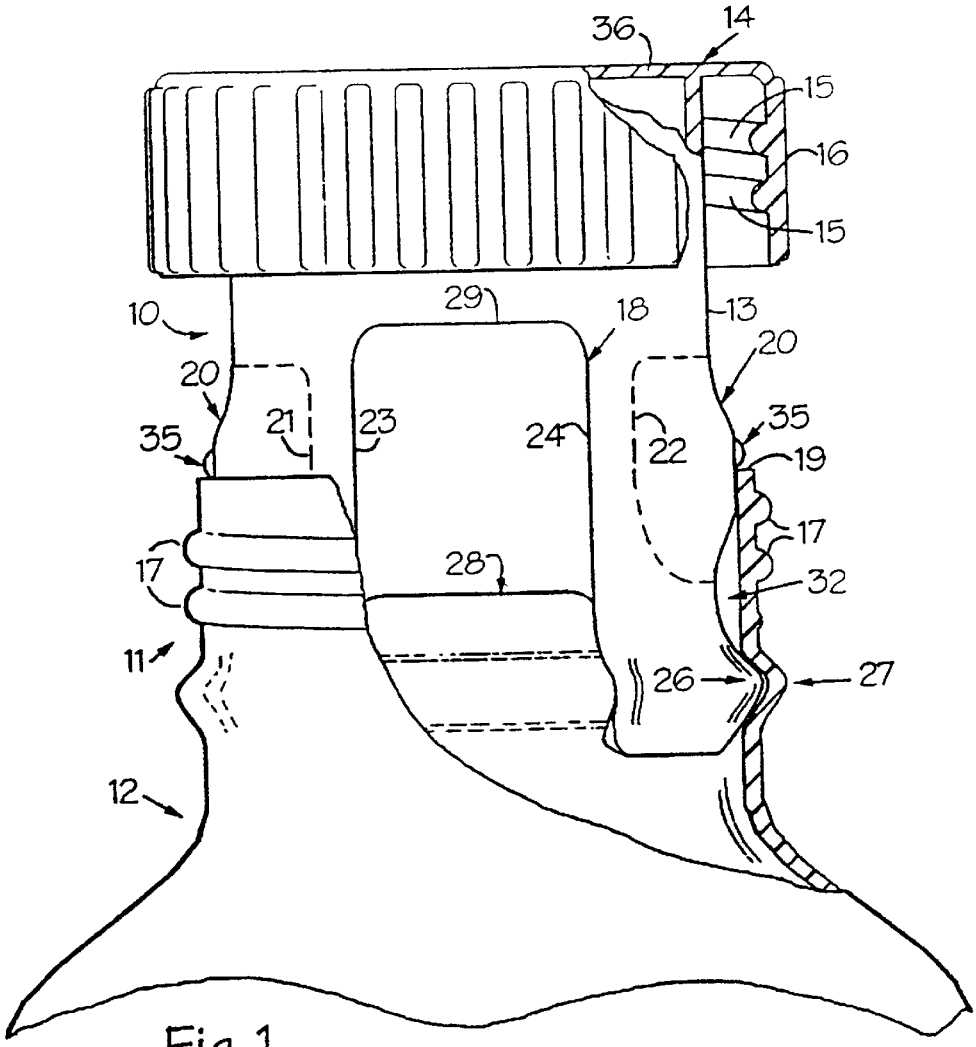
FIG. 1 is a side view, partly broken away, of a first embodiment of the invention, showing a first closure device in a position for a pouring operation in the neck of a bottle.

In the accompanying drawings, the relative proportions of some features of the embodiments have been exaggerated where necessary for the purposes of clarity of description, illustration and explanation. Also it will be seen that for the different embodiments described the reference numerals used for corresponding features are the same.

Figure 2:
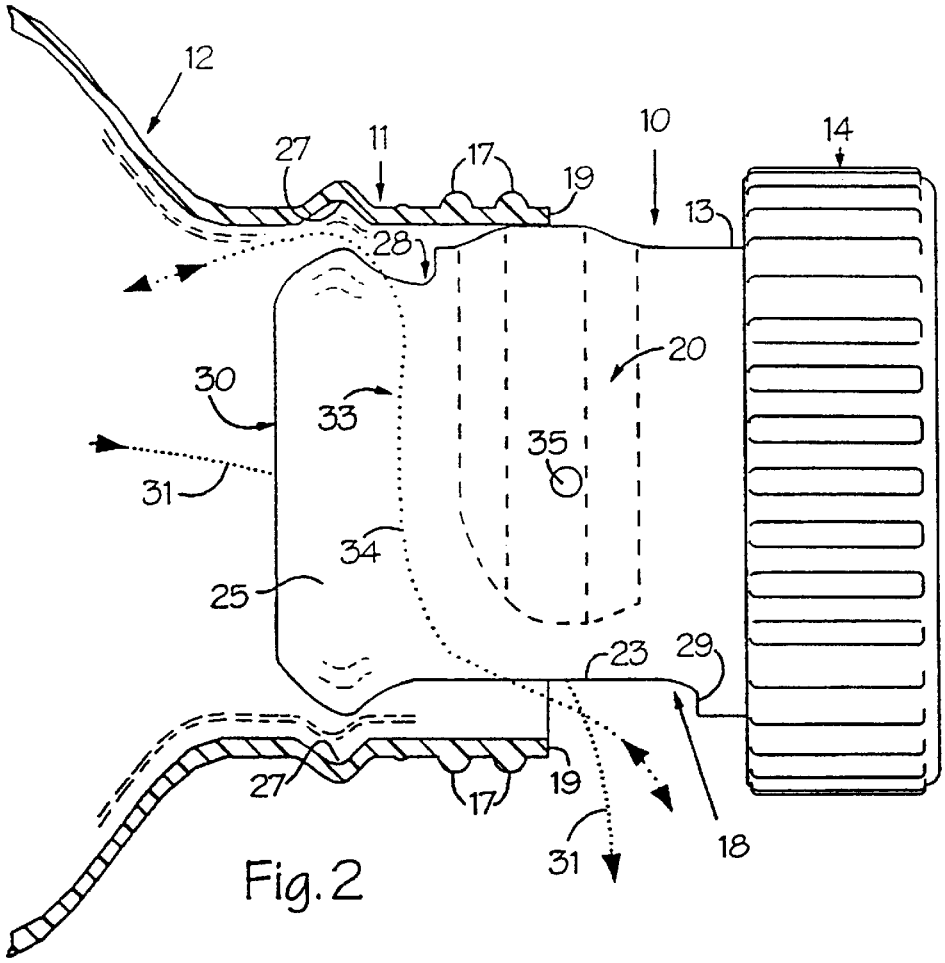
FIG. 2 is a side view of the first embodiment with the neck of the bottle in section and illustrating flow paths for air and liquid.

FIG. 1 shows a first embodiment of the closure device 10 positioned in the neck of 11 of a bottle 12 to allow a liquid (not shown) within the bottle 12 to be poured out through the closure device 10 when the bottle 12 is held with its axis horizontal as indicated in FIG. 2.

The closure device 10 has a hollow body 13 with a screw-on cap 14 at one end having a screw-thread 15 formed on the inside of its skirt 16 for engaging with an external screw-thread 17 formed on the neck 11. The other end of the hollow body 13 is open.

The hollow body 13 is formed with a side opening 18 which is elongate in the axial direction of the body 13 and merges with the open end of the hollow body 13. With the closure device 10 in the position illustrated in FIGS. 1 and 2, part of the side opening 18 is exposed beyond the mouth defined by the rim 19 at the end of the neck 11. The hollow body 13 is also formed with an enlargement 20 which extends around the body between two positions 21 and 22 each spaced from an adjacent one of the longitudinal edges 23 and 24 of the opening 18. A central portion of the enlargement 20 has a diameter that fits the internal diameter of the neck 11 immediately inwards of the rim 19 so that, when the closure device 10 is in the position shown in FIGS. 1 and 2 where the cap 14 is spaced away from the mouth of the neck 11, the enlargement 20 and the interior of the neck 11 are a friction fit and cooperate in providing a barrier to fluid so that liquid from within the bottle 12 cannot escape between the interior of the neck 11 and the hollow body 13 where the central portion of the enlargement 20 is in contact with the neck 11.

Two further fluid barriers are provided by cooperation between, on the one hand, a pair of ridge-like arcuate projections 25 and 26 formed adjacent to the open end of the hollow body 13, and a complementary recess 27 extending completely around the neck 11. The body of the bottle 12 is formed by blow-moulding a plastics material but the neck 11 is pressed so that there is a smooth, cylindrical inner surface where the thread 17 is provided externally. The recess 27 appears as an annular projection on the outside of the neck 11. Each of the arcuate projections 25 and 26 extends from the inner, relative to the bottle 12, end of a respective longitudinal edge 23 or 24 of the opening 18 to a corresponding edge of a cut-out 28 formed in the hollow body 13 at a position diametrically opposite to the opening 18.

In FIG. 2 the path of the liquid leaving the bottle 12 by entering the closure device 10 at the open end 30 of the hollow body 13 and pouring out through an outlet aperture defined by the exposed part of the outlet opening 18 and the rim 19 of the neck 11 is indicated by a first dotted line 31 with arrow heads pointing in the direction of flow.

Two venting passages 32 and 33 are defined by the three fluid barriers. Each of the venting passages 32 and 33 has an inlet region adjoining the outlet aperture, the inlet region of the venting passage 32 being bounded by the end of the enlargement 20 at the position 22, the arcuate projection 26 at the edge 24 of the opening 18, the edge 24 of the opening 18, and part of the rim 19. The inlet region of the air passage 33 is similarly bounded at the position 21, the arcuate projection 25 at the edge 23, the edge 23 of the opening 18, and part of the rim 19. Each inlet region occupies a space between part of the wall of the hollow body 13 at an edge 23 or 24 of the side outlet opening 18, and an opposing part of the interior surface of the neck 11. The cut-out 28 serves as an outlet port for both venting passages 32 and 33.

When the bottle 12 is substantially full of liquid and is tilted for a pouring operation with the closure device 10 positioned as shown in FIGS. 1 and 2, the neck 11 and the hollow body 13 of the device 10 are initially filled by the liquid. As liquid leaves the bottle 11 through the opening 18 and the venting passages 32 and 33, the pressure within the bottle 11 falls and air must enter the bottle to replace the liquid which is pouring out. It is found that the main stream of liquid which pours vertically down from the exposed portion of the opening 18 is substantially uniform and uninterrupted. It appears that air enters the venting passages 32 and 33 as bubbles which begin their forming in the inlet regions of the venting passages 32 and 33. The smallest cross-sectional area along the path of each venting passages 32 or 33 should be made smaller than the cross-sectional area of the outlet aperture defined by the exposed portion of the side opening 18, since it is found that the smaller the cross-sectional area of each venting passage relative to cross-sectional area of the outlet aperture, the less disturbance there is in the liquid at the periphery of the stream from the closure device 10. Preferably, the cross-sectional area along the path of each venting passage is made as small as possible while allowing of sufficiently rapid entry of air into the bottle or other container.

The end portions of the arcuate projections 25 and 26 adjoining the longitudinal edges 23 and 24 cooperate with the recess 27 to form innermost boundaries of the inlet regions of the two venting passages 33 and 32 and to prevent the inlet regions from being swept out by the main stream of liquid during a pouring operation.

The cut-out 28, being on the opposite side of the hollow body 13 from the outlet aperture, is at a position which is displaced circumferentially of the hollow body 13 as far as possible from the positions of the inlet regions, which adjoin the outlet aperture, i.e. the exposed part of the outlet opening 18. If the venting passages 32 and 33 were given separate outlet ports, the two outlet ports could be in the form of two separate cut-outs at respective positions which are displaced 140° around the axis of the hollow body 13 in each circumferential direction from the position between the edges 23 and 24 of the side opening 18. The efficiency of the venting function of a venting passageway diminishes as the circumferential position of its outlet port approaches that of its inlet region.

Since liquid which enters the venting passages 32 and 33 during a pouring operation joins the main stream of liquid issuing from the exposed portion of the opening 18, such liquid flows out in the same direction as the main stream.

The bidirectional function of the passages 32 and 33 is indicated schematically for the passage 33 by arrow heads pointing in both directions along a dotted line 34.

The outer region of the central portion of the enlargement 20 is provided with a pair of pips 35 arranged to assist in locating the closure device in the neck 11 for a pouring operation, the pips 35 being just above the rim 19 as shown in FIG. 1 when the arcuate projections 25 and 26 are located in the recess 27. The pips 35 may be omitted if the arcuate projections 25 and 26 are a snap fit in the recess 27.

Figure 3:
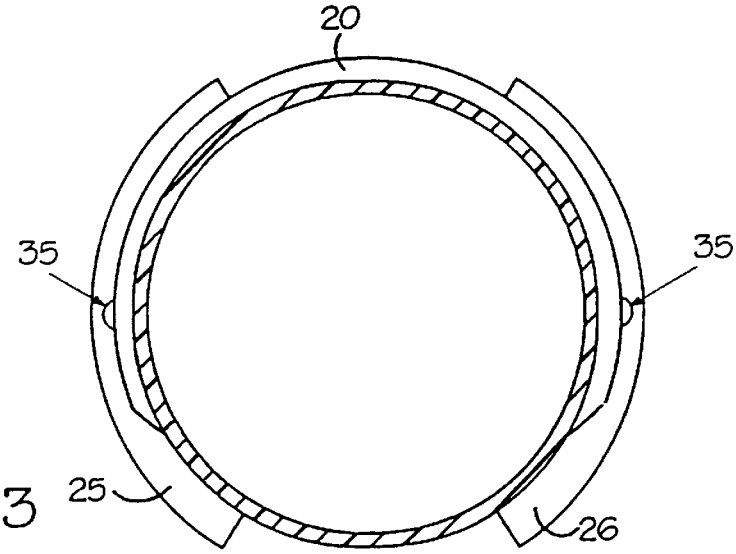
FIG. 3 is a radial cross-sectional view of part of the first embodiment.

It will be appreciated that the arcuate projections 25 and 26 of the device 10 of FIGS. 1 to 3 have two functions: to cooperate with the neck 11 in providing two fluid barriers, and to at least assist in locating the device 10 in its position for pouring as shown in FIGS. 1 and 2.

If the closure device is made by injection moulding with a plastics material, the merging of the side outlet opening 18 with the open end 30 of the hollow body 13 has the advantage that the injection moulding can be done without the use of a side core. The moulding also provides the cut out 28, which is referred to herein as a cut out merely because it appears as an interruption in the periphery of the hollow body 13 at its open end 30.

Between the uppermost, or outer, shoulder of the enlargement 20 and the end wall 36 provided by the cap 14 the hollow body 13 has uniform internal and external diameters. A short tube is formed by the body 13 from the upper edge 29 of the opening 18 to the wall 36. FIG. 3 is a cross-sectional view of the hollow body 13 at a radial plane through the tubular portion above the opening 18, and shows the relative positions and extents of the enlargement 20 and the two arcuate projections 25 and 26. When the bottle 12 is tilted for a pouring operation, the closed-off tubular portion checks and counteracts the horizontal component of the flow of liquid into the closure device 10, so that the liquid pours out of the exposed part of the opening 18 in a substantially vertical direction.

It will be seen from FIGS. 2 and 3 that the edges of the exposed part of the opening 18, provided by the edges 23, 24 and 29, are radially set back from the rim 19 of the neck 11. This setting back has the result that when the bottle 12 is returned to the vertical position from a pouring operation, any liquid which may cling to the edges of the opening 18 tends to drip back into the bottle 12 rather than down onto the outer surface of the bottle 12.

To close the bottle 12, the closure device 10 is pushed into the neck 11 until the internal screw thread 15 of the skirt 16 can be engaged with the external screw thread 17 of the neck 11. The closure device 10 is rotated by its cap 14 to fully engage the threads 15 and 17, the rim 19 thereby being forced against the inner surface of the end wall 36 to seal the bottle 12.

Initially, the skirt 16 of the cap 14 may be connected to a tear-off tamper indicator band or captive collar (not shown) engaged with an annular projection. The annular projection required may be provided by suitable adaptation of the recess 27, or by a further annular projection. Such a tear-off tamper indicator band would first be detached in the usual way before the cap 14 is unscrewed, or, if a captive collar is provided instead, the initial unscrewing of the cap 14 would separate the rim of the skirt 16 from the collar which would remain loose below the annular projection at the recess 27.

Figure 4:
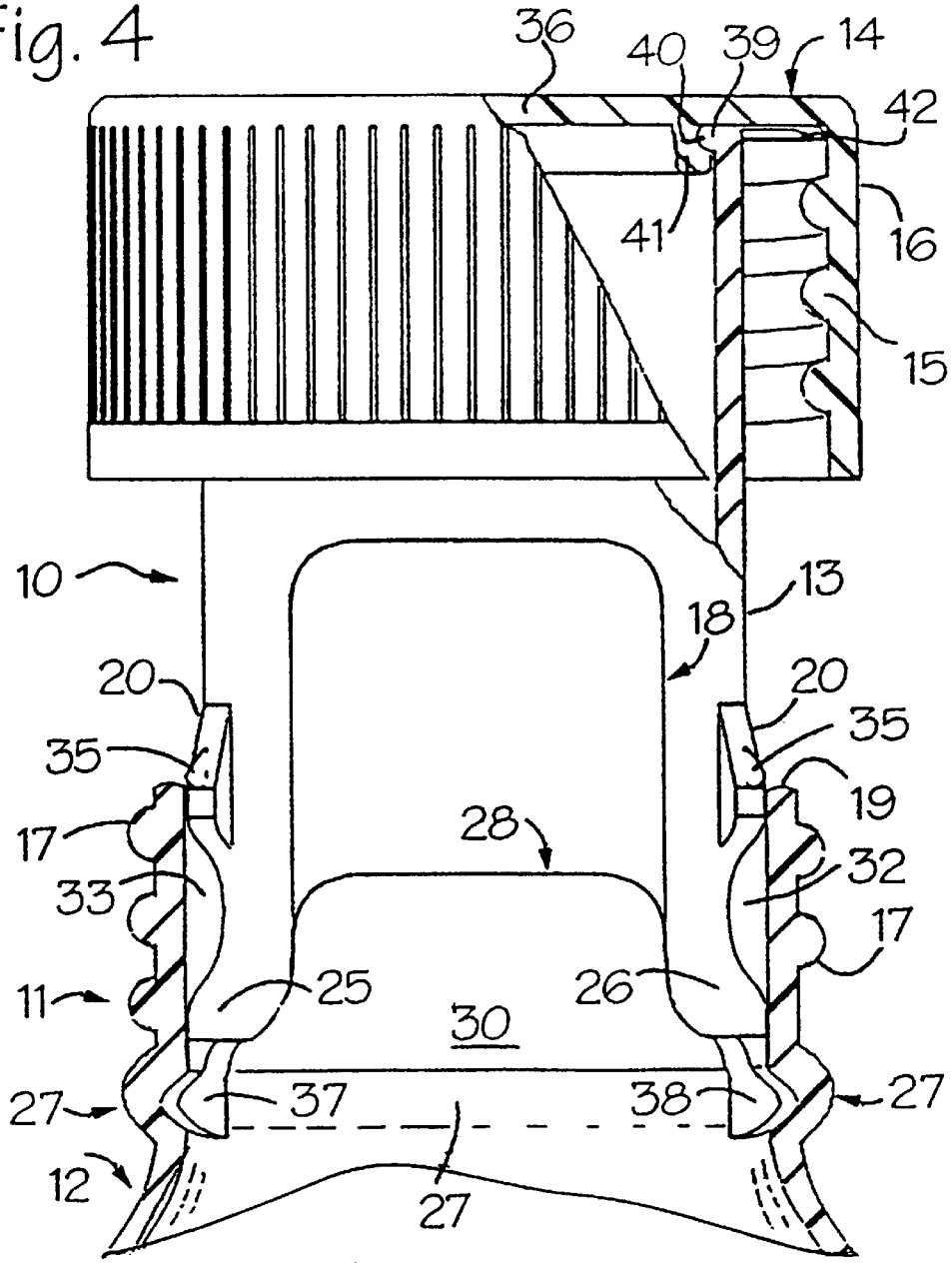
FIG. 4 is part sectional, part broken away side view of a second embodiment of the invention, showing a second closure device in a position for a pouring operation in the neck of a bottle.

For some liquids it is necessary to provide a compressible elastomeric insert on which the rim 19 presses when the cap 14 is screwed down to seal the bottle 12. Since it may be difficult to install a suitable such insert on the annular region of the end wall 36 between the skirt 16 and the closed end of the hollow body 13, another embodiment is shown in FIGS. 4 to 6 which has a hollow body 13 and a cap 14 formed separately. In this embodiment, in the position for a pouring operation, part of the opening 18 is exposed above the rim 19 of the neck 11 as indicated in FIG. 4, and the two arcuate projections 25 and 26 at the open end 30 of the body 13 are a friction fit in the neck 11 and cooperate with the inner surface of the neck 11 to define the two venting passages 32 and 33 having inlet regions adjoining the opening 18. The hollow body 13 has two radially outwardly projecting catch members 37 and 38 which extend from and radially outwards of the arcuate projections 25 and 26 to engage in an annular recess 27 in the neck 11 when the closure device 10 is in the pouring position. The catch members 37 and 38 are of relatively small circumferential extent in relation to the hollow body 13.

The other end of the hollow body 13 is adapted to attach to the cap 14 by a radially inwardly projecting ridge 39 which fits into an external annular groove 40 provided in an annular wall 41 extending axially from the inner surface of the end wall 36 of the cap 14. The dimensions of the ridge 39 and the groove 40 are such that the engagement between the hollow body 13 and the wall 36 of the cap 14 is sufficiently strong to withstand pulling of the hollow body 13 through the neck 11 from a closing position in which the thread 15 of the cap 14 is fully engaged with the thread 17 of the neck 11 to the position shown in FIG. 4.

A thin radially outwardly extending flange 42 is also provided on the same end of the hollow body 13 as the ridge 39 to serve as a compressible annular insert in the cap 14. When the threads 15 and 17 are fully engaged, the rim 19 of the neck 11 presses against the flange 42, which is sandwiched between the rim 19 and the wall 36 of the cap 14, to provided an airtight seal for the bottle 12.

Pips 35 may be provided at regular intervals around the body 13 on the enlargement 20 which indicate that the body 13 is properly located for a pouring operation by appearing just above the rim 19 when the catch members 37 and 38 engage the recess 27. Also, each pip 35 is of substantially tear-drop shape with the sharper end outermost to facilitate outward movement of the hollow body 13 in the neck 11.

The structure and operation of the closure device 10 of FIG. 4 is otherwise substantially the same as for the device 10 of FIGS. 1 to 3.

In the closure devices 10 of FIGS. 1 and 4, the structure allows some flexing of the parts adjacent the respective open end 30 so that if desired or necessary, the device 10 can be completely extracted from the neck 11 of the bottle 12, and subsequently re-inserted. Such extraction and reinsertion may be required for, for example, re-filling of the bottle 12 with liquid to be dispensed, drinking directly from the mouth of the bottle 12, or conventional pouring out of liquid through the mouth defined by the rim 19.

If, on the contrary, it is desired that the closure device 10 of FIG. 4 should not be extractable from the neck 11 after initial filling of the bottle 12, the catch members 37 and 38 are shaped like barbs or at least present radially outwardly extending surfaces lying in a radial plane relative to the hollow body 13, and hence relative to the neck 11, and the inner surface of the recess 27 is made a sufficient departure from the cylindrical interior of the threaded part of the neck 11 at the upper or outermost region of the recess 27 to ensure that the catch members cannot be pulled out of the recess 27 to allow extraction of the closure device 10 from the neck 11.

Although the hollow body 13 and the cap 14 shown are engaged by the snap fit arrangement of the ridge 39 and the wall 41, other embodiments in which the hollow body is made as a separate piece may have the end of the hollow body welded or adhered in some other manner to the inner surface of the cap.

Preferably a separate hollow body such as the body 13 of FIG. 5 is moulded from a material which is elastomeric when sufficiently thin to serve as a cap liner flange 42, and substantially rigid when thick enough to define the remaining structure of the hollow body.

The cap 14 is of a relatively rigid plastics material. However, a metal cap may be used when the hollow body is secured in it to serve also as a liner. There are well known methods for securing plastics material liners in metal caps, as for example, in the case of caps for olive oil bottles.

FIG. 7 shows a further embodiment in which the closure device 10 has some features of both devices 10 of FIGS. 1 to 6, and differs in other respects. The closure device 10 is shown in its position for a pouring operating in the neck 11 of a bottle 12, the neck 11 being substantially the same as the neck 11 of the bottle shown in FIG. 1.

The hollow body 13 includes a drip apron 43 which is secured over part of the side opening 18 of the body 13. The main part of the hollow body 13 is tubular with a constant external diameter except for a longitudinally extending recessed region 44 in which the opening 18 is formed and the drip apron 43 is located, and a pair of arcuate channels 45 and 46 which provide communication between the recessed region 44 and a cut out (not shown) similar to the cut out 28 of the devices 10 of FIGS. 1 to 6.

The cap 14 may be formed in one piece with the tubular main part of the hollow body 13, or may be formed separately as in the device 10 of FIGS. 4 to 6.

The floor of the recessed region 44 of the body 13 is defined by a wall 47 which from the cap 14 to the vicinity of the channels 45 and 46 is substantially part of a circular section cylinder, and terminates at the open end 30 in two radially outwardly extending curved portions with part circular cylindrical ends 48 and 49 which fit against a part circular cylindrical inner surface of a is lower or innermost part 50 of the drip apron 43, as can be seen from FIGS. 8 and 9. The opening 18 is formed in the wall 47 and has an arched upper or outermost edge which is provided with a projecting rim 51 which prevents liquid creeping up towards the cap 14 by surface tension.

The venting passages defined between the neck 11 and the channels 45 and 46 continue between the lower part of 50 of the drip apron 43 and the curved portions of the wall 47 above the ends 48 and 49 which seal against the part 50.

The sides of the recessed region 44 are defined by two elongate flat walls 52 and 53 that lie in axial planes, i.e. planes which contain the longitudinal axis of the hollow body 13. The planes of these walls 52 and 53 define the ends of the channels 46 and 45 respectively, and the side edges 54 and 55 of the drip apron 43 are in sealing engagement with their surfaces and with coplanar surfaces 56 and 57 adjoining the ends 48 and 49.

The apron 43 has an upper or outermost part 58, which provides a curved pouring lip 59, and an intermediate part 60 that joins the upper and lower parts 58 and 50 together. The upper part 58 is shaped substantially as part of a hollow toroid.

At each side of the opening 18 a space remains between the apron 43 and the wall 47 which serves as an inlet region of the venting passage which continues through the channel 45 or 46. The path of the venting passage which is partly defined by the channel 45 is indicated in part by a broken line 61 with arrow heads in FIG. 9.

The two spaces which constitute the inlet regions of the venting passages can be seen from above in FIG. 10 which is a cross sectional view of the hollow body 13 at a radial plane between the projecting rim 51 over the opening 18 and the cap 14. FIG. 10 shows an arcuate inward projection 62 which corresponds to the two channels 46 and 45. Between the ends of the two channels 46 and 45 at a position 63 diametrically opposite the opening 18 the cut out (not shown) extends from the open end 30 into the lower half of the projection 62. Alternatively, instead of a single cut out at the position 63, two cut outs, each at a position which is displaced circumferentially of the hollow body 13 from the position of the respective inlet region, may be provided. In this alternative, the main wall of the hollow 13 may continue straight down from the cap 14 to the open end 30 between the two outlet ports.

It will be seen from FIG. 10 that the outer surface of the lower part 50 of the apron 43 has the same radius as the cylindrical parts of the main part of the hollow body 13. The upper part 58 of the apron 43 is, however, so shaped that the pouring lip 59, at least where it spans the width of the opening 18, is spaced radially back from the cylindrical surface defined by the lower part 50. The purpose of this arrangement can be seen from FIGS. 11 and 12. FIG. 11 shows the position of the drip apron 43 when the closure device 10 is still in the position for a pouring operation after the bottle 12 has been returned to the vertical position after liquid has been poured through the closure device 10 from the interior of the bottle 12. Liquid which remains on the pouring lip 59 may drip down outside the upper part of 58 of the apron 43. However, because that part of the lip 59 which is opposite the outlet opening 18, and therefore over which the liquid poured, is set back radially from the vertical cylindrical surface defined by the inner surface of the neck 11, the dripping liquid 64 falls into and accumulates in a trough 65 temporarily formed by the top of the neck 11, the intermediate part 60 of the apron, a lower region of the upper part 58 of the apron, and the side walls 52 and 53. When, subsequently, the closure device 10 is pushed back into the neck 11 to allow the cap 14 to be secured on the top of the neck 11, the liquid accumulated in the trough 65 runs down the lower part 50 and into the interior of the bottle 12 once the outer surface of the lower part 50 has completely disengaged from the inner surface of the neck 11. The final position of the apron 43 when the cap 14 has been screwed down to seal the neck 11 is shown in FIG. 12.

It will be apparent that the upper part 58 of the apron 43 and its lip 59 may have shapes other than those depicted in and described with reference to FIGS. 7 to 12, provided that liquid is able to drip from the lip into the temporary reservoir 65.

The apron 43 is secured to the main part of the hollow body 13 by welding or another form of adhesion, or may be held in place by a snap fitting arrangement (not shown), or by the process of two shot moulding.

Although the embodiment of FIG. 7 is shown having the bottle 12 as the container, the container may be, for example, a five litre lubricating oil container in the form of a bottle or a more rectangular can shape. For such a container of lubricating oil, it is advantageous to make the closure device 11 with a much longer hollow body 13 than is illustrated in FIGS. 7 to 12, and provide the drip apron 43 with a corresponding longer upper part 58 so that the part of the side outlet opening 18 exposed beyond the lip 59 when the closure device 10 is in the position for a pouring operation, as in FIG. 7, is a suitable distance from the body of the container to allow accurate pouring of lubricating oil into an engine. It will be appreciated that the inlet regions of the air passages of this embodiment adjoin the outlet aperture defined by the opening 18 and the lip 59 although the outlet aperture is spaced away from the rim 19, or the corresponding rim of a rectangular can outlet conduit, by a distance which may be several inches (about one or two decimeters).

When the bottle 12, or other container, is sufficiently full of liquid for the cut out (not shown) at the position 63 to be submerged below the free surface (if any) of liquid in the bottle or container during a pouring operation, air enters the bottle or container in the manner described hereinbefore with reference to the embodiment of FIGS. 1 to 3, beginning with the forming of bubbles in liquid in the inlet regions, adjoining the outlet aperture, of the venting passages. It will be appreciated that, in the embodiment of FIGS. 7 to 12, the inside surface of the drip apron 43 takes the place of the interior surface of the outlet conduit of the bottle 12 or other container in the functioning of the inlet regions of the venting passageways. The smallest cross-sectional area of each of the venting passageways may in this embodiment be defined in effect by the upper or outermost part 58 of the apron 43, the wall 47, and one side or longitudinal edge of the opening 18, or by that part of the cross section of the channel 45 or 46 remaining open at the end opening into the space between the lower part 60 of the apron 43 and the respective radially outwardly extending curved portion of the wall 47 immediately above the end 48 or 49.

In an embodiment which is a modification of the embodiment of FIGS. 7 to 12, there is no lower part 50 of the apron 43, and instead the intermediate part 60 has an edge that seals against the interior surface of the threaded portion of the neck 11 when the closure device is in the position illustrated by FIG. 11, so that the temporary reservoir is again formed, and the surfaces 56 and 57, coplanar with the surfaces of the walls 52 and 53, are eliminated, the wall 47 curving to merge with the lower or innermost half of the surface of each channel 45 and 46 and providing continuations of the arcuate rims, below the channels 45 and 46, from which the catch members 38 and 37 extend. In this case the smallest cross-sectional area in each venting passage may be defined by the full cross section of the respective channel 45 or 46.

The flat wall 36 of the cap may be provided with an indicator arrow head moulded in relief and pointing towards the circumferential position.of the opening 18.

A projecting rim corresponding to the rim 51 may be provided on the devices 10 of FIGS. 1 to 6 also.

Figure 13:
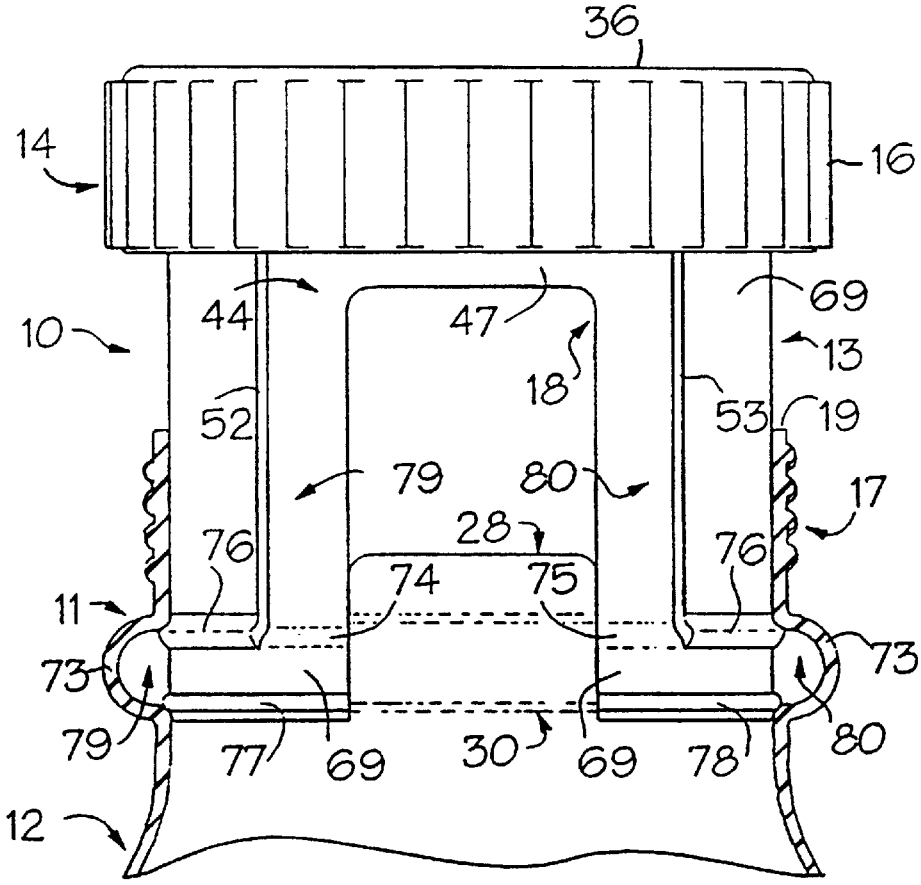
FIG. 13 is a side view of a fourth embodiment of the invention, showing the neck of a bottle in axial section with the closure device in a position for a pouring operation.

FIG. 13 shows an embodiment having a closure device 10 in a neck 11 of bottle 12 where an annular bulge 73 of substantially semi-circular hollow cross-section is provided in the neck 11 below an external screw thread 17.

The recessed region 44 extends in the axial direction from the flat wall 36 of the cap 14 to two inclined transition surfaces 74 and 75.

Two radially projecting arcuate ridges 76 extend circumferentially around the hollow body 13, one from the end of the flat wall 52 at the transition surface 74 to a cut out 28, and the other from the end of the flat wall 53 at the transition surface 75 to the cut out 28. The ridges 76 separate a larger upper or outermost part of the cylindrical wall 69 from two arcuate lower or innermost parts that extend respectively from a side of the opening 18 to a side of a cut out 28. The upper edge of the cut out 28 lies above the level of the ridges 76 at a position diametrically opposite the circumferential position of the opening 18. Contact between the cylindrical wall 69 and the interior surface of the neck 11 provides a barrier to liquid between the cut out 28 and the rim 19 above the level of the ridges 76.

Each of the two arcuate lower parts of the surface 69 is provided with a circumferentially co-extensive radially outwardly projecting arcuate ridge 77 or 78 that lies almost immediately adjacent the open end 30. The axial spacing of the ridges 77 and 78 from the ridges 76 is chosen to be such that the ridges 77 and 78 seal against the lower or innermost edge of the interior of the bulge 73 when the ridges 76 are drawn into sealing engagement with the upper or outermost edge of the interior of the bulge 73, as indicated in FIG. 13. When the device 10 is thus set in the position for pouring, two venting passages 79 and 80 are formed, the passage 79 extending from an inlet region bounded by the walls 47 and 52 and the upper, externally screw threaded part of the neck 11, over the transition surface 74 and through the interior of part of the bulge 73 to the cut out 28, and the passage 80 extending from an inlet region bounded by the walls 47 and 53 and the upper, externally screw threaded part of the neck 11, over the transition surface 75 and through the interior of another part of the bulge 73 to the cut out 28. The surface 69 of the device 10 fits the interior surface of the neck 11 at its upper, externally screw threaded part, and immediately below the bulge 73.

The bottle 12 is moulded from a resilient plastics material and the ridges 76, 77 and 78 have profiles which allow the hollow body 13 to be initially inserted into the neck 11 and to be moved between a closing position in which the cap 14 is screwed down against the rim 19 and the position for a pouring operation where the ridges 76, 77 and 78 engage the bulge 73, and the outermost portion of the opening 18 is exposed beyond the rim 19.

The principal function of the ridges 76, 77 and 78 is to enable the closure device 10 to be set in the position for a pouring operation. If the fit between the wall 69 and the inner surface of the neck 11 above and below the bulge 73 is sufficiently good, either the ridges 76 can be omitted, or the ridges 77 and 78 can be omitted, engagement between the wall 69 and the interior of the neck 11 serving to provide the necessary fluid barrier above the bulge 73 or the two barriers below the bulge 73 in the position for a pouring operation. Preferably the omitted ridge 76 or ridges 77 and 78 are replaced by a plurality of pips. Furthermore, if the hollow body 13 is equipped with catch members like the catch members 37 and 38 of the device 10, and a recess is provided in the neck 11 below the bulge 73, like the recess 27 in the bottle 12, all four ridges 76, 77 and 78 can be omitted.

Figure 14:
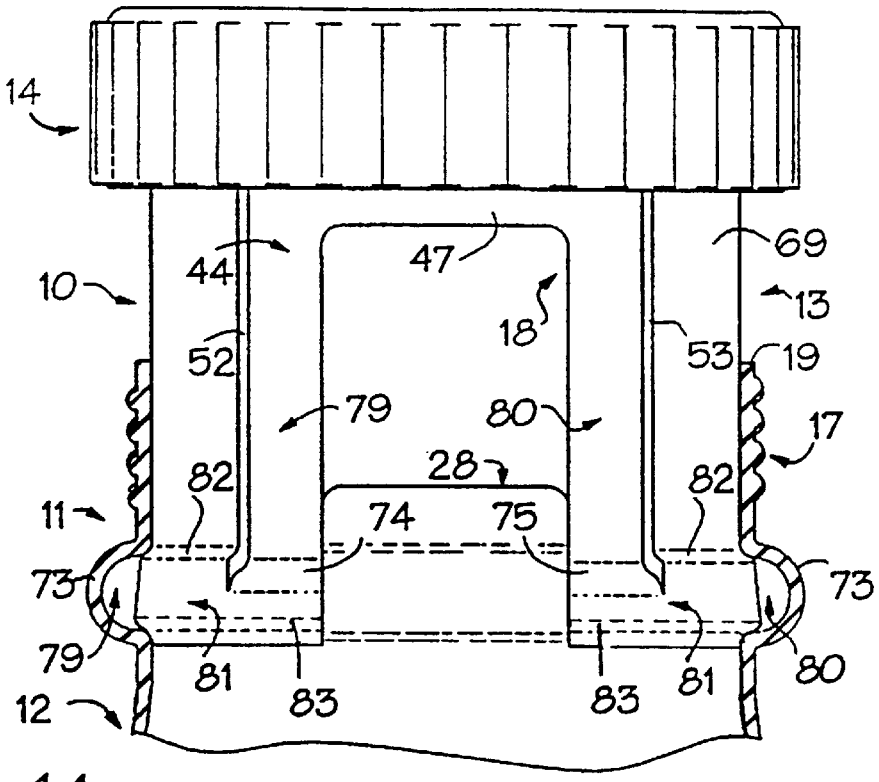
FIG. 14 is a side view, similar to that of FIG. 13, of a fifth embodiment of the invention.
Figure 15:
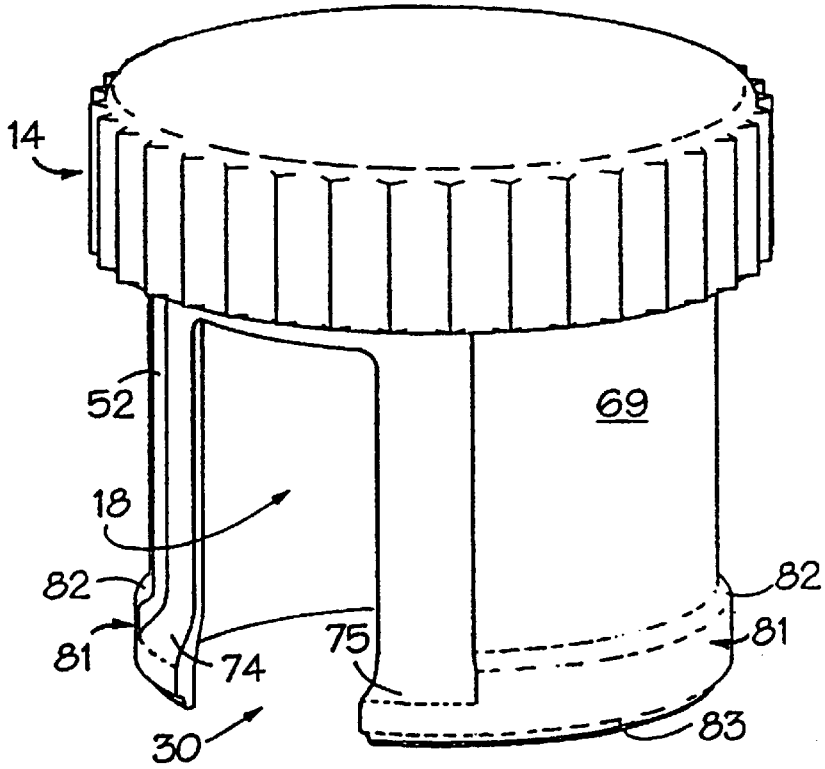
FIG. 15 is a perspective view of the closure device of the fifth embodiment.

FIGS. 14 and 15 show an embodiment which is similar to that of FIG. 13. It will be seen from FIGS. 14 and 15 that the closure device 10 of this embodiment has, instead of the four ridges 76, 77, and 78, two arcs of collar-like enlargement 81 with upper and lower shoulders 82 and 83 which, for a pouring operation, bear against the upper and lower edges of the interior of the bulge 73. The upper edge of the cut out 28 lies above the level of the upper shoulders 82, and the cut out 28 and the side opening 18 separate the two arcs of collar-like enlargement 81. Each shoulder 82 extends around the hollow body 13 from the lower end of a respective one of the axial plane walls 52 and 53. One venting passage 79 extends from its inlet region at the wall 47 over the transition surface 74 and one arc of enlargement 81 to the cut out 28. The other venting passage 80 similarly extends from its inlet region at the wall 47 over the transition surface 75 and the other arc of enlargement 81 to the cut out 28. Two arcuate rims at the same external diameter as the wall 69 extend down below the lower shoulders 83 to engage the interior of the neck 11 below the bulge 73. Contact between the cylindrical surface 69 of the hollow body 13 and the interior surface of the neck 11 provides a barrier to liquid between the cut out 28 and the rim 19.

Figure 16:
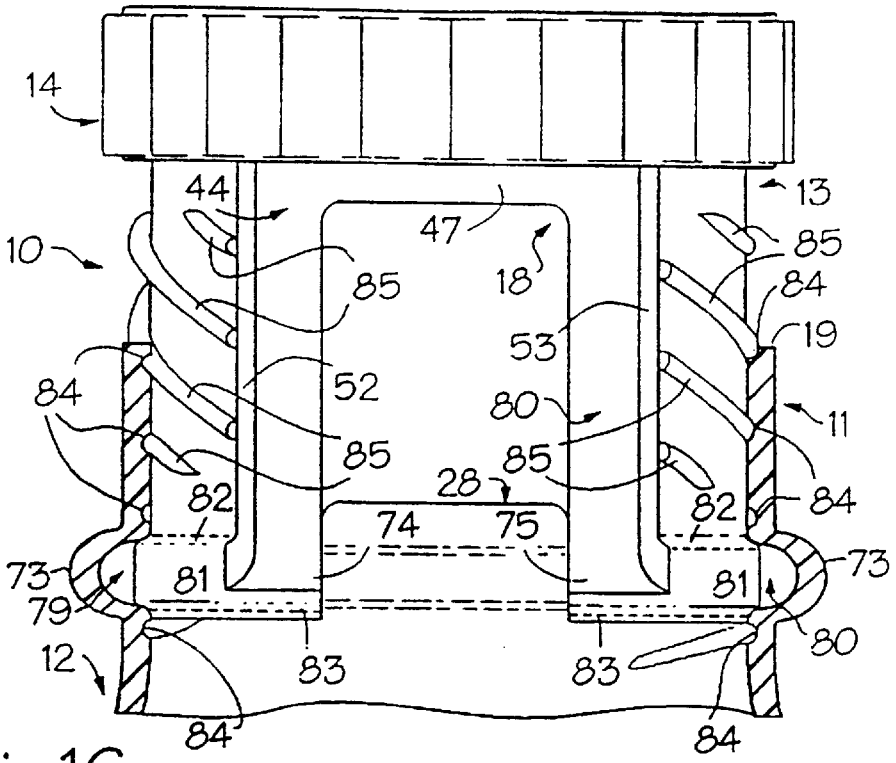
FIGS. 16, 17 and 18 are respective side views, similar to that of FIG. 13, of sixth, seventh, and eighth embodiments of the invention.

FIG. 16 shows an embodiment which differs from that of FIGS. 14 and 15 only in that the neck 11 has an internal screw thread 84 instead of the external screw thread 17, and correspondingly the closure device 10 has on its hollow body 13 an external screw thread 85 instead of the cap 14 having an internal screw thread. The inner surface (not shown) of the skirt of the cap 14 is a smooth fit on the exterior surface of the upper part of the neck 11. As in other embodiments, the cap 14 may be made separately from the body 13 or may be integral therewith.

It will be apparent that in embodiments where the skirt of the cap and the exterior of a neck are screw threaded, male threads may be formed on both the skirt and the neck, as shown in FIGS. 1 and 4, or that both male and female threads may be used, and that, in the embodiment of FIG. 16, the external threads on the hollow body 13 may be female and those in the neck 11 may be male.

Figure 17:
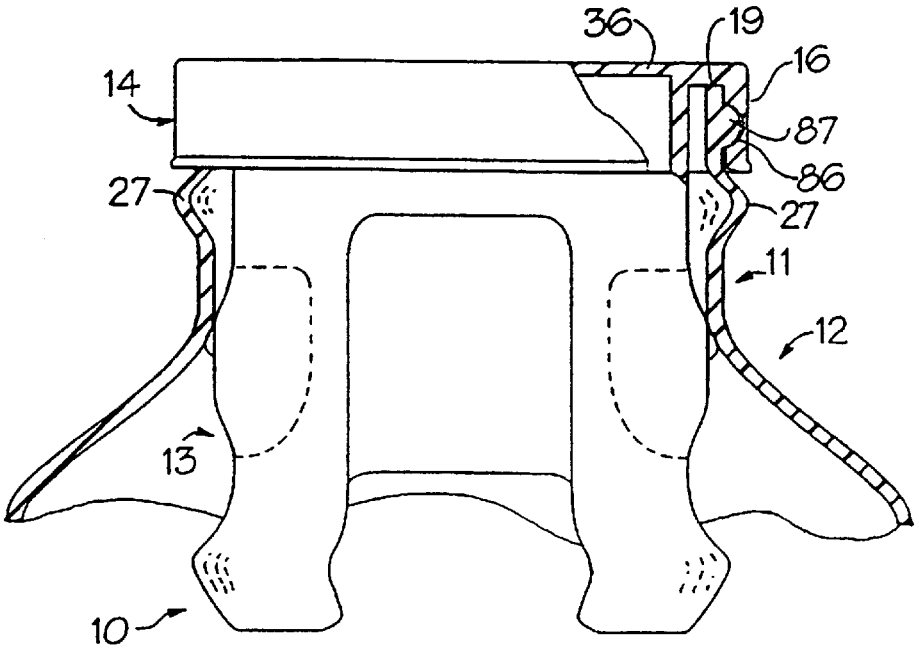

Other forms of engagement may be used for setting the closure end portion of the closure device in the closing position. One example is shown in FIG. 17 in which a closure device 10 has a closure end portion in the form of a cap 14 with a cylindrical skirt 16 having an internal annular groove 86 of substantially semi-circular cross section which, when the device 10 is in the closing position in the neck 11 of a bottle 12, receives an annular bead 87 provided on the outside of the upper part of the neck 11, the bead 87 being positioned slightly below the rim 19 of the neck 11 by a distance that ensures that the rim 19 is pressed firmly into sealing engagement with the underside of the flat wall 36 of the cap 14 when the bead 87 and the groove 86 are engaged. The embodiment of FIG. 17 operates in the same manner as that of FIG. 1 except that the cap 14 is a snap fit closure on the neck 11. The groove and bead of the snap fit closure may be interchanged if the wall of the neck is suitable.

Figure 18:
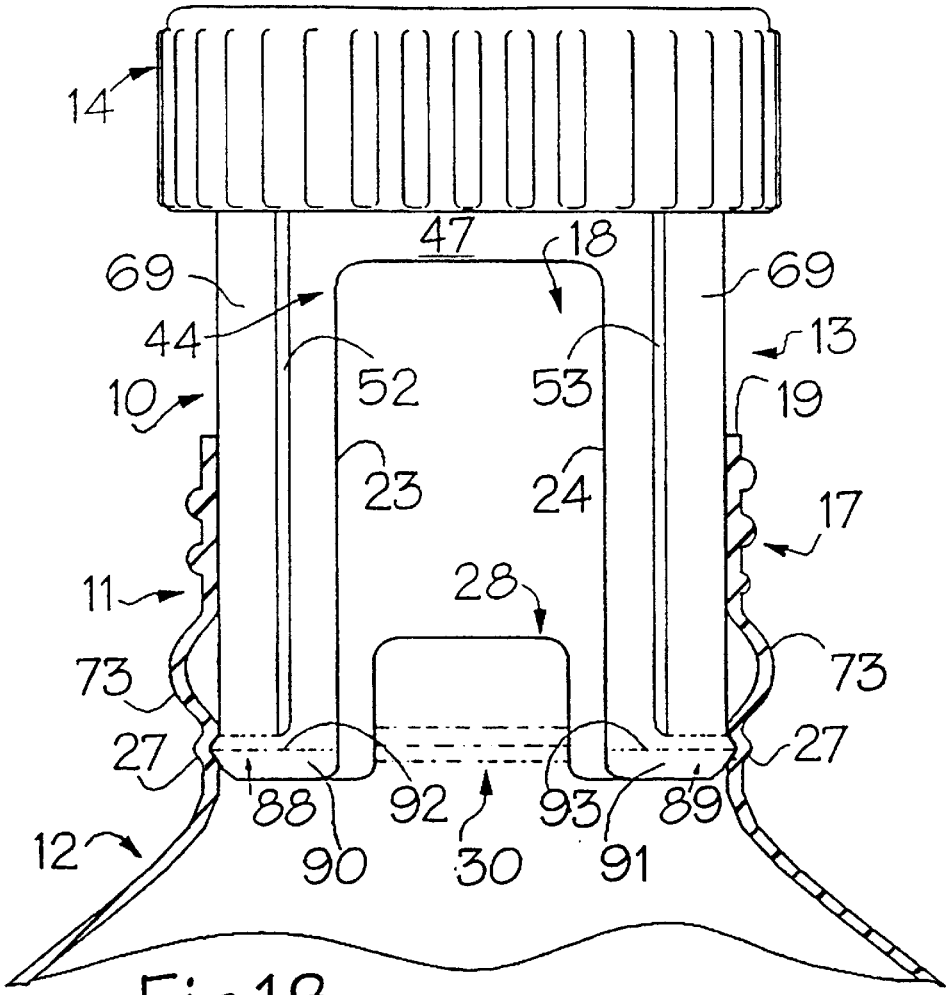

FIG. 18 shows an embodiment which is another variant of the embodiment of FIG. 13, the closure device 10 having symmetrically disposed arcuate detent ridges 88 and 89 adjacent the open end 30 of the hollow body 13 of the device 10. The transitions between the upper and lower boundaries of the bulge 73 of FIG. 18 and the adjoining parts of the neck 11 are less abrupt than in the case of the bulges 73 of FIGS. 13, 14 and 16 since the bulge 73 of FIG. 18 is not required to engage any part of the hollow body 15. A relatively small annular recess 27 is provided below the bulge 73 to engage the arcuate detent ridges 88 and 89 in the position for a pouring operation. The outer diameter of the wall 69 is chosen to ensure a fluid tight fit between the outer surface of the wall 69 and the inside surface of the screw threaded part of the neck 11. The ridge 88 extends from the bottom end of one side edge 23 of the opening 18 to one side edge of the cut out 28, and the ridge 89 extends from the bottom end of the other side edge 24 of the opening 18 to the other side edge of the cut out 28. The lower inclined surfaces 90 and 91 of the ridges 88 and 89 are prolonged downwards to provide a taper at the open end 30 to facilitate initial insertion of the closure device 10 into the neck 11. The upper inclined surfaces 92 and 93 are prolonged between the edges 23 and 24 of the opening 18 and the walls 52 and 53 to provide transition surfaces to the floor 47 of the recessed region 44. The end portions of the ridges 88 and 89 between the edges 23 and 24 and the walls 52 and 53 cooperate with the recess 27 to form innermost boundaries of the inlet regions of the two venting passages which extend from the recessed region 44 to the cut out 28 through the bulge 73 and to prevent the inlet regions from being swept out by the main stream of liquid during a pouring operation. The inner surface of the neck 11 between the bulge 73 and the recess 27 bears against the surface of the wall 69 to provide further sealing for the two venting passages.

In an alternative embodiment which is substantially as described with reference to FIG. 18, the ridges 88 and 89 are replaced by a ring of pips for locating in the recess 27, and the recessed region 44 alongside the edges 23 and 24 of the opening 18 terminates at a distance from the open end 30 which leaves two areas of the wall 69 extending to the edges 23 and 24 above the ring of pips. These two areas cooperate with the inner surface of the neck 11 between the bulge 73 and the recess 27 to provide fluid barriers which direct the main stream of liquid away from the recessed area 44, and thus away from the inlet regions of the venting passages, during a pouring operation.

Figure 19:
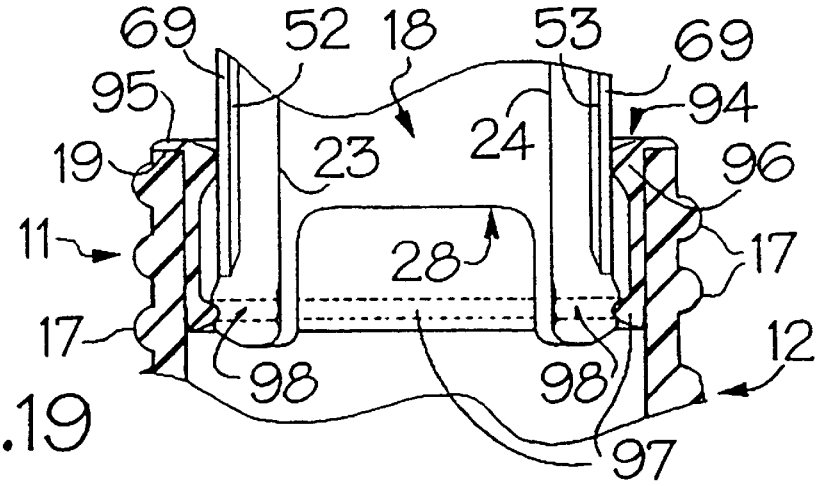
FIG. 19 is a fragmentary side view of part of the ninth embodiment of the invention with an outlet conduit shown in axial section.

FIG. 19 shows part of an embodiment which is similar to that of FIG. 18 except that the neck 11 of the bottle 12 is a simple straight hollow cylinder with an external screw thread 17, and is equipped with a cylindrical insert 94 having at one end an outwardly radially extending flange 95 that covers the rim 19 of the neck 11, and an internal annular ridge or bead 96, and a further internal annular ridge or bead 97 at the other end within the neck 11. The lower part of the cylindrical wall 69 of the hollow body of the closure device is shown in FIG. 19 and has a diameter that is less than the internal diameter of the neck 11 but fits in the mouth defined by the ridge 96 of the insert 94 to provide therewith a barrier to fluid.

The closure device has, instead of the arcuate single ridges 88 and 89, two arcuate double ridges which define arcuate valleys 98 which in the position for a pouring operation receive the lower ridge 97 of the insert 94 to form two fluid barriers extending circumferentially from the longitudinal edges 23 and 24 of the side opening 18 to the edges of the cut out 28. The upper edge of the cut out 28 lies below the ridge 96 when the ridge 97 is engaged with the valleys 98. The diameter at the bottom of the valleys 98 may be equal to or slightly less than the outer diameter of the wall 69 so that the insert 94 supports the hollow body of the closure device against tilting when the closure device is being pushed into the neck 11 from the position shown in FIG. 21.

For yet another embodiment, the structure of the insert 94 is formed as an integral part of the neck of a bottle.

It will be seen from FIG. 19 that the upper or outermost surface of the upper ridge 96 of the insert 94 slopes or curves towards the interior of the bottle 12 from the outer surface of the flange 95. The purpose of this feature will be explained hereinafter. The insert 94, before its insertion into the neck 11, may be slightly barrel shaped below the flange 95 to ensure a tight fit the neck 11 but allow the relatively easy insertion of the insert 94.

The advantage of using an insert is that it is then not necessary to form the neck or other outlet passage with features specifically designed to cooperate with the closure device of an embodiment of the invention. Thus, for example, a bottle of known shape and material can be adapted by the use of an insert to present an outlet conduit suitable for cooperation with a closure device in an embodiment of the invention. Glass bottles, in particular, may be adapted by the use of an insert.

Figure 20:
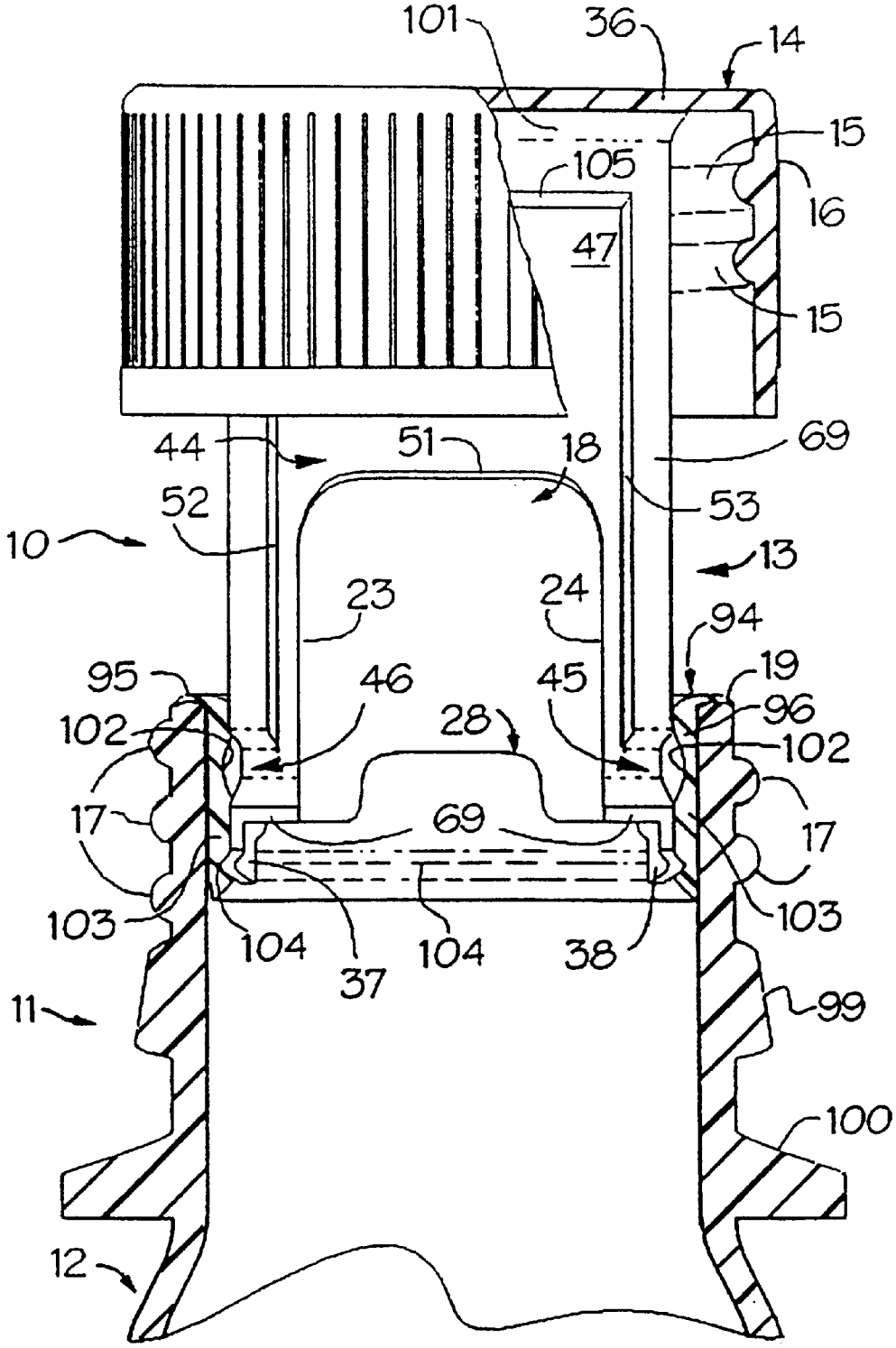
FIG. 20 is a side view similar to that of FIG. 13 showing an tenth embodiment.

FIG. 20 shows an embodiment of the invention in which a closure device 10 cooperates with an insert 94 secured in the neck 11 of a bottle 12 formed from polyethylene terephthalate (PET). The neck 11 is of known shape having a smooth cylindrical interior surface, a circular rim 19, an external male screw thread 17, an integral collar 99 below the screw thread 17, and an integral radially projecting flange 100 below the collar 99. In the initially sealed condition, the skirt 16 of the cap 14 of the closure device 10 has a separable retaining ring (not shown) with a radially inwardly extending flange that engages the annular shoulder presented to the flange 100 by the collar 99. When the cap 14 is initially unscrewed from the neck 11, the retaining ring (not shown) becomes detached from the skirt 16 and remains loose between the collar 99 and the flange 100.

The insert 94 has an internal annular ridge or bead 96 which, however, is not as pronounced as the ridge 96 of the insert 94 of FIG. 19. The upper or outermost surface of the ridge 96 slopes or curves towards the interior of the bottle 12 from the outer surface of the flange 95. The cylindrical wall 69 is joined to the inner surface of the flat wall 36 of the cap 14 by a substantially frusto-conical transition portion 101, the wider base of which is at the wall 36. The surface of the transition portion 101 may be curved to match a portion of a toroidal surface. When the closure device 10 is pushed into the closing position and the cap 14 is screwed down on the neck 11, the surface of the transition portion 101 bears against the upper or outermost surface of the annular ridge 96 of the insert 94. As the cap 14 is finally screwed down, the transition portion 101, by a wedging action, compresses the ridge 96 against the interior surface of the outer end of the neck 11, thereby easily forming a tight seal between the closure device 10 and the bottle 12.

Between the ridge 96 and the end remote from the flange 95, the insert 94 has a shallow annular internal trough 102 followed by a thick wall portion 103 with an annular internal groove 104. When the closure device 10 is in the position for a pouring operation, as shown in FIG. 20, the annular ridge 96 bears against the cylindrical wall 69 above the channels 45 and 46 and the cut out 28, the thick wall portion 103 bears against the arcuate portions of the wall 69 below the channels 45 and 46, and the groove 104 engages the catch member 37 and 38. The catch members 37 and 38 and the groove 104 are shown shaped to allow extraction of the closure device 10 from the insert 94. However, their shapes may be modified as explained hereinbefore with reference to the embodiments of FIGS. 5 to 6.

The annular ridge 96 of the insert 94 defines the mouth of the outlet conduit of the bottle 12. The side edges 23 and 24 of the side opening 18 of the hollow body 13 are set back radially relative to the inner periphery of the ridge 96 except at the arcuate portions of the wall 69 where the side opening 18 merges with the open end 30 of the hollow body 13, as best seen from the exploded perspective view of FIG. 21.

The part cylindrical wall 47 that forms the floor of the recessed region 44 merges with the floors of the channels 45 and 46. The two elongate flat walls 52 and 53 that lie in axial planes terminate at their outermost ends at an arcuate wall 105. The arcuate wall 105 is spaced axially from the transition portion 101 of the closure device 10 so that a right circular cylindrical portion of the hollow body 13 is provided between the recessed region 44 and the transition portion 101 to peripherally confine the entire ridge 96 during closure. The arcuate wall 105 may provide a smooth transition between the walls 47 and 69.

With the closure device 10 in the position illustrated in FIG. 20, two venting passages are formed by the two channels 45 and 46 cooperating with the trough 102, portions of the recessed region 44 between the ridge 96 and the wall 47, and the cut out 28. The parts of the two arcuate portions of the wall 69 which extend from the bottom or innermost ends of the edges 23 and 24 of the side opening 18 cooperate with the thick wall portion 103 of the insert 94 in presenting barriers to liquid during a pouring operation, and prevent the main stream of liquid to the outlet aperture sweeping through the inlet regions of the two venting passages. The two inlet regions respectively adjoin the outlet aperture at the edges 23 and 24 of the opening 18.

Figure 21:
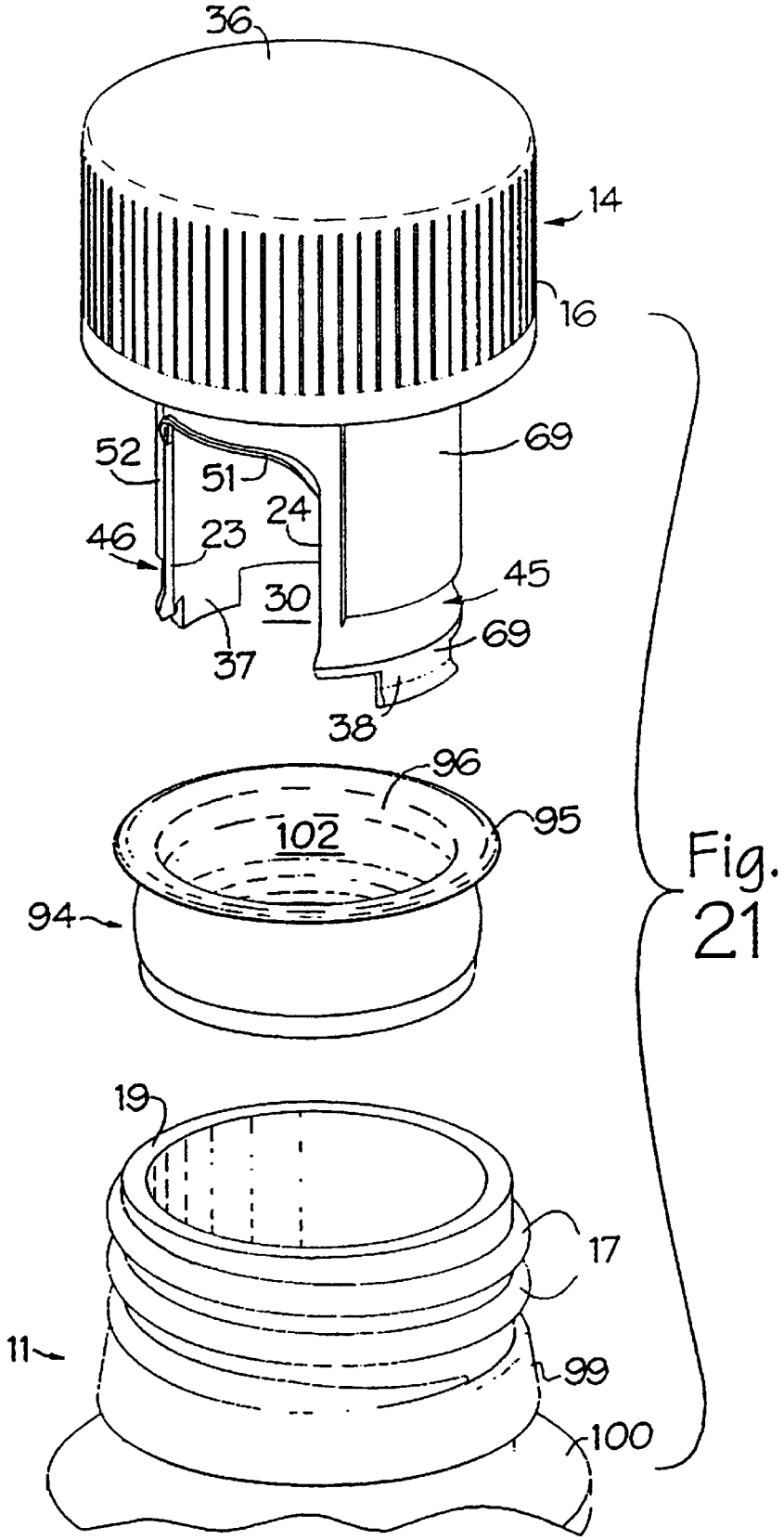
FIG. 21 is an exploded perspective view of the tenth embodiment.
Figure 22:
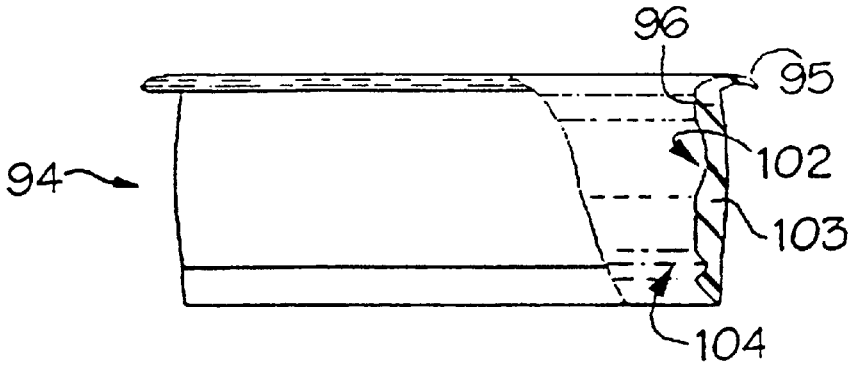
FIG. 22 is a side view, partly in axial section and partly broken away, of a component of the tenth embodiment.

As shown in FIG. 21, the insert 94 in its relaxed state is substantially barrel shaped beyond the flange 95 to ensure a tight fit inside the neck 11 of the bottle 12. The insert 94 is preferably made by moulding an elastomeric polymer. FIG. 22 shows the wall of the insert 94 in cross section in its relaxed state, before insertion into the neck 11. The inner periphery of the ridge 96 has a cylindrical surface giving the profile of the ridge 96 a flat region. The flange 95 is sufficiently thin to compress between the rim 19 and the flat wall 36 of the cap 14.

To avoid pinching of the junction of the flange 95 and the body of the insert 94 between the radially inner edge of the rim 19 and the transition portion 101 of the hollow body 13, the diameter of the wider end of the transition portion 101 should not exceed the internal diameter of the rim 19.

The outside surface of the body of the insert 94 between the groove 104 and the adjacent end of the insert 94 diminishes in diameter towards the end to facilitate entry of the insert 94 into the neck 11.

Figure 23:
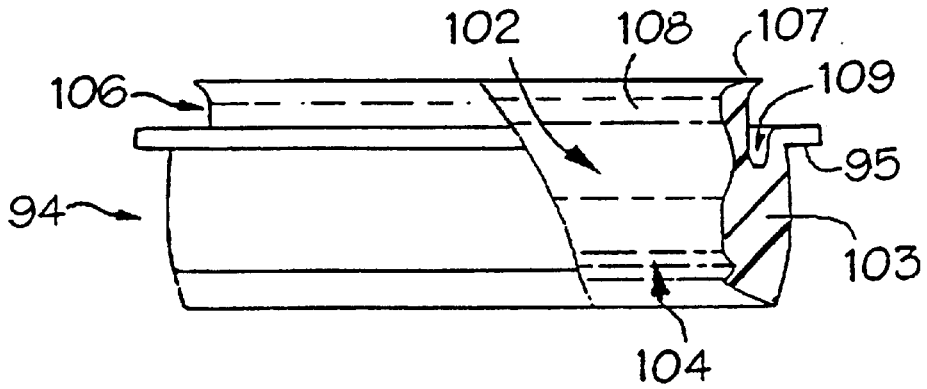
FIG. 23 is a view, similar to that of FIG. 22, of a component of a eleventh embodiment.

FIG. 23 shows another insert 94 which is similar in some features to the insert 94 of FIG. 22 but has a proportionately thicker wall to its body, a thicker flange 95, and, instead of the upper internal ridge 96 of the insert 94, an annular extension 106 defining an end mouth with a curved annular lip 107. The radially inner profile of the extension 106 is similar to that of the ridge 96 and has a corresponding flat portion presenting a cylindrical surface 108. The radially outer profile of the extension 106 is spaced radially inward of the radially inner periphery of the flange 95 and an annular trough 109 is formed in the thick wall portion 103 between the extension 106 and the flange 95. The lip 107 has a sharp radially outer edge that overhangs the trough 109 when the axis of the insert 94 is vertical. It will be appreciated that the lip 107 and the trough 109 together function as a drip trap.

Figure 24:
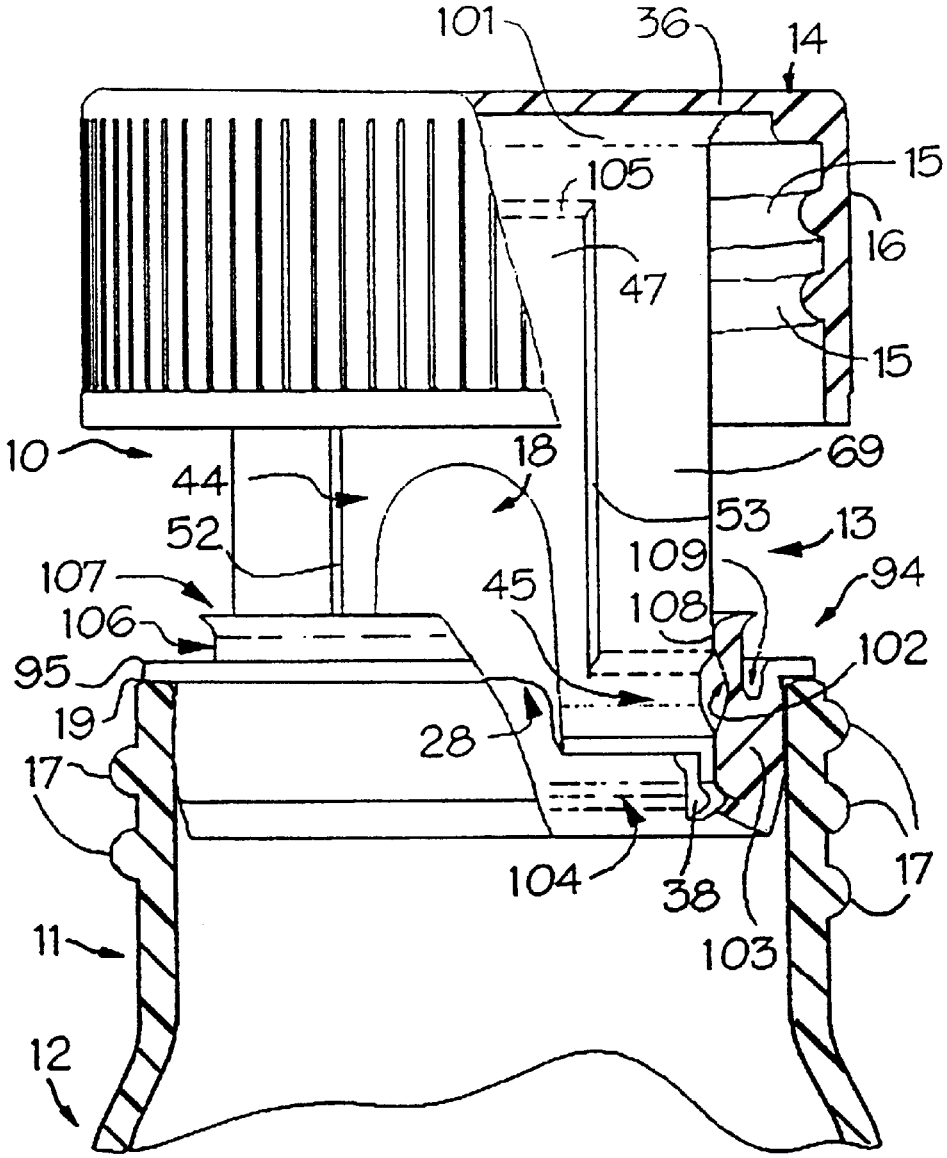
FIG. 24 is a side view, partly broken away and partly in axial section, of the eleventh embodiment.

FIG. 24 shows an embodiment of the invention utilising the insert 94 of FIG. 23. The insert 94 is inserted into the neck 11 of the relatively thick-walled bottle 12, such as a glass bottle. In FIG. 24, the wall 69 of the hollow body 13 is in contact with the cylindrical surface 108 of the insert, and with the thick wall portion 103 of the insert, so that fluid barriers are formed for a pouring operation with air entering the bottle 12 through two venting passages formed by the inlet regions in the recessed region 44, two parts of the trough 102, two corresponding channels (45 and one not shown), and the cut out 28. It will be appreciated that conventional inserts for olive oil bottles having screw down caps are known to include an extension and trough similar to the extension 106 and trough 109.

When the closure device 10 is pushed inwards through the insert 94 from the position shown in FIG. 24 and screwed down, finally the transition portion 101 of the hollow body 13 wedges into the extension 106 and forms a tight seal against the lip 107. The flat wall 36 of the cap 14 does not bear against the flange 95 of the insert 94 but is spaced from the outer annular surface of the flange 95 by the extension 106. An annular step is included in the cap 14 at the interior angle of the junction between the skirt 16 and the flat wall 36, with the radial extent of the flat annular surface of the step being sufficient to bear on the opposing surface of the flange 95 of the insert 94, and the axial depth of the step being chosen to ensure that substantially the whole of the axially directed sealing force exerted by the cap 14 when it is completely screwed down is exerted on the flange 95 backed by the rim 19.

When the liquid or other coherent flowable material in the bottle 12 is required on some occasions to be poured out in small quantities and on other occasions in large quantities, as for example in the case of olive oil, the catch members .38 and another not shown, and the groove 104 are shaped to allow extraction of the closure device 10 so that for pouring large quantities the closure device 10 can be removed. The embodiment has the advantage that a drip catching engagement, namely the extension 106 and trough 109, remains operative when the device 10 is removed. After a large quantity of the liquid or other material has been thus dispensed without the closure device 10 in the insert 94, the hollow body 13 of the closure device 10 is merely re-inserted into the insert 94. The tightness of fit of the insert 94 in the neck 11 should be made sufficiently good by the insert 94 being barrel shaped when relaxed and having a large enough area of dry contact with the inside of the neck 11 when installed for there to be no dislodging of the insert 94 whenever the closure device 10 is extracted. If necessary a non-toxic, non-oxidising adhesive may be included between the insert 94 and the neck 11 to ensure fixing.

The opening 18 may be made more like a longitudinal slot, i.e. having the distance between its axial side edges a small fraction of its axial length, if the embodiment is to be used for disposing thin liquid sauces such as soy sauce, or sparingly used ingredients such as vinegar.

Figure 25:
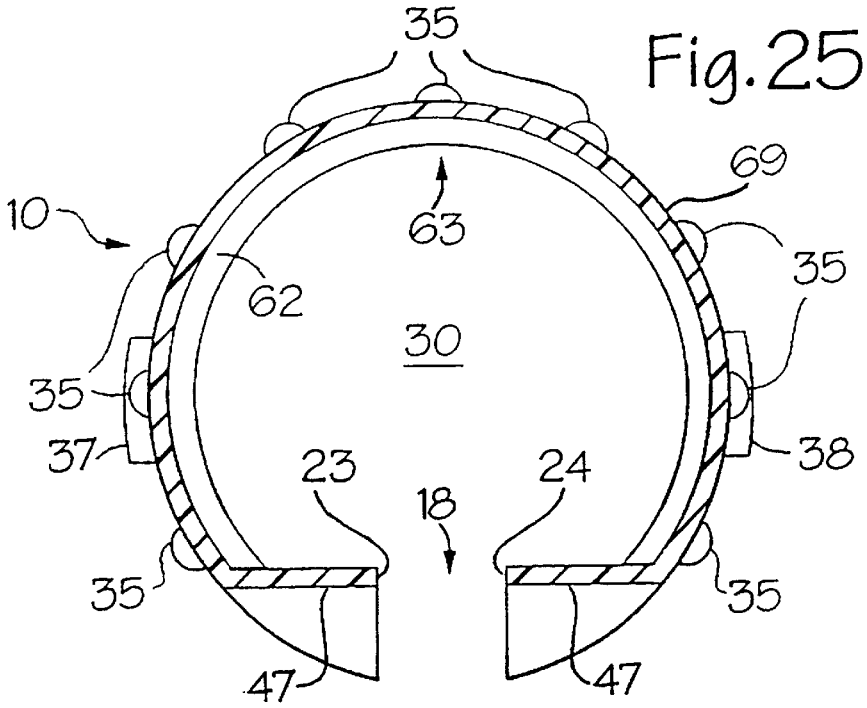
FIG. 25 is a radial cross-sectional view of part of the closure device of a twelfth embodiment of the invention.
Figure 26:
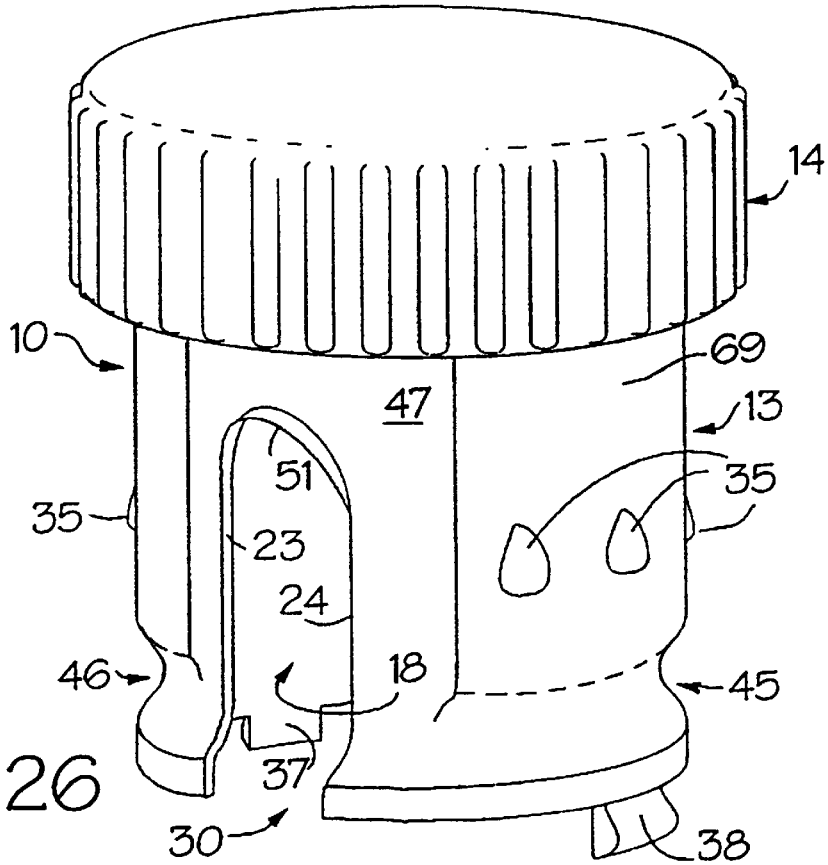
FIG. 26 is a perspective view of the closure device of the twelfth embodiment.

FIGS. 25 and 26 illustrate a closure device 10 of an embodiment of the invention having a hollow body 13 with a cylindrical wall 69 with, instead of a recessed region, a flat wall 47 in which the side opening 18 is formed. The closure device 10 has some features corresponding to those of the device 10 of FIGS. 7 to 12, including a cut out (not shown) at a position 63 diametrically opposite the side outlet opening 18. When this closure device 10 is positioned for a pouring operation, the axial or side edges 23 and 24 of the opening 18 are radially set back from the inner periphery of the outlet mouth of the outlet conduit of the container (not shown) by virtue of the flat wall 47, and regions of the flat wall 47 adjoining the opening 18 and the adjacent ends of the channels 45 and 46 define, with the opposing portions of the outlet conduit (not shown), inlet regions of two venting passages leading to the cut out (not shown) at the position 63. Towards the open end 30 of the hollow body 13 the flat wall 47 merges at each side of the opening 18 with the lower or inner-most halves of the outwardly concave walls defining the channels 45 and 46. Between the channels 45 and 46 and the open end 30 of the hollow body 13 there is a relatively short (in the axial direction) length of circular cylindrical wall (interrupted by the side opening 18 where it merges with the open end 30 and by the cut out, not shown), which may be regarded as part of the cylindrical wall 69 since it has the same external diameter as the wall 69.

In a pouring operation, the ends of the short, circular cylindrical wall at the open end 30 cooperate with the interior of the outlet conduit of the container (not shown)to provide barriers to liquid below inlet regions of the venting passages and prevent the inlet regions being swept out by the main stream of liquid.

Figure 27:
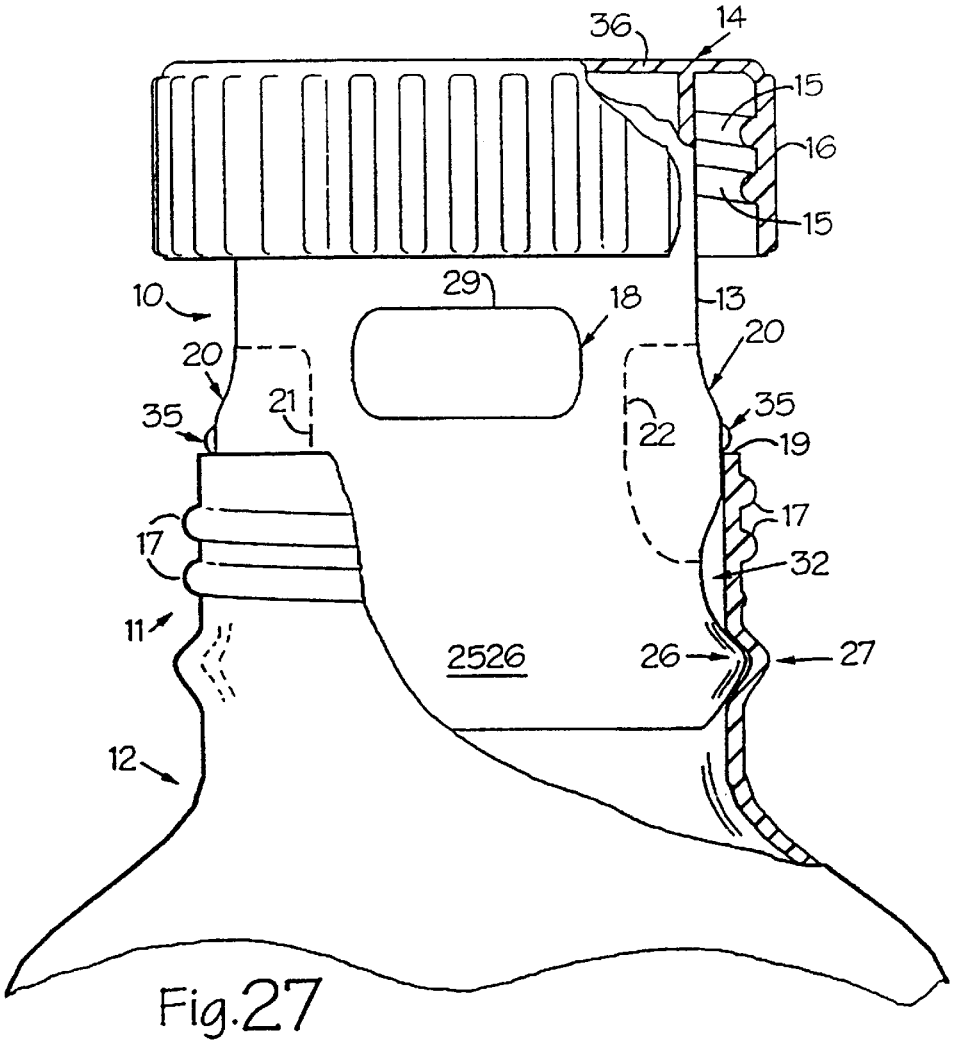
FIGS. 27 and 28 are side views corresponding to FIGS. 1 and 2 of an embodiment similar to the first embodiment.
Figure 28:
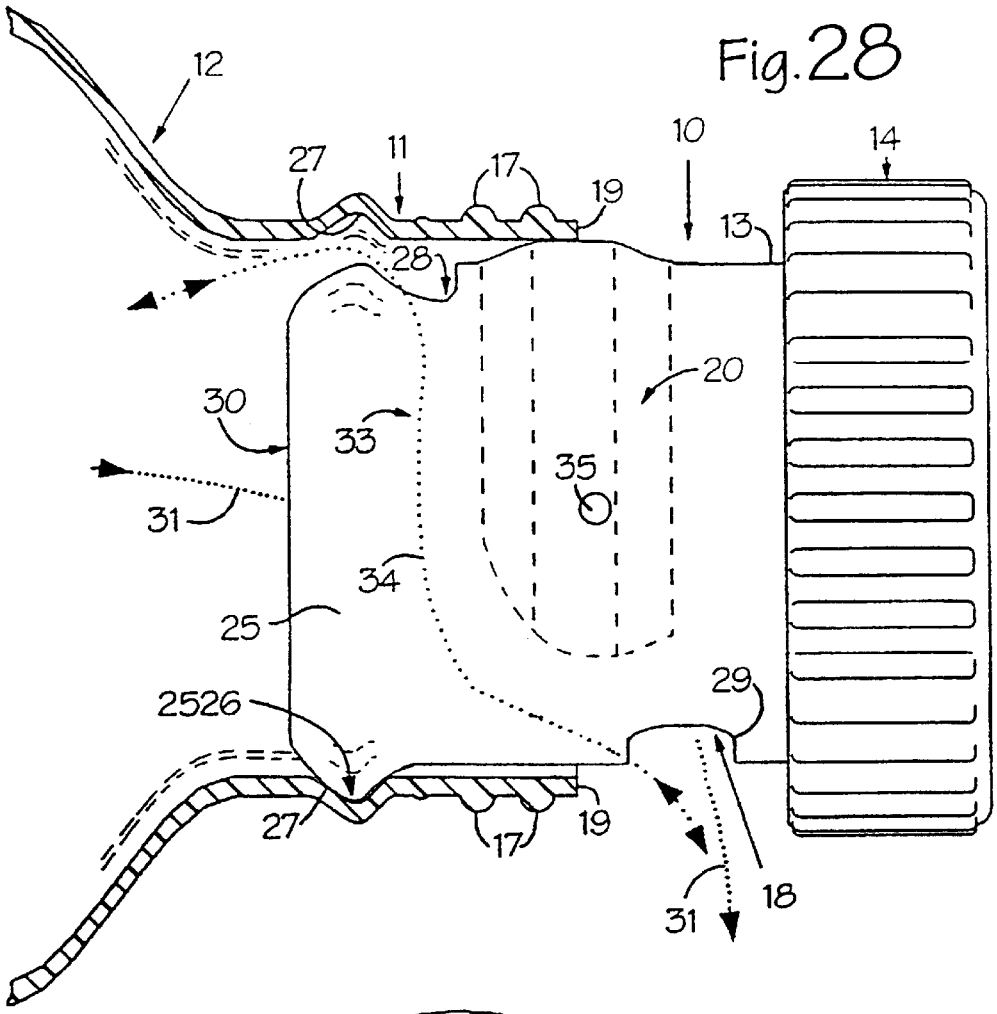

FIGS. 27 and 28 show an embodiment of the invention which is a variant of the embodiment of FIGS. 1 to 3. In this variant, the side outlet opening 18 does not merge with the open end 30 of the hollow body 13 but has an endless periphery including an innermost or lower edge substantially aligned circumferentially of the hollow body 13 with the outermost or upper shoulder of the enlargement 20 so that in the position for a pouring operation the lower edge of the side outlet opening 18 is slightly beyond the rim 19 of the neck 11. Thus in this embodiment the outlet aperture in the position for pouring operation is wholly defined by, and constituted by, the side outlet opening 18 of the hollow body 13. The relative dimensions of the projections 25 and 26 and the flexibility of the material of the hollow body 13 are made suitable for the ridge-like arcuate projections 25 and 26 to be continuous with an intermediate ridge-like projection 2526 as shown in FIG. 27 so that a single almost annular projection 25, 2526, 26 is formed which extends from one side to the other of the cut-out 28. The wall of the hollow body 13 between the opening 18, the end positions 21 and 22 of the enlargement 20, and the projection 2526, and the opposing portion of the neck 11 then define a common inlet region for the two venting passages 32 and 33.

Figure 29:
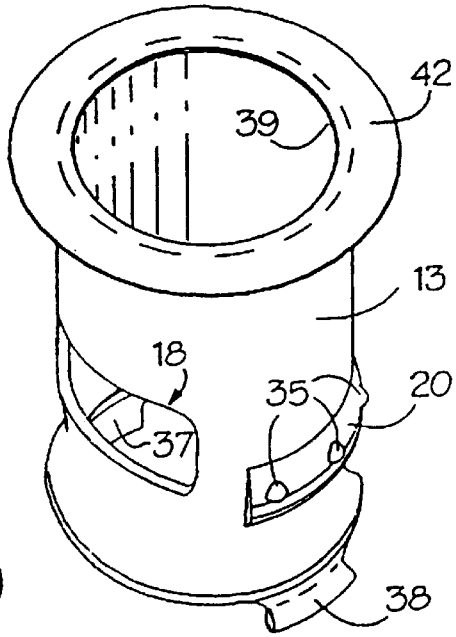
FIG. 29 is a perspective view of the hollow body of a closure device of an embodiment similar to the second embodiment.

FIG. 29 shows in perspective a variant of the hollow body 13 of the embodiment of FIGS. 4 to 6 where the side opening 18 constitutes the outlet aperture and a common inlet region is formed for the two venting passages 32 and 33 as in the embodiment of FIGS. 27 and 28.

Further embodiments having the outlet aperture constituted by the side outlet opening of the hollow body of the closure device and a common air inlet region formed between an inner fluid barrier which is continuous circumferentially from one side of the common air outlet port to the other side thereof can be accordingly be constructed as variants of the embodiments described hereinbefore with reference to FIGS. 13 to 26 of the accompanying drawings. Such variants are illustrated respectively by FIGS. 30 to 33. It should be noted in connection with the embodiment of FIG. 30 that because the parts of the arcuate enlargements 81 which provide the lower shoulders 83 are continuous below the recessed region 44, the enlargements 81 must be small enough in the radial direction to allow the hollow body 13 to be initially inserted into the top of the neck 11 with the amount of flexibility provided by the cut out (not shown) corresponding to the cut out 28 of FIG. 16, and the thinness of material forming the hollow body 13.

It will be appreciated that in such embodiments, where the lower or innermost part of the endless edge of the side outlet opening of the hollow body is radially set back relative to the end mouth of neck or other outlet conduit and is above an intermediate portion of the inner fluid barrier, for example the portion completed by the intermediate projection 2526 of FIGS. 27 and 28, the inner fluid barrier is able to catch drips from the lower part of the side outlet opening at the end of a pouring operation, and material caught in this manner in the common air inlet region will be returned to the interior of the container through the common air outlet port or when the closure device is set in the closing position.

In the closure device 10 of FIG. 33, the two channels 45 and 46, which run from a common inlet region below the outlet opening 18 to a cut out (not shown) merging with the open end 30 of the hollow body 13 at a position at the opposite side of the hollow body from the opening 18, are downwardly inclined from the common inlet region to the cut out (not shown) when the closure device 10 is vertical, as illustrated. This configuration of the channels 45 and 46 has the advantage that, especially where a relatively viscous liquid, such as an automobile lubricating oil, is poured from the container (not shown) through the closure device 10, any liquid remaining in the common inlet region below the opening 18 and in the channels 45 and 46 when the container is returned to the vertical position is urged by gravity to flow back into the container through the channels 45 and 46 and the cut out (not shown). It will also be seen that a lower or innermost portion of the cylindrical wall 69 of the hollow body 13 defines the open end 30 of the hollow body except where it is interrupted by the cut out (not shown) which serves as the common outlet port of the inclined channels 45 and 46. This lower portion of the cylindrical wall 69 cooperates with the inner surface of the outlet conduit (not shown) of the container (not shown) to provide a barrier to liquid during a pouring operation, the barrier preventing the inclined channels 45 and 46 and their common inlet region from being washed out by direct flow liquid from the interior of the container (not shown). In a further embodiment which is a modification of that of FIG. 33, the inclined channels are provided as grooves or recesses in the outlet conduit, which may be the neck, of the container, and the hollow body 13 is formed with the cylindrical wall 69 being made continuous to eliminate the channels 45 and 46. The inclined channels in the outlet conduit are opposing portions of a single, continuous encircling groove or recess inclined at an angle to the longitudinal axis of the outlet conduit which ensures that this groove communicates with a common air inlet region formed by the space between the flat wall 47 and the inner surface of the outlet conduit when the closure device is in the position for a pouring operation, while a diametrically opposite portion of the encircling groove or recess communicates with the cut out of the hollow body 13. To ensure that the closure device is correctly orientated within the outlet conduit for a pouring operation, the outlet conduit is provided with a locating recess of restricted circumferential extent to guide and locate the or each catch member 38. If the container (not shown) is made to include a hollow handle that provides communication between a neck forming the outlet conduit of the container and the main body of the container, the hollow body 13 of the modification just described may omit the cut out, the cylindrical wall 69 provide a continuous circular rim at the open end 30 of the hollow body 13, and the single, continuous encircling groove or recess inclined at an angle to the longitudinal axis of the outlet conduit have its lowest part merged with the neck end of the hollow handle. In this further modification, the common air inlet region below the side opening 18 in a pouring operation communicates with the hollow handle (not shown) which serves as the air outlet port of the two branches of venting passageway provided by the encircling groove or recess (not shown). A similar embodiment may be formed by again omitting the cut out (not shown) from the closure device 10 of FIG. 33, retaining the channels 45 and 46 and forming the cylindrical wall 69 as a complete ring at the open end 30 so that the two channels 45 and 46 merge at their lowest points and are separated from the open end 30 of the hollow body by the ring of cylindrical wall 69. A hollow handle is again provided as part of the container (not shown) to serve as an air outlet port communicating with the channels 45 and 46 at their common lowest point. The neck of the container in this latter embodiment would be internally a plain cylinder in which the cylindrical wall 69 would slide, except for the opening defining the neck end of the hollow handle, and the locating recess of restricted circumferential extent for engaging the or each catch member 38 with the closure device correctly positioned for a pouring operation in which the channels 45 and 46 and the hollow handle communicate. Where embodiments utilise a hollow handle as the air outlet port, the part or branches of the venting passageway which extend from the air inlet region or regions adjoining the side outlet aperture for liquid or the like are preferably inclined downwardly from the air inlet region or regions to the neck end of the hollow handle when the container is vertical to ensure that any liquid or the like in the venting passageway runs back into the hollow handle. Preferably the hollow handle is so shaped that it will return such liquid or the like to the main space in the container. If the handle is not hollow, and the closure device of FIG. 33 is modified, as just described, by the omission of the cut out (retaining the channels 45 and 46 and forming the cylindrical wall 69 as a complete ring at the open end 30 so that the two channels 45 and 46 merge at their lowest points and are separated from the open end 30 of the hollow body by the ring of cylindrical wall 69), the closure device provides an unvented outlet opening 18 for liquid or the like and the space which served as the common air inlet below the opening 18 in the pouring position now serves as a drip catcher. Liquid or the like thus caught is retained in the channels 45 and 46 until the closure device is returned to the closing position in which at least the common lowest point of the channels 45 and 46 is below the cooperating part of the outlet conduit and is able to release the caught material to the interior of the main body of the container, as when the drip apron 43 of the embodiment of FIGS. 7 to 12 is returned to the position of FIG. 12. The embodiments of FIGS. 27 to 32 can be similarly modified by omission of the air outlet port to provide unvented closure devices with a drip catching and releasing function utilising the structure of the common air inlet region and the venting passages which are, in these modifications, no longer used for venting. The unvented closure devices just described are particularly useful with containers which can be squeezed to eject a paste or a thick flowable material such as tomato ketchup or shampoo.

Figure 30:
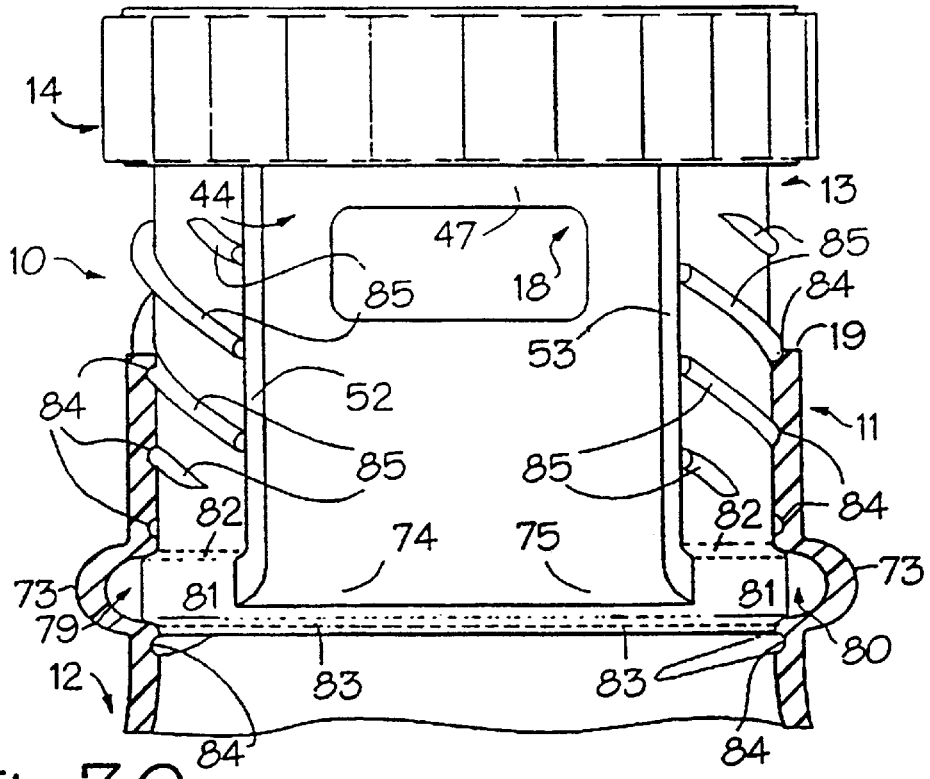
FIG. 30 is a side view, with the outlet conduit in axial section, of an embodiment similar to the sixth embodiment.

In a further embodiment which is a modification of either that of FIG. 16 or that of FIG. 30, the interior of the skirt of the cap 14 and the exterior of the neck 11 of the bottle 12 are provided with a groove and bead snap fitting arrangement such as the groove 86 and the bead 87 of FIG. 17, and the internal female threads 84 of the neck 11 are replaced by two, diametrically opposite, hemispherical internal projections adjacent the rim 19 of the neck 11, and the male threads 85 of the hollow body 13 are replaced by substantially diametrically opposite single female threads, or grooves, each of which follows part of a helical path from immediately below the flat wall of the cap 14 to a position below the rim 19 when the enlargements 81 are engaged in the annular bulge 73. The two hemispherical projections on the neck 11 are engaged respectively in the two female threads or grooves in the hollow body so that the closure device makes part of a revolution whenever it is moved between its closing and pouring positions. The closure device is held in its closing position by the snap fitting engagement between the skirt of the cap and the neck of the bottle. The engagement between the hemispherical projections and the female threads acts as a smoothly running guide during movement of the closure device from the pouring position to the closing position, so that the user can simply push the closure device back into the closing position from the pouring position. In an alternative arrangement, the hemispherical projections are provided on the hollow body adjacent its open end, and corresponding part helical grooves are provided within the neck of the bottle. The general principles of push and twist snap fitting closures are known from U.S. Pat. No. 3,690,520.

Figure 34:
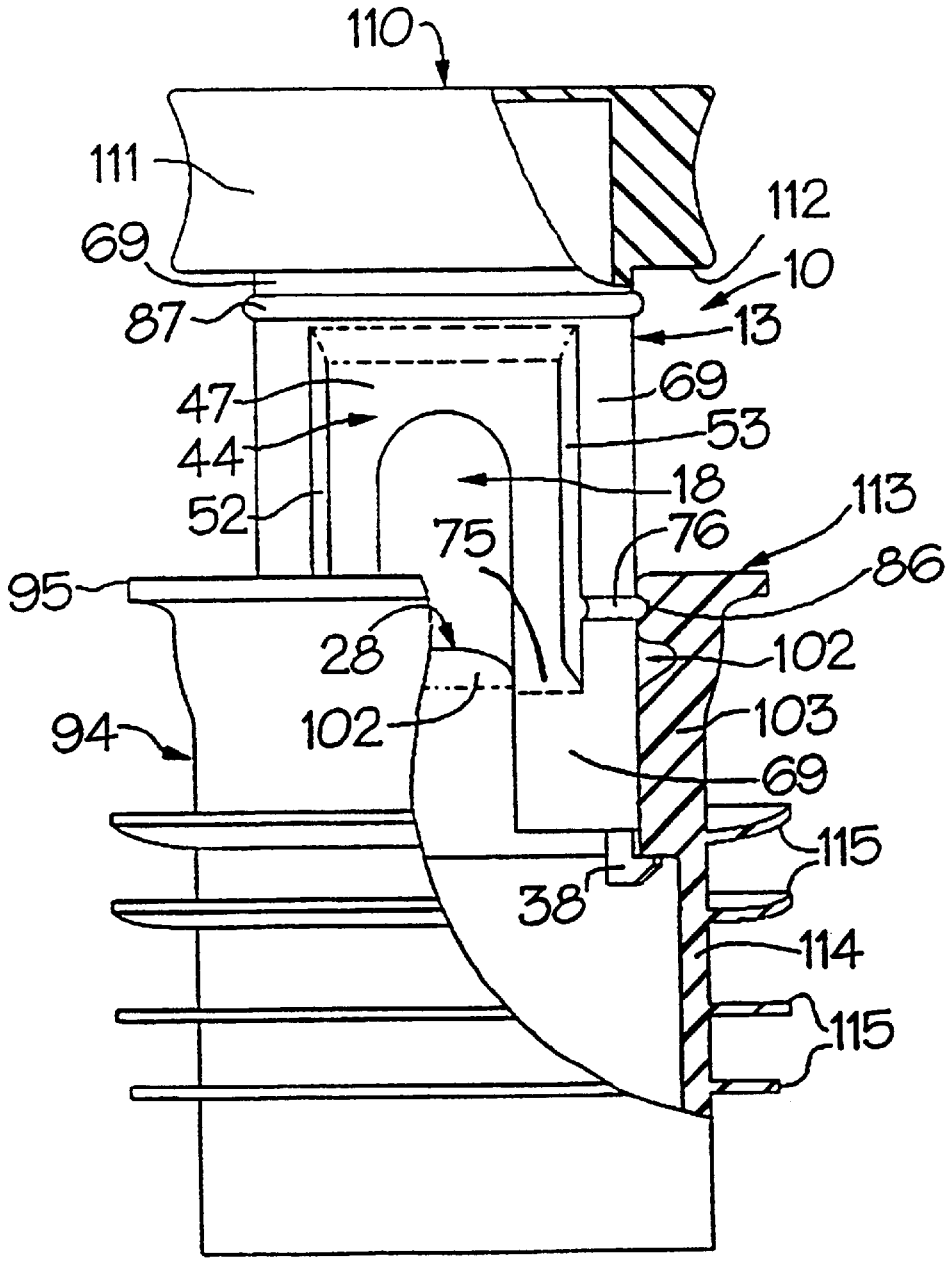
FIG. 34 is a side view, partly in axial section, of a combination embodying the invention, the combination consisting of a closure device and an insert.

FIG. 34 shows another embodiment of the present invention in the form of a combination of a closure device 10 and an insert 94. The combination is intended to be used to replace the closure, such as a cap or a cork, of a bottle having a neck with a smooth interior surface that is substantially a cylinder of circular cross section for at least about three quarters of an inch (2 cm) below the rim. In use, the initial cap or cork or other closure of the bottle (not shown) is removed, and the insert 94, with the closure device 10 in a closing position to be described hereinafter, is pushed into the neck of the bottle until a radially extending flange 95 of the insert 94 rests on the rim of the neck, like the flange 95 resting on the rim 19 in FIG. 26. The closure device 10, which in FIG. 34 is shown in the position for a pouring operation, has a hollow body 13 with a cylindrical wall 69 interrupted by a recessed region 44, an arch-like side outlet opening 18 which merges with the open end of the hollow body 13 and extends into a floor wall 47 of the recessed region 44, and a cut out 28 diametrically opposite the opening 18 but of smaller axial extent. The cylindrical wall 69 is provided with an upper, complete ring-like circumferential bead 87, and a lower circumferential bead 76 that is interrupted by the recessed region 44. At its open end, the hollow body 13 has two axially projecting legs with radially outwardly projecting feet, one, 38, of which is shown in FIG. 34. Each of the feet has a flat, radially extending engagement surface facing in the axial direction of the hollow body 13 towards a closure end portion 110 of the hollow body. The closure end portion 110 has a flat end wall that terminates the space within the hollow body 13, and a thicker circumferential wall 111 with a concave outer surface to facilitate gripping of the end portion 110 with a finger and thumb of a user. The closure end portion 110 has a flat, annular lower surface 112 that adjoins the top of the cylindrical wall 69 above the upper bead 87. When the closure device 10 is in its closing position, the annular surface 112 bears against a larger annular surface 113 provided by a head portion of the insert 94 and including the upper surface of the flange 95. In the closing position, the upper bead 87 is engaged in an annular internal groove 86 in the head portion of the insert 94. The head portion is defined by the free end of a thick walled portion 103 of the insert 94 which has a through passage defined by the thick walled portion 103 and an adjoining thin walled portion 114. The thick and thin walled portions 103 and 114 together define a cylindrical outside surface which is equipped with flexible radially projecting fins 115 and has a diameter that is less than the internal diameter of the neck of the bottle (not shown). The fins 115 diminish in diameter towards the free end of the thin walled portion 114 and are concave upwards adjacent the junction between the thin and thick walled portions 114 and 103. Towards the head portion with the flange 95 and the surface 113, the outside surface of the thick walled portion 103 increases smoothly in diameter to provide a tight fit in the neck of the bottle. When the insert 94 is pushed into the neck of the bottle, the fins 115 are folded or bent radially inwards so that the insert 94 can only be withdrawn from the neck by a strong pull.

With the insert 94 secured in the neck of a bottle as described, the closure device 10 can be pulled out from its closing position, in which the upper bead 87 is engaged in the groove 86 and the surfaces 112 and 113 are in contact with one another, to the position for a pouring operation shown in FIG. 34 in which the lower bead 76 is engaged with the groove 86 and the side opening 18 is partly exposed beyond the head portion surface 113 of the insert 94. In the latter position, the flat, radially extending engagement surfaces of the feet of the legs, such as the leg 38, bear upwardly against a downwardly (inwardly relative to the bottle which is not shown) facing annular surface formed within the insert 94 at the junction between the thin and thick walled portions 114 and 103 of the insert 94. This engagement prevents the closure device 10 from being pulled out of the insert 94. Also, two circumferential channels through which air can pass are formed by the cooperation of an internal annular groove 102 in the thick walled portion 103 of the insert 94 and opposed portions of the cylindrical wall 69 below the lower bead 76. Each of these channels forms a part of a passage for air extending from a respective inlet region in the recessed region 44 of the device 10 and the outlet port provided by the cut out 28, which lies between the lower bead 76 and the open end of the hollow body 13. It will be seen that the recessed region 44 is bounded by flat walls 52 and 53, and transition surfaces such as the surface 75, like the recessed region 44 of FIG. 20. Contact between the cylindrical wall 69 and the internal surface of the thick walled portion 103 of the insert 94 below the groove 102 provides fluid barriers that prevent the inlet regions of the passages for air being washed out by direct streams of liquid from the bottle during a pouring operation.

Figure 31:
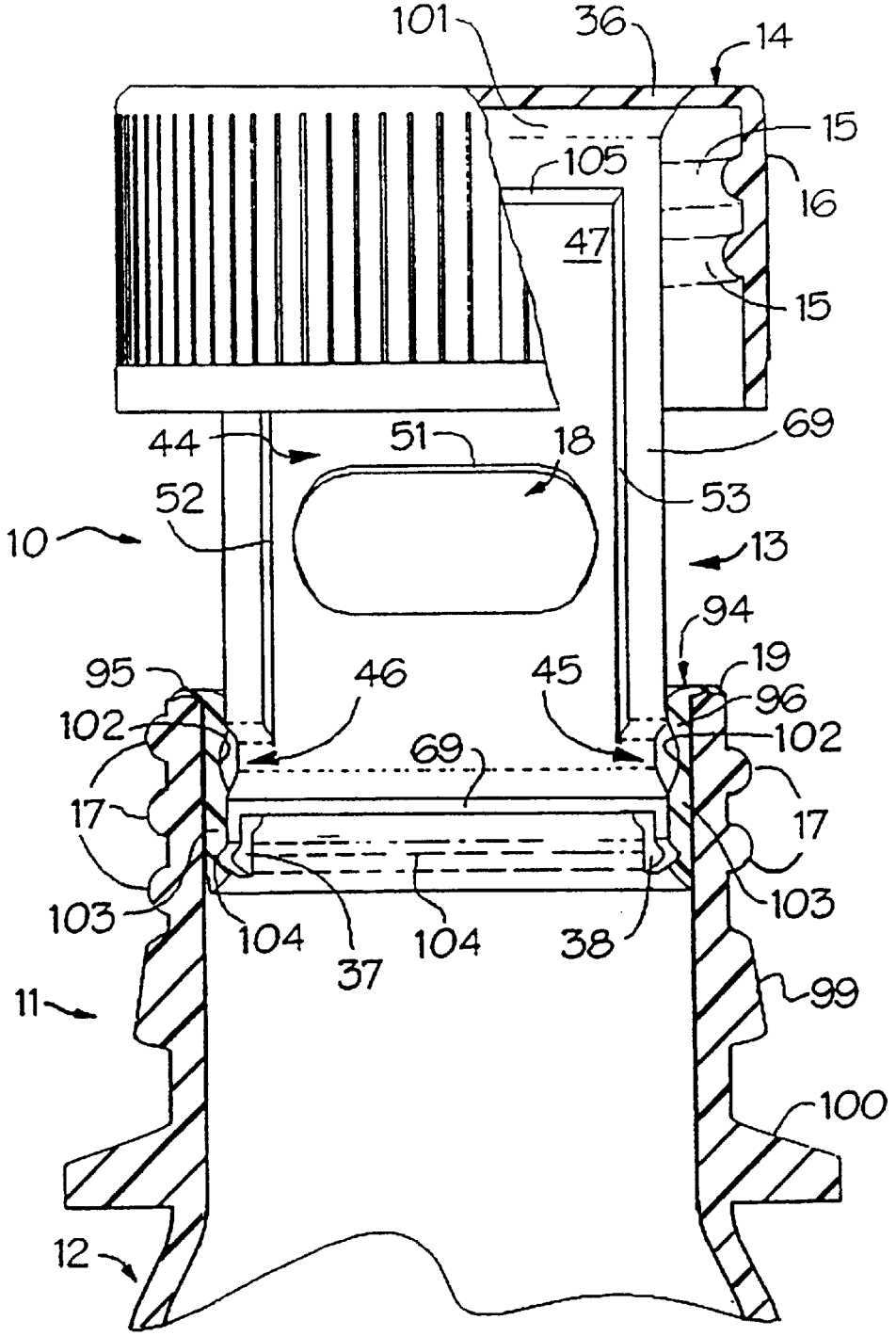
FIG. 31 is a side view, with the outlet conduit in axial section and the closure device partly broken away and partly in section, of an embodiment similar to the tenth embodiment.
Figure 32:
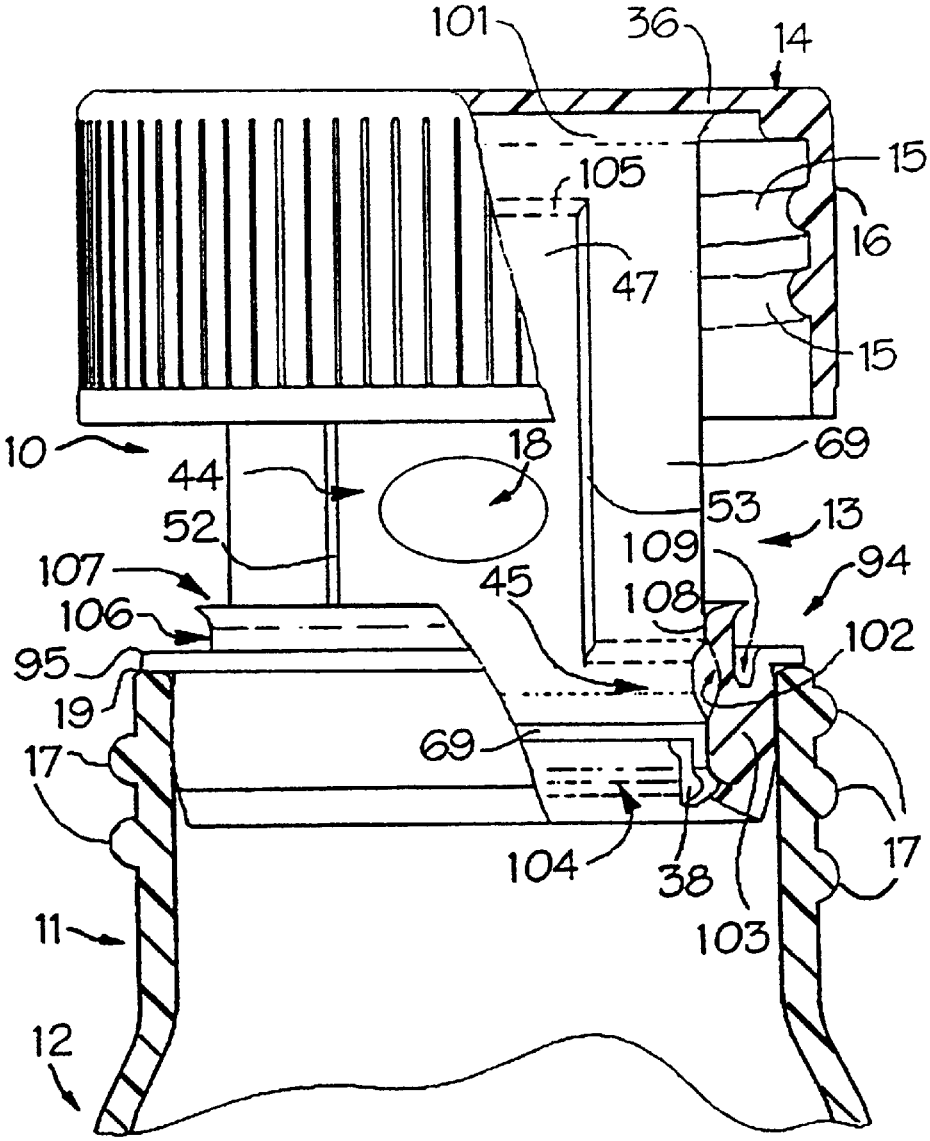
FIG. 32 is a side view, partly broken away and partly in axial section, of an embodiment similar to the eleventh embodiment.
Figure 33:
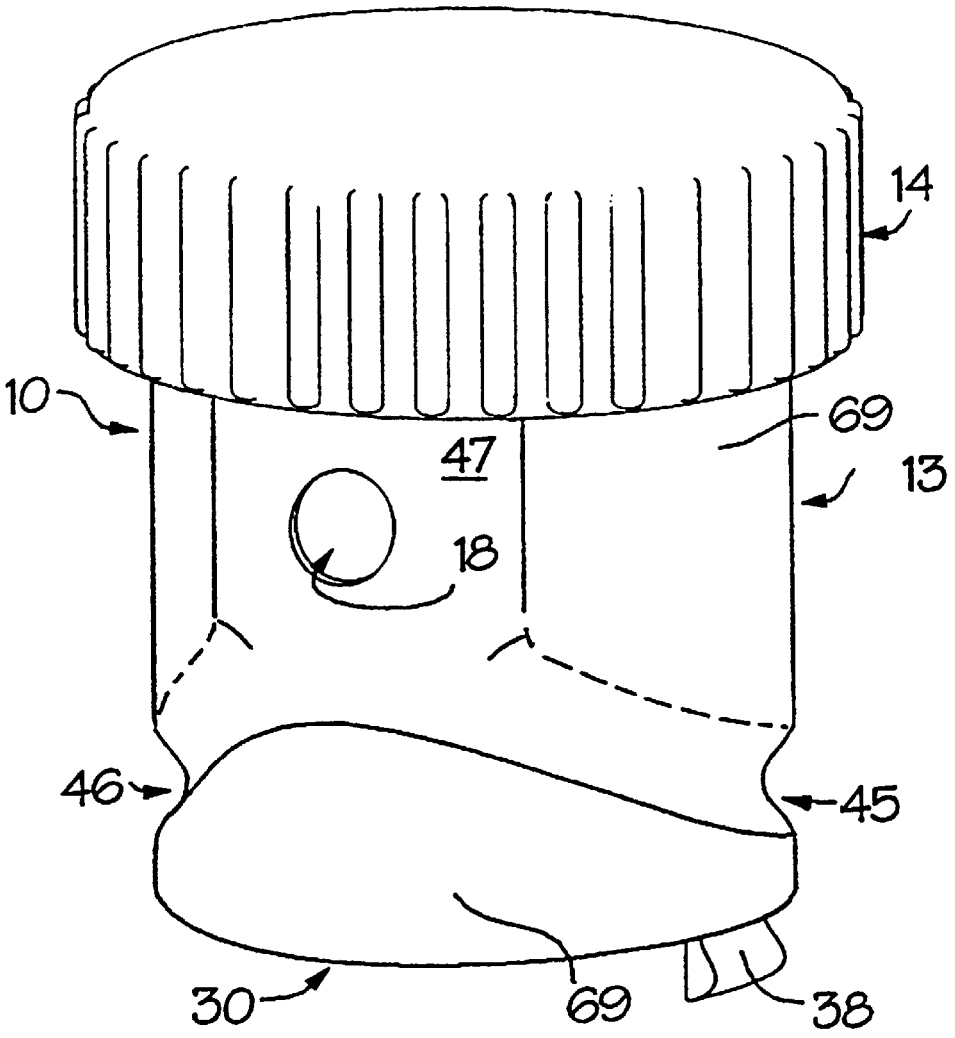
FIG. 33 is a perspective view of the closure device of an embodiment similar to the twelfth embodiment of the invention.

Instead of the side outlet opening 18 which merges with the open end of the hollow body 13, there may be a simple hole, like the holes 18 of FIGS. 31 and 32, in the floor wall 47 of the recessed region 44 which then provides a common inlet region, bounded by a continuous stretch of the wall 69, for the two air passages.

Alternative structures may also be employed for the outlet port or ports of the two air passages instead of the cut out 28. For example, one or more flats or grooves may be provided each at a position circumferentially displaced from the side outlet opening or hole in the hollow body and running axially between a position communicating with the annular groove 102 of the insert 94 to the rim defining the open end of the hollow body. Such air outlet ports would be similar to the arrangements for entry of air described in U.S. Pat. Nos. 2,790,582 and 2,919,057 but different in that the axial path is blocked by the engagement between the lower bead 76 and the groove 86 in the position for a pouring operation. More generally, in embodiments such as those of FIGS. 7 to 12, 14 and 15, and 20 and 21, the cut out may be replaced by a relatively thin wall which defines an external recess in the hollow body of the closure device, the recess cooperating with the interior of the outlet conduit to provide a communicating space between the circumferential arcuate venting passages and the interior of the container. In particular, the cylindrical wall 69 may, instead of a cut out 28 or one or more axially extending grooves or flats, have as an outlet port a simple hole providing communication between the groove 102 and the interior of the hollow body 13. It should be noted, however, that manufacture by injection moulding of the closure device 10 with the side opening 18 and the cut out 28 which merge with the open end of the hollow body does not require a side core.

In another embodiment which is a modification of the closure device 10 and insert 94 of FIG. 34, a channel, similar to the channels 45 and 46 of FIG. 20, is provided in the hollow body 13 and extends circumferentially around the hollow body 13 below the level of the bead 76 to cooperate with the groove 102 in the insert 94 when the closure device is in the position for a pouring operation. Instead of a cut out corresponding to the cut out 28, an outlet port for air is provided in the form of an axially directed hole or bore which opens at its uppermost end at the circumferentially extending groove, and extends down beyond the open end of the hollow body as the bore of a tube of relatively small outer diameter. This tube is sufficiently long to ensure that the air finally enters the bottle at a position well within the body of the bottle.

Such variants of the outlet port for air may be employed in embodiments which are otherwise as described hereinbefore with reference to any of the FIGS. 1 to 33, and especially where legs such as the legs 38 of FIG. 4 or FIG. 34 are used to prevent the closure device being accidentally pulled out beyond the position for a pouring operation. For embodiments such as that of FIGS. 1 to 3 or 27 and 28, relative dimensions must be chosen to ensure that the hollow body can be inserted into the neck or other outlet conduit. Alternatively, instead of providing the hollow body with arcuate projections such as the projections 25 and 26 of FIGS. 1 and 2, the corresponding portion of the hollow body may have an outer diameter that matches the inner diameter of the neck or conduit at its mouth, and have two or more flexible parts created by defining each such part between a pair of axial slits extending from the open end of the hollow body. Each such flexible part is formed with a radially outwardly projecting hemispherical pip that can locate in a groove such as the groove or recess 27 in the neck 11 of the bottle 12 of FIGS. 1 and 2. Thus each pip acts as a spring-loaded projection or catch with the flexible part on which it is formed acting as a spring strip attached at one end to the main body of the closure device.

Instead of the insert 94, other forms of bung may be used for the insert which cooperates with the closure device 10. Although the interior of the bung must provide an axial through passage with grooves 102 and 86 and a radial engagement surface or surface for the feet of the legs 38 and the other (not shown), and the head portion must provide an annular surface 113, the external configuration of the bung may be of any kind suitable for securing the combination of the closure device 10 and the bung in the neck of a bottle without risk of the bung being accidentally pulled out when the closure device 10 is drawn out to its position for a pouring operation. For example, instead of a cylindrical outer surface with fins 115, the bung may have a series of frusto-conical surfaces each tapering towards the innermost or lower end of the bung, i.e. away from the head portion, so that a series of annular shoulders is presented on the outside of the bung. Such a bung would retain the flange 95 of the insert 94.

In the embodiments described hereinbefore it may be advantageous to include, in addition to the lip 51 at the upper edge of the side opening 18, a complementary internal lip within the hollow body 13 at the upper edge of opening 18 to ensure that liquid falling from the interior of the upper, closed end of the hollow body 13 drops into neck 11 or other outlet conduit.

Figure 35:
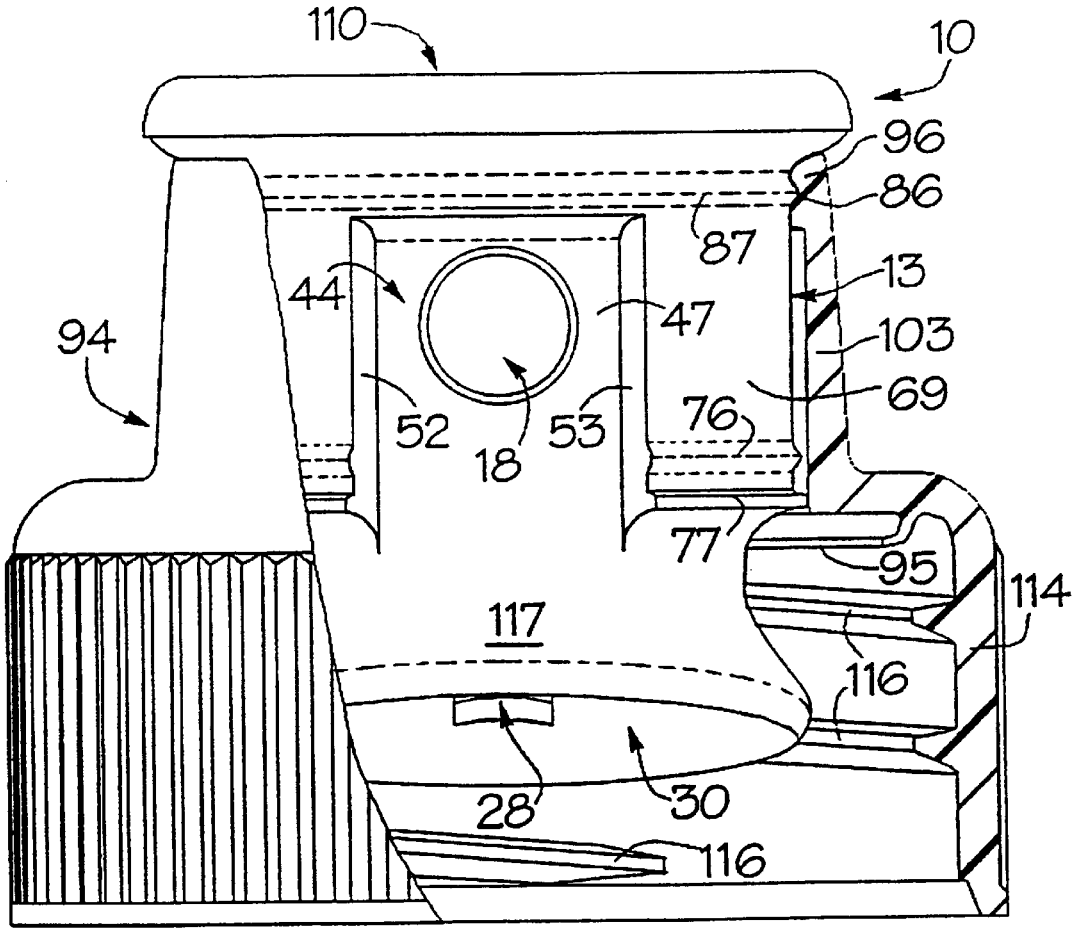
FIG. 35 is a side view of a closure device embodying the invention and engaged in a closing position with a cooperating outlet conduit end-piece which is shown partly broken away and partly in axial section.

FIG. 35 shows a closure device 10 positioned in an end-piece 94 for the neck 11 (FIG. 36) of a bottle (not shown) to seal an outlet conduit formed by the neck 11 and its end-piece 94, the outlet conduit having an end mouth defined by an internal annular ridge 96 of the end-piece 94. The bottle (not shown) and the end-piece 94 together form a container, the container including the outlet conduit defined as just described.

The closure device 10 has a hollow body 13 with a closure end portion 110 at one end shaped to seal against the ridge 96 of the end-piece 94. The other end 30 of the hollow body 13 is open.

The hollow body 13 is formed with a side opening 18. The side opening 18 does not merge with the open end 30 of the hollow body 13 but has an endless periphery. With the closure device 10 in the position illustrated in FIG. 36, the side opening 18 is exposed beyond the mouth defined by the ridge 96 at the end of the end-piece 94 and constitutes an outlet aperture for liquid from the bottle (not shown), the position in FIG. 36 being the position for a pouring operation, and it will be seen that the lowest point on the periphery of the side opening 18 is slightly beyond the ridge 96 of the end-piece 94, so that the outlet aperture in the position for a pouring operation is wholly defined by the side opening 18 of the hollow body 13.

Part of the hollow body 13 is tubular with a constant external diameter except for a longitudinally extending recessed region 44 in which the side opening 18 is formed.

The floor of the recessed region 44 of the body 13 is defined by a wall 47 which is substantially part of a circular section cylinder and includes the side opening 18.

Figure 36:
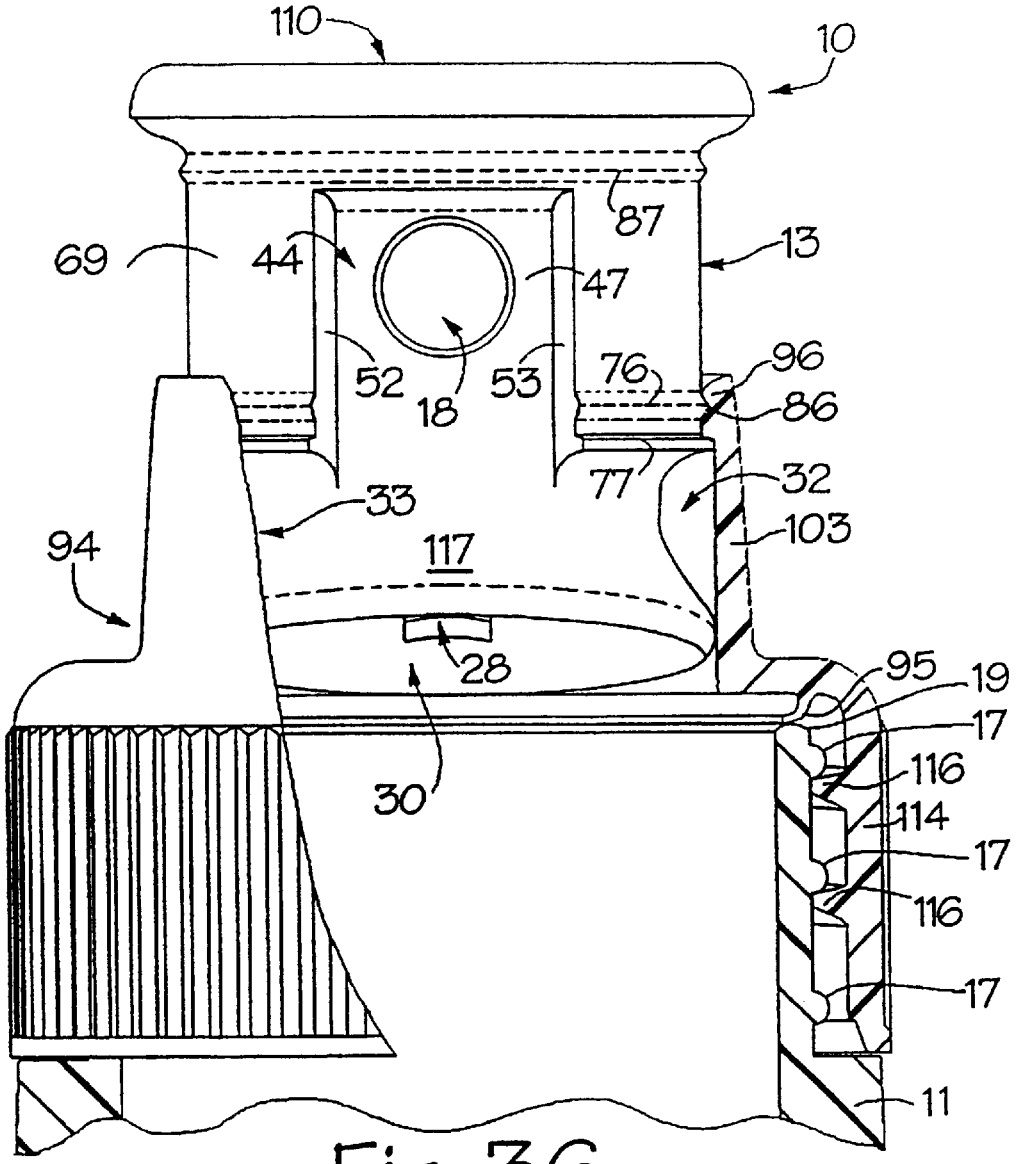
FIG. 36 is a side view of the closure device and end-piece of FIG. 35 engaged in a position for a pouring operation, with the end-piece shown partly broken away and partly in axial section and screw-threadedly engaged with the end part of the neck of a bottle.

Below the side opening 18, the radially set back wall 47 of the hollow body 13 merges with a skirt 117, and defines with an opposing tubular portion 103 of the end-piece 94 a common air inlet region for two venting passages 32 and 33 which extend circumferentially around opposite sides of the skirt 117 to a common air outlet port 28 when the closure device 10 is in a position for a pouring operation, as shown in FIG. 36. The two passages 32 and 33 are arcuate and extend around respectively diametrically opposite extents of a circumference of the hollow body 13.

Figure 37:
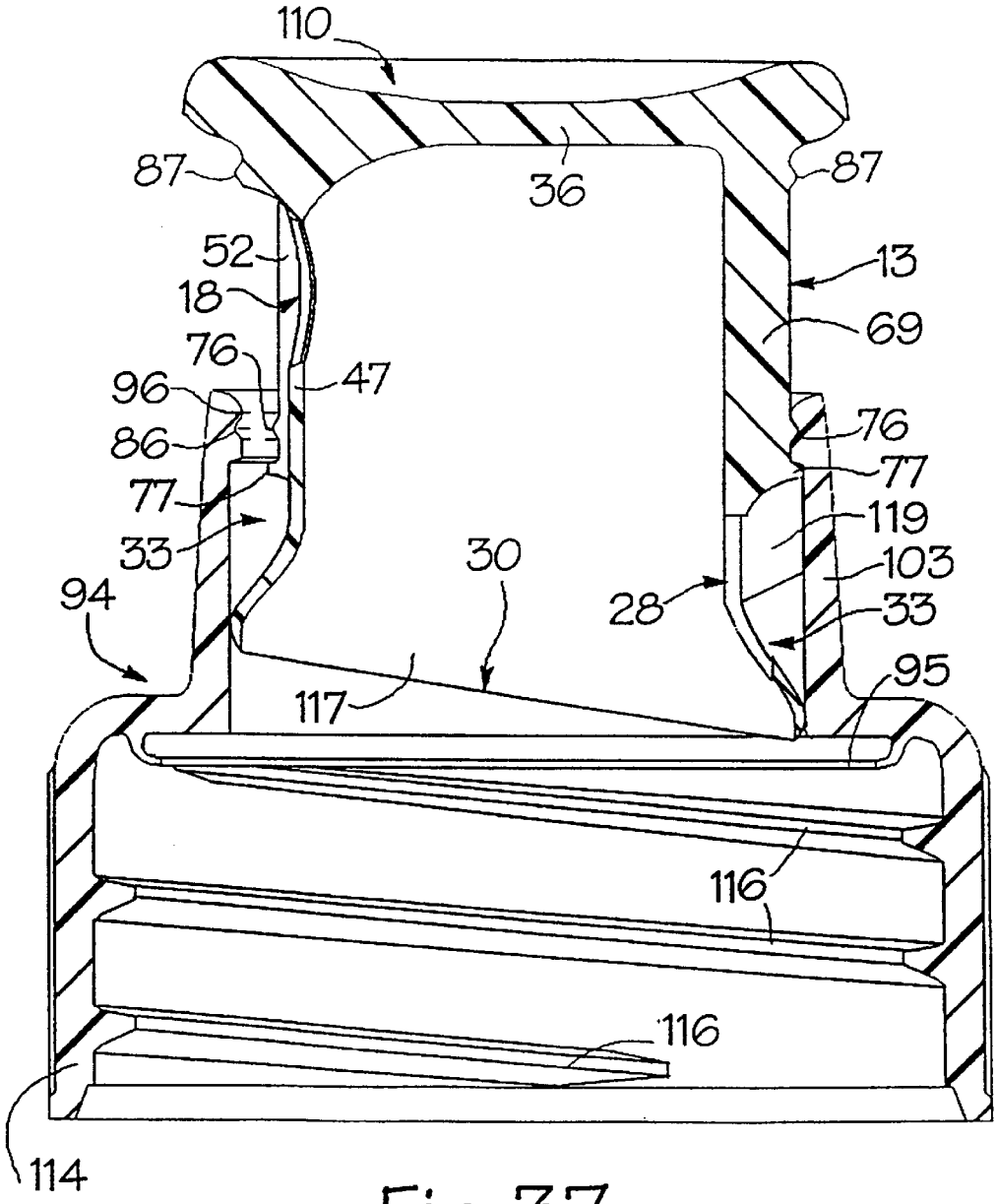
FIG. 37 is an axial sectional view of the closure device and the end-piece of FIG. 35 with the closure device in the position for a pouring operation and the axial plane of section passing through a side outlet opening of the closure device.

The two venting passages 32 and 33 indicated in FIG. 36 are bounded by the two barriers. Each of the venting passages 32 and 33 has an air inlet region substantially adjoining the outlet aperture constituted by the side opening 18, the air inlet regions merging to form the common air inlet region substantially adjoining the opening 18. The common air inlet region occupies a space between part of the wall of the hollow body 13 between its open end 30 and the opening 18, and an opposing part of the interior surface of a tubular portion 103 of the end piece 94. An opening 28 in the skirt 117 serves as the common air outlet port for both venting passages 32 and 33. It will be appreciated that the air outlet port 28 is disposed within the container which consists of the bottle (not shown) and the end-piece 94. The open end 30 of the hollow body 13 is defined by the rim of the skirt 117 and has a substantially elliptical periphery, the rim of the skirt 117 being at an angle to a radial plane of the hollow body 13, as shown in FIG. 37. The skirt 117 tapers to the open end 30, and, in the position for a pouring operation, is in continuous contact with the interior surface of a tubular portion 103 of the end-piece 94 along an endless line at which the curvature of the skirt 117 inflects, as shown in FIGS. 36 and 37.

Thus the common air inlet region is formed between an inner barrier, which is established by the contact between the skirt 117 and the tubular portion 103 and is continuous circumferentially of the hollow body 13, and the outlet opening 18.

When the bottle (not shown) is substantially full of liquid and is tilted for a pouring operation with the closure device 10 positioned as shown in FIGS. 36 and 37, the neck 11, the tubular portion 103 of the end-piece 94, and the hollow body 13 of the device 10 are initially filled by the liquid. As liquid leaves the bottle through the opening 18 and the venting passages 32 and 33, the pressure within the bottle falls and air must enter the bottle to replace the liquid which is pouring out. It is found that the main stream of liquid which pours vertically down from the exposed portion of the opening 18 is substantially uniform and uninterrupted. It appears that air enters the venting passages 32 and 33 as bubbles which begin their forming in the air inlet regions of the venting passages 32 and 33.

The opening 28, being on the opposite side of the hollow body 13 from the outlet aperture 18, is at a position which is displaced circumferentially of the hollow body 13 as far as possible from the position of the common air inlet region, which adjoins the outlet aperture, i.e. the side opening 18. If the venting passages 32 and 33 were given separate air outlet ports, the two air outlet ports could be in the form of two separate openings at respective positions which are displaced 140° around the axis of the hollow body 13 in each circumferential direction from the nearest point on the periphery of the side opening 18. The efficiency of the venting function of a venting passageway diminishes as the circumferential position of its air outlet port approaches that of its air inlet region.

Since liquid which enters the venting passages 32 and 33 during a pouring operation joins the main stream of liquid issuing from the opening 18, such liquid flows out in the same direction as the main stream.

The cylindrical wall 69 is provided at the closure end portion 110 with an upper, complete ring-like circumferential bead 87, a lower circumferential bead 76 that is interrupted by the recessed region 44, and a circumferentially co-extensive, radially outwardly projecting ridge or flange 77.

The closure end portion 110 has an end wall 36 that terminates the space within the hollow body 13, and thickens towards the side opening 18 to provide a shallowly curving region that merges with the periphery of the side opening 18. This eliminates a pocket that might retain liquid which would drip from the upper part of the opening 18 when the container is returned to the upright position after a pouring operation. The closure end portion 110 has a curved, annular lower surface above the upper bead 87. When the closure device 10 is in its closing position, this curved annular surface bears against the upper annular surface of the ridge 96. In the closing position (FIG. 35), the upper bead 87 is engaged in an annular internal groove 86 in the tubular portion 103 of the end-piece 94. The tubular portion 103 has a constant internal diameter corresponding to the external diameter of the flange or ridge 77 of the hollow body 13. An engagement portion 114 of the end-piece 94 is equipped with an internal screw thread 116 for engagement with an external screw thread 17 on the end portion of the bottle neck 11.

It will be appreciated that the bead 76 and the ridge 77 of the device 10 and the groove 86 of the end-piece 94 have two functions when the closure device 10 is in the position for a pouring operation: to cooperate in providing an outer barrier to liquid, and to at least assist in locating the device 10 in its position for pouring as shown in FIGS. 36 and 37. The outer barrier blocks a direct path for liquid between the air outlet port 28 and the end mouth defined by the ridge 96. The outer barrier is interrupted by the recessed region 44 and thus extends from the common air inlet region to the air outlet port 28.

When the bottle is tilted for a pouring operation, the end wall 36 of the closure device 10 checks and counteracts the horizontal component of the flow of liquid into the closure device 10, so that the liquid pours out of the opening 18 in a substantially vertical direction.

It will be seen from FIG. 37 that the endless edge of the opening 18 is radially set back from the ridge 96 of the end-piece. This setting back has the result that when the bottle is returned to the vertical position from a pouring operation, any liquid which may cling to the edge of the opening 18 tends to drip back into the end-piece 94, rather than down onto the outer surface of the bottle.

To close the container, the closure device 10 is pushed into the end-piece 94 until the upper bead 87 of the hollow body 13 engages with the groove 86 of the end-piece 94.

When the closure device 10 is in the position for a pouring operation as shown in FIG. 37 the lower or innermost part of the endless edge of the side outlet opening 18 of the hollow body is radially set back relative to the end mouth of the outlet conduit and is above a portion of the inner barrier, so that the inner barrier may catch drips falling or running down from the lower part of the side outlet opening 18 at the end of a pouring operation, and material caught in this manner in the common air inlet region will be returned to the interior of the container through the common air outlet port 28 or directly when the closure device 10 is set back in the closing position shown in FIG. 35.

In the arrangement of FIGS. 36 and 37, the inner or lower boundaries of two venting passages 32 and 33, which boundaries are defined by the inner barrier, run from the common air inlet region below the outlet opening 18 to below the common air outlet port 28 at a position at the opposite side of the hollow body from the opening 18, and are downwardly inclined from the common air inlet region to the common air outlet port 28 when the closure device 10 is vertical, as illustrated by FIG. 37. This configuration of the venting passages 32 and 33 has the advantage that, especially where a relatively viscous liquid, such as a syrup or an automobile lubricating oil, is poured from the container (not shown) through the closure device 10, any liquid remaining in the common air inlet region below the opening 18 and in the venting passages 32 and 33 when the container is returned to the vertical position is urged by gravity to flow back into the container through the venting passages 32 and 33 and the common air outlet port 28. The lower portion of the skirt 117 cooperates with the inner surface of the outlet conduit of the container as shown in FIGS. 36 and 37 to provide the inner barrier to liquid during a pouring operation, the inner barrier completing the inclined venting passages 32 and 33 and preventing their common air inlet region from being washed out by direct flow liquid from the interior of the container (not shown).

With the end-piece 94 secured on the neck 11 of a bottle as described, the closure end portion 110 can be gripped manually and the closure device 10 can be pulled out manually from its closing position, in which the upper bead 87 is engaged in the groove 86 and the closure end portion 110 and the ridge 96 are in contact with one another, to the position for a pouring operation shown in FIG. 36 in which the lower bead 76 is engaged with the groove 86 and the side opening 18 is exposed beyond the tubular portion 103 of the end-piece 94. In the latter position, the flat, radially extending upper surface of the flange or ridge 77 bears upwardly against a downwardly (inwardly relative to the bottle which is not shown) facing annular surface formed within the tubular portion 103 below the lower side wall of the groove 86. This engagement prevents the closure device 10 from being pulled out of the end-piece 94 without extra effort.

Contact between the cylindrical wall 69 and the internal ridge 96 of the tubular portion 103 of the end-piece 94 and the annular ridge below the groove 86 provides guidance which holds the closure device 10 coaxial with the end-piece 94 during sliding of the closure device 10 between its closing position and its position for a pouring operation.

Figure 39:
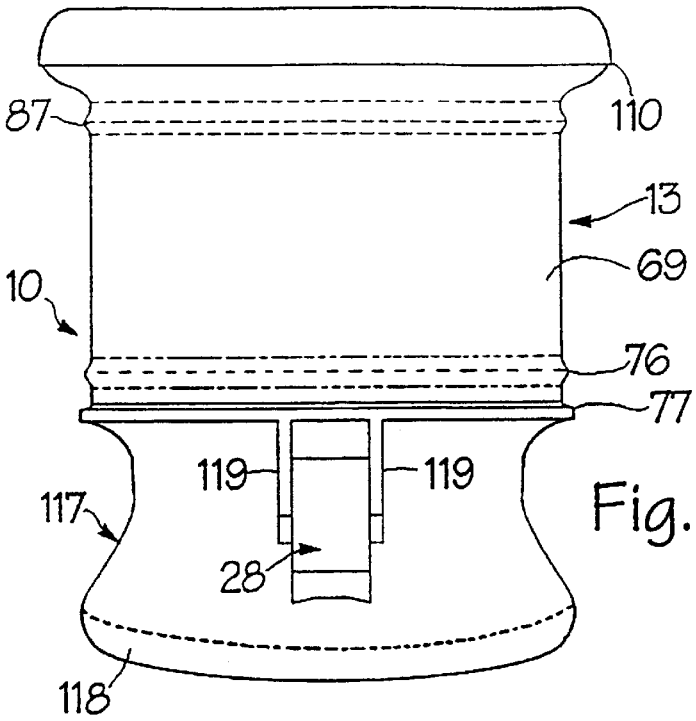
FIG. 39 is a side view of the closure device of FIG. 35 or 38 showing an air outlet port.
Figure 40:
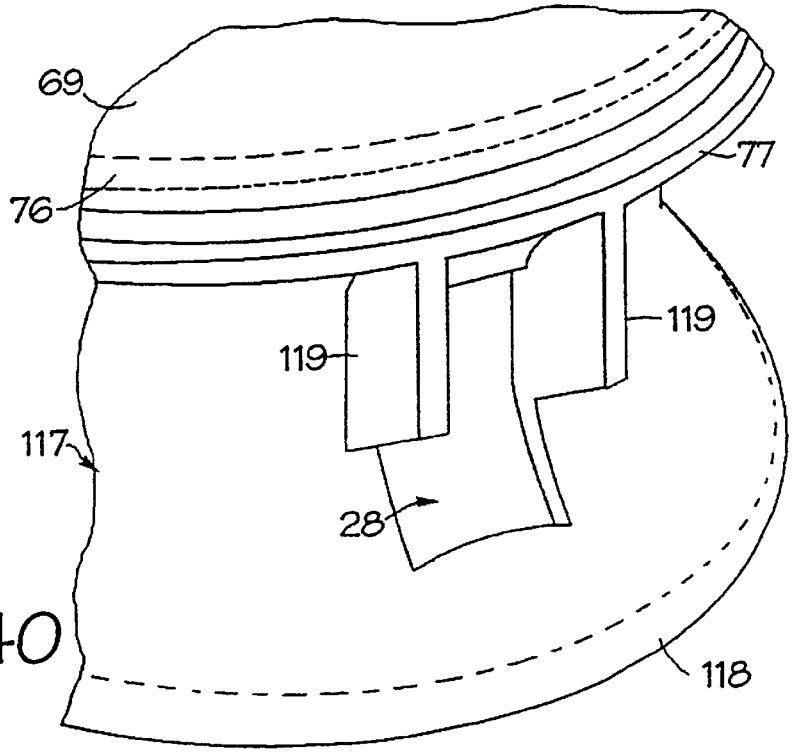
FIG. 40 is a fragmentary, perspective view of the closure device of FIG. 39.

FIGS. 39 and 40 show the air outlet port 28 in more detail. The hollow body 13 has, extending from the ridge 77 and the skirt 117, a substantially radially extending deflector fin 119 at each side of the air outlet port 28. Each deflector fin 119 is disposed to partially obstruct a respective venting passage 32 or 33 (FIG. 36) when the closure device 10 is positioned for a pouring operation. The partial obstruction of the venting passage 33 is illustrated by FIG. 37. The air outlet port 28 is separated from the open end 30 of the hollow body 13 by a portion of the skirt 117, which portion, as can be best seen from FIGS. 37 and 40, is shaped to deflect liquid which enters the hollow body 13 from its open end 30 away from an adjacent portion of the internal surface of the tubular portion 103 of the end-piece 94.

The deflector fins 119 serve to restrict or prevent liquid from the interior of the bottle (not shown) entering the venting passages 32 and 33 during a pouring operation. Any liquid which nevertheless does enter the venting passages 32 and 33 is poured out in the same direction as and joins the main stream from the side outlet opening 18 when such liquid reaches the air inlet region substantially adjoining the opening 18.

From FIG. 36 it will be seen that when the engagement portion 114 of the end-piece 94 fully engages with its internal screw thread 116 the external screw thread 17 on the end part of the neck 11 of the bottle, a radially internally extending annular flange 95 of the end-piece 94 bears sealingly against the rim 19 at the free end of the neck 11. The tubular portion 103 of the end-piece 94 is of smaller diameter than the engagement portion 114 to which the tubular portion 103 is joined by a substantially flat annular portion carrying the sealing flange 95.

Figure 38:
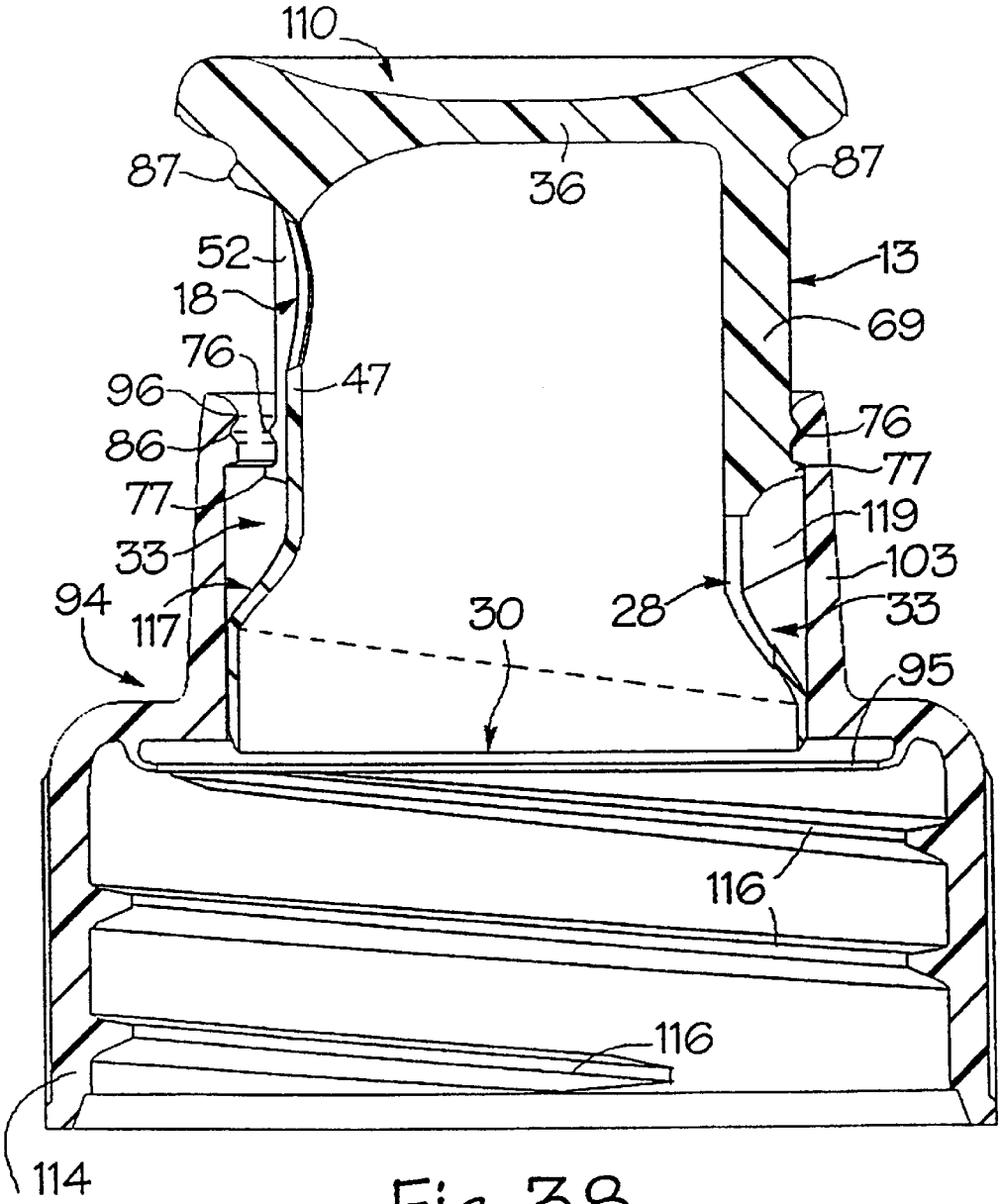
FIG. 38 is an axial sectional view corresponding to FIG. 37 but with a modification to the closure device.

FIG. 38 shows, in a view corresponding to FIG. 37, a modification of the hollow body 13 in which the skirt 117 includes a right circular cylindrical portion having an external diameter giving that portion of the skirt 117 a sliding fit in the tubular portion 103 of the end-piece 94. The modified skirt 117 of FIG. 38 and the skirt 117 of FIGS. 35 to 37 have a radially inwardly tapering rim portion 118 indicated in FIGS. 39 and 40. This rim portion 118 is substantially elliptical in the skirt 117 of FIGS. 35 to 37 and defines the open end 30 of the hollow body 13 of FIGS. 35 to 37 in a plane which is at an acute angle to a radial plane, as can be seen from FIG. 37. The tapering rim portion of the modified skirt 117 of FIG. 38 defines a circular open end 30 for the hollow body 13 and the open end 30 then lies in a radial plane. FIGS. 37 and 38 also illustrate the inclined disposition of the respective lower or inner boundaries of the venting passages 32 and 33 when the closure device 10 and the end-piece 94 are vertical. The lower boundaries of the venting passages 32 and 33 formed by the cooperation of the skirt 117 of FIGS. 35 to 37 and the end-piece 94 are established by the contact between the elliptical, widest part of the skirt 117 and the internal surface of the tubular portion 103. The lower boundaries of the venting passages 32 and 33 formed with the modification of FIG. 38 are established by the contact between the elliptical upper or outer end of the circular cylindrical portion of the modified skirt 117 and the tubular portion 103, and are represented in FIG. 38 by a broken line.

The contact between the skirt 117 below the side outlet opening 18 (as seen in FIGS. 37 and 38) and the tubular portion 103 of the end-piece establishes the common air inlet region for the venting passages 32 and 33 by preventing this region from being washed out by a direct current of liquid from the bottle as the bottle is tilted and held substantially or nearly horizontal during a pouring operation.

Figure 41:
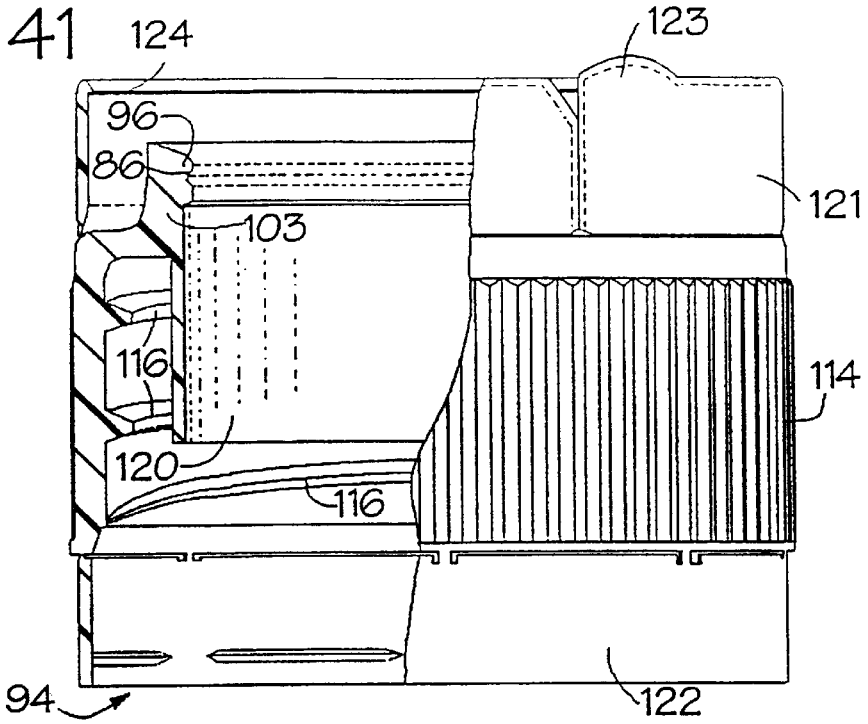
FIG. 41 is a side view of a modified end-piece shown partly broken away and partly in axial section.

FIG. 41 shows a modification of the end-piece 94 in which the tubular portion 103 is reduced to an annular support for the internal annular engagement features which provide the groove 86 and the ridge 96 which defines the end mouth. The internal surface of the tubular portion 103 merges with the internal surface of a relatively thin coaxial, circular cylindrical wall 120 that extends within the engagement portion 114. The external diameter of the cylindrical wall 120 is chosen to fit within the end part of the neck (not shown) of a bottle. The end part of the neck is as shown in FIG. 36 but the sealing contact between the rim 19 and the flange 95 of FIG. 36 is replaced in the modification of FIG. 41 by sealing contact between the cylindrical wall 120 and the internal surface of the neck (not shown). If in a further modification the external diameter of the wall 120 is smaller than the internal diameter of the end part of the bottle neck (not shown) or other structure on which the engagement portion 114 is engaged, a flange similar to the flange 95 of FIG. 36 may be provided on the flat annular part of the end-piece 94 to seal against the rim of the bottle neck or such structure.

Figure 42:
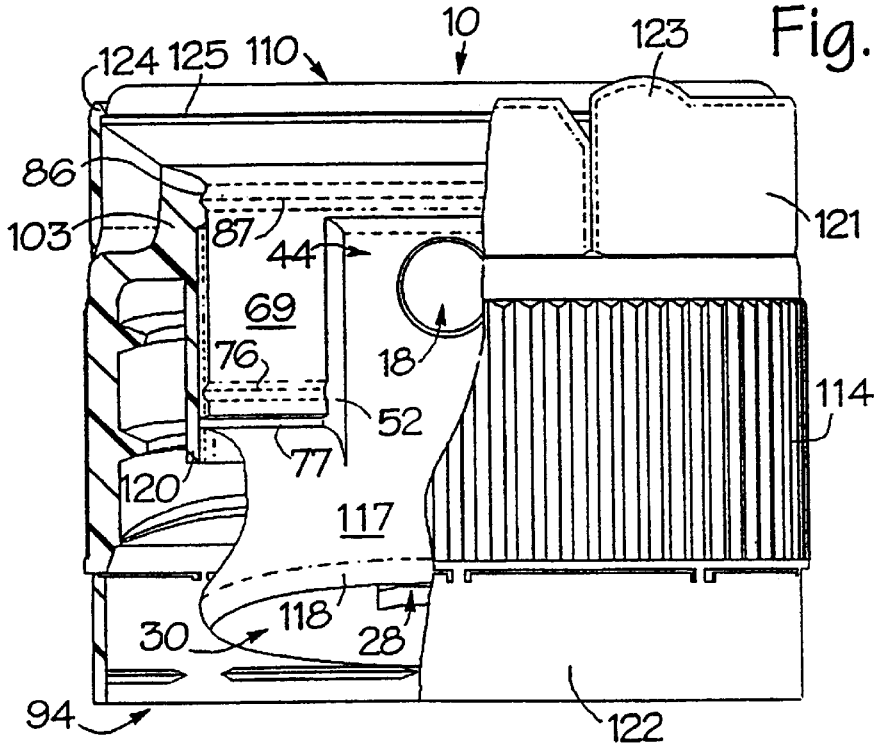
FIG. 42 is a side view corresponding to FIG. 41 and showing the end-piece engaged with a closure device in the closing position.

The end-piece 94 of FIG. 41 is shown equipped with tamper evident strips 121 and 122. The strip 121 surrounds the tubular portion 103 and is attached along one side to the adjacent end of the engagement portion 114 by a fine, tearable web. The strip 122 is in the form of a ring attached along one edge to the opposite end of the engagement portion 114 by frangible tabs and has internal ridges for engaging below a collar (not shown) formed on the neck of the bottle (not shown). The strip 121 has a manually grippable tab 123 at one end and, along its other side, may be equipped with a radially inwardly projecting flange 124 for engaging with the closure end portion 110 of the closure device 10 as shown in FIG. 42. The closure end portion 110 is then modified by the provision of a radially outwardly projecting ridge 125 over which the flange 124 engages when the closure device 10 is in the closing position shown in FIG. 42. It will also be seen that the thickness of the wall 120 of the end-piece 94 is such that the outer peripheral surface of the ridge 77 of the closure device 10 is in sliding contact with the internal surface of the wall 120 and the contiguous surface of the tubular portion 103. Before the closure device 10 is first used in a pouring operation, the strip 121 is removed by manually gripping the tab 123 and tearing the strip 121 away from the engagement portion 114 of the end-piece 94. The closure device 10 can then be disengaged from the closing position by pulling the closure end portion 110 away from the end-piece 94 so that the upper bead 87 disengages from the groove 86. The tubular portion 103 must be sufficiently resilient to allow such disengagement and subsequent re-engagement. The closure device 10 is pulled out to the position illustrated in FIG. 43 in which the lower bead 76 on the hollow body 13 of the closure device 10 is engaged in the groove 86 in the tubular portion 103 of the end-piece 94. The widest part of the skirt 117 of the hollow body 13 is in sliding contact with the internal surface of the wall 120 so that when the bottle (not shown) is tilted to pour liquid contents out through the side opening 18 of the closure device 10, the contact between the skirt 117 and the wall 120 acts as a barrier that prevents liquid from flowing directly between the skirt 117 and the wall 120 into the passages 32 (not visible in FIG. 43) and 33 and their common air inlet region.

If the user wishes to dispense with the closure device 10, the engagement portion 114 of the end-piece 94 can be unscrewed from the end part of the neck of the bottle (not shown), thereby breaking the frangible tabs which connect the ring-strip 122 to the engagement portion 114.

Figure 43:
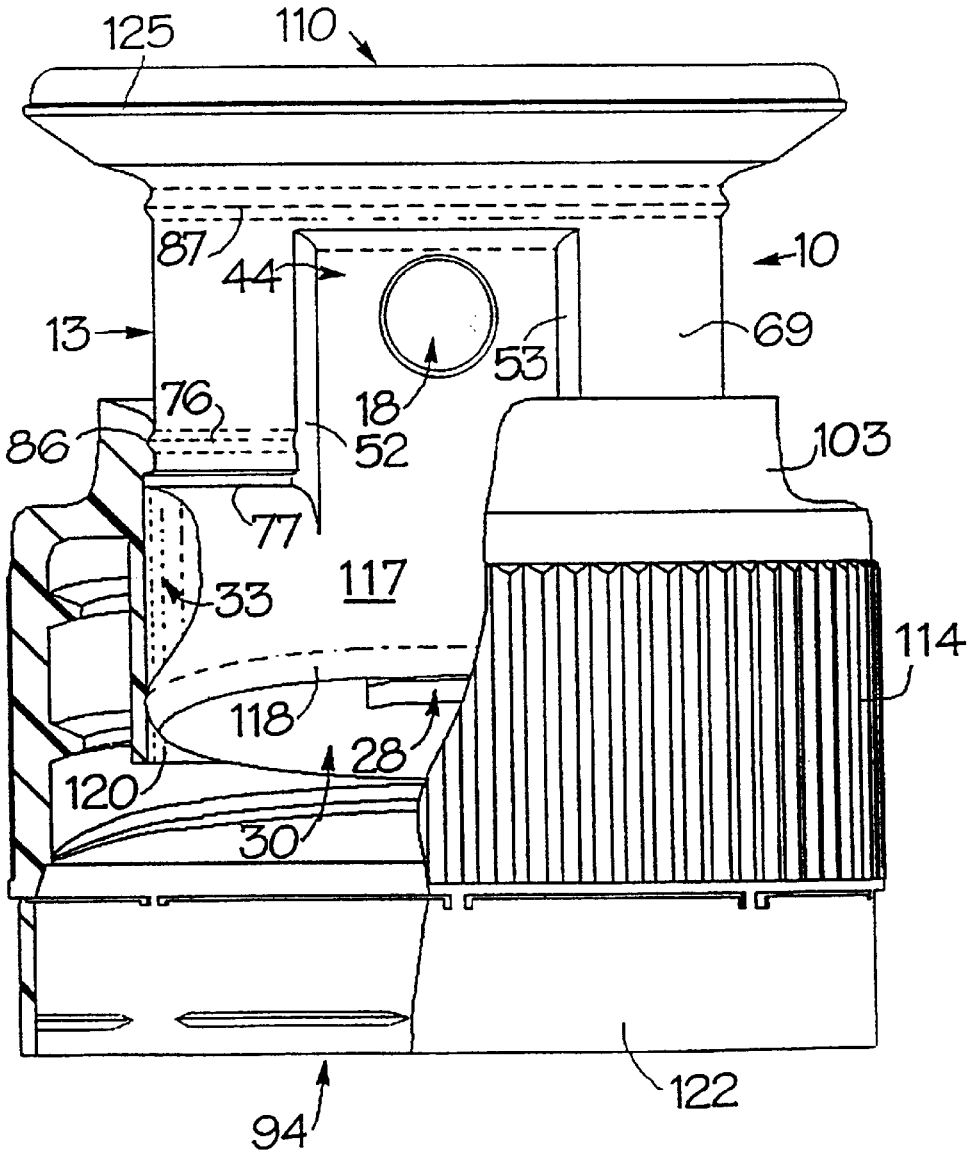
FIG. 43 is a side view corresponding to FIG. 41 and showing the end-piece engaged with the closure device in a position for a pouring operation.
Figure 44:
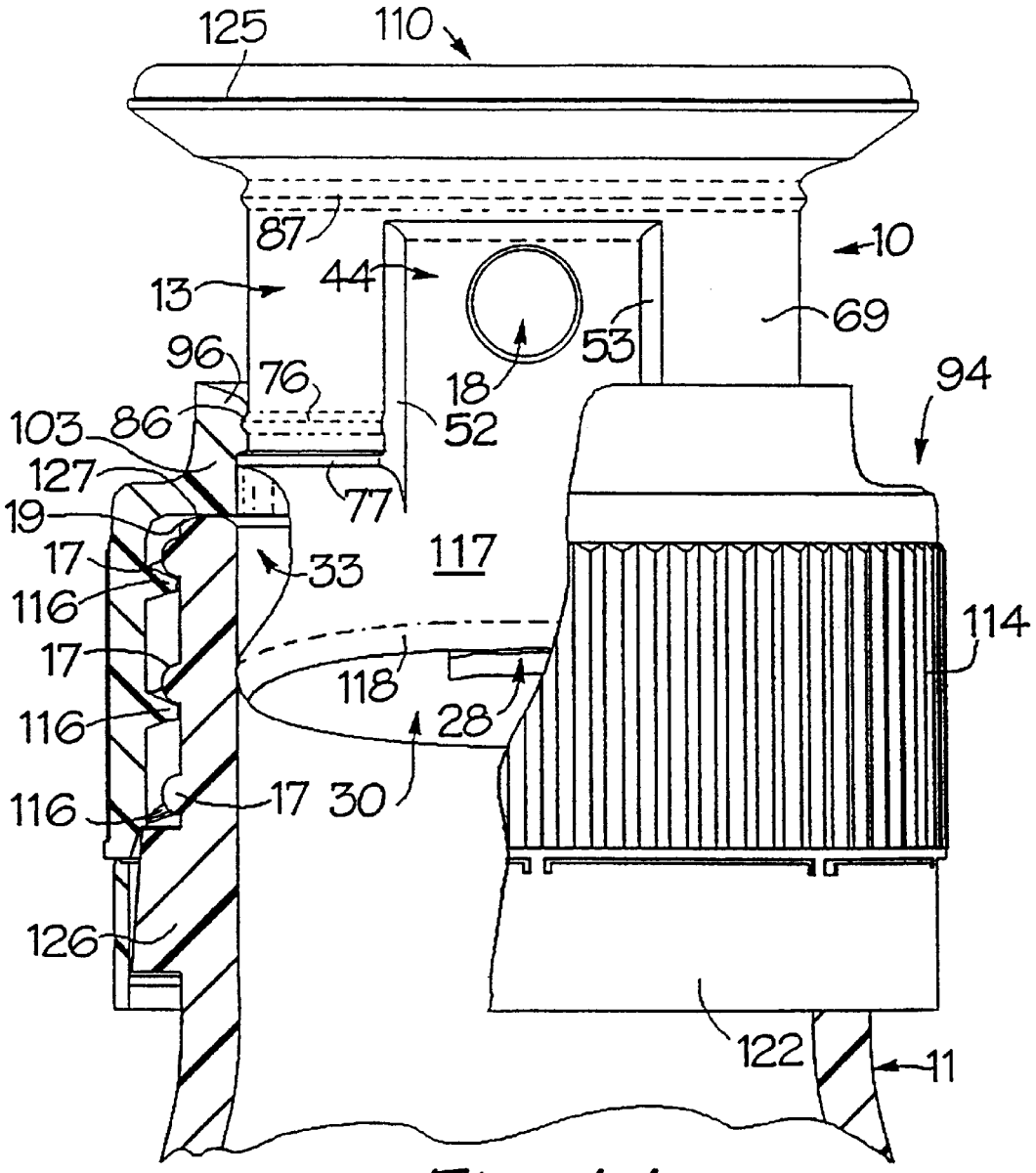
FIG. 44 is a side view corresponding to FIG. 43 but showing a further modification of the end-piece and its engagement with the end part of the neck of a bottle.

FIG. 44 shows a further modification of the end-piece 94 which differs from the end-piece 94 illustrated in FIGS. 41, 42 and 43 only in lacking the coaxial wall 120. The neck 11 of a bottle (not otherwise shown) has on its end part an external screw thread 17 engaged with the internal screw thread 116 of the engagement portion 114 of the end-piece 94, and the internal circumferentially aligned ridges on the ring-strip 122 are in contact with an annular surface, which faces away from the rim 19 of the neck 11, of a collar 126 formed on the outside of the neck 11. The internal annular surface 127 of the flat annular part of the end-piece 94 which joins the engagement portion 114 to the tubular portion 103 bears in sealing contact against the rim 19 of the neck 11. Alternatively, the end-piece 94 may be equipped at the surface 127 with a sealing flange corresponding to the sealing flange 95 of FIG. 36. The internal cylindrical surface of the tubular portion 103, which may be shorter than illustrated in FIG. 44, is in sliding contact with the outer peripheral surface of the ridge 77 and is substantially coaxial with and substantially of the same diameter as the internal surface of the neck 11 at its end part leading to the rim 19. The widest part of the skirt 117, where the tapered portion 118 joins the remainder of the skirt 117, is in sliding contact with the internal surface of the end part of the neck 11. The two passages 32 (not visible in FIG. 44) and 33, and the common air inlet region between the side outlet opening 18 and the passages 32 and 33 are bounded in the part of the outlet conduit formed by the neck 11 by a barrier to liquid formed by the contact between the widest part of the skirt 117 and the internal surface of the neck 11. This barrier prevents liquid from the bottle (not shown) flowing directly into the air inlet region and the passages 32 and 33 when the bottle is tilted for a pouring operation. In the embodiment of FIG. 44, the end-piece 94 defines substantially only the end mouth of the outlet conduit and cooperates with the hollow body 13 in establishing a barrier to liquid by means of sealing contact between the ridge 77 of the hollow body 13 and the annular projection which forms the inner or lower wall of the groove 86.

Figure 45:
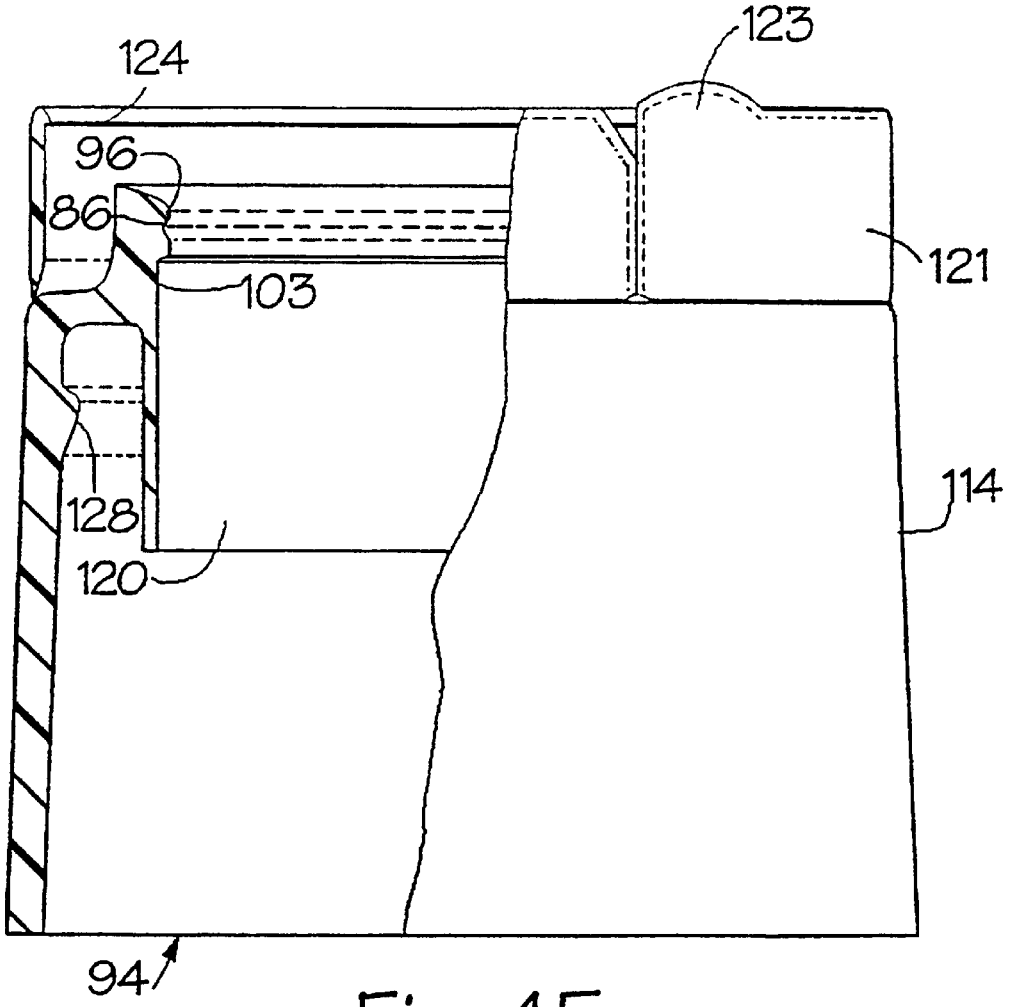
FIG. 45 is a side view corresponding to FIG. 41 of another modification of the end-piece.

A further modification of the end-piece 94 of FIGS. 41 to 43 is illustrated in FIG. 45, the modification in this case being to the engagement portion 114 which is longer, substantially in the shape of a frustum of a cone of small apex angle, and has an internal ridge 128 close to its smaller end and having a profile which matches an annular groove or indentation in the neck (not shown) of a bottle on the end part of which the engagement portion 114 is to fit. The cylindrical, internal coaxial wall 120 fits in sealing contact inside the neck of the bottle. The end-piece 94 of FIG. 45 is not intended to be removed from the neck of the bottle and accordingly has only the tamper evident strip 121 for initially securing the closure device (not shown) in its closing position. The closure device is as shown in FIGS. 42 and 43. The coaxial wall 120 may be omitted, so that another modification is provided similar to that of FIG. 44.

Although the embodiments shown in the accompanying drawings are described hereinbefore for use with liquid, they may also be used with other coherent flowable material, for example, a sauce.

It will be appreciated that the side opening 18 of the hollow bodies 13 of FIGS. 35 to 38 and 42 to 44 may extend longitudinally of the hollow body 13 to merge with the open end 30 of the hollow body 13, as is the case in some of the embodiments described hereinbefore. Similarly, the air outlet port 28 may merge with the open end 30. However, it should be noted that if in embodiments with a skirt 117 the side opening 18 is extended axially to merge with the open end 30, sufficient of the widest part of the skirt 117 must remain below the recessed region 44 to ensure that the inner barrier created by contact between the widest part of the skirt 117 and the internal surface of the outlet conduit establishes the respective air inlet regions of the venting passages 32 and 33 by preventing liquid from washing directly into the recessed region 44 when the container is tilted for a pouring operation.

The closure devices 10 of FIGS. 35 to 40, and FIGS. 42 to 44 can be modified to serve as unvented closure devices with a side outlet opening 18 by omitting the air outlet port 28. The deflector fins 119 are also then omitted. The skirt 117 provides a complete, continuous encircling barrier by contact with the interior surface of the tubular portion 103 or the wall 120 or the neck 11 when the closure device is in the pouring position. Liquid or the like that drips or runs down the recess wall 47 into the space that serves as the common air inlet region in the vented embodiments catches such material, which is then retained above the rim portion 118 of the skirt 117 until the closure device is pushed down to its closing position, this material then being released to the interior of the main body of the container, similarly to the releasing action described hereinbefore with reference to the drip apron 43 in FIG. 12. Such unvented closure devices are particularly useful with containers which can be squeezed to eject their contents through the side opening 18 when the unvented closure device is in its pouring position.

The closure devices 10 of FIGS. 35 to 40, and FIGS. 42 to 44, and the corresponding unvented closure devices just described, are suitable for single-handed opening and closing if the end piece 94 forms part of a container that can be held in one hand. The closure device can be moved from its closing position to its pouring position by upward pressure under the projecting peripheral edge of the closure end portion 110 exerted by the thumb of the user, the tip of the thumb being in contact with the projecting peripheral edge. The body of the container can then be squeezed if the closure device is unvented. To move the closure device from the pouring position to the closing position, the tip of the thumb presses down on the projecting peripheral edge until the closure device reaches the closing position.

Where containers having bodies and necks are mentioned or described hereinbefore in the description of embodiments of the invention, such containers will usually be formed from a plastics material or glass. Other suitable materials may of course be used, and embodiments of the invention may include or be used in conjunction with containers having bodies made of, for example, metal or of waxed papers. In particular, an embodiment of the invention may be used with or include a container having a body in form of a carton made from waxed paper or a laminate of paper and plastics material, or a multi-layer laminate.

In the embodiment described hereinbefore with reference to the accompanying drawings, when the closure device is in the closing position the closure end portion seals the outlet conduit by having an annular surface, such as the radially outer part of the inner surface of the end wall of the cap 14 or the underside of the radially projecting rim of the closure end portion 110 of FIGS. 35 to 39, forced against a rim 19 or annular ridge 96. In the embodiments of FIGS. 34 to 45, the annular circumferential bead 87 on the cylindrical wall 69 where the closure end portion 110 merges with the hollow body 13 ensures that the axially directed force is applied in the closing position and also contributes to the sealing action of the closure end portion 110. It will be appreciated that other embodiments can be realised in which, for example, the sealing action of the closure end portion is achieved wholly by radial pressure between one or more radially outwardly directed surfaces of the closure end portion against one or more cooperating radially inwardly directed surfaces of the outlet conduit, by virtue of resilience of the closure end portion and tight fitting or wedging (like a conventional cork) of the closure end portion in the outlet conduit.

The closure end portions of the closure devices of the various embodiments may be combined with suitable known forms of child-proofing mechanism, especially of the push-and-twist type. For example, the closure end portions which have a screw-down cap, such of the caps 14, may, in particular, be combined with the type of child-proofing mechanism marketed under the registered trade mark CHEMLOK. Embodiments with screw down caps may, more generally, be combined with a child-resistant mechanism that does not involve the structure of the inside of the outlet conduit and the inside top surface of the cap.

Those skilled in the art will understand that various features of the preferred embodiments described and illustrated hereinbefore can be selected and combined to form further embodiments of the invention, and that the scope of the invention is not limited by the embodiments described but is defined by the following claims.

What is claimed is:

1. A closure device for an outlet conduit of a container, the outlet conduit having an end mouth, and the closure device having a closure end portion, an open end, and a hollow body extending from the closure end portion to the open end and defining a side outlet opening, the closure device being arranged at least partly within the outlet conduit and being settable in a closing position in which the closure end portion seals the outlet conduit, the closure device being positionable for a pouring operation with the closure end portion spaced away from the end mouth of the outlet conduit and at least part of the side outlet opening exposed beyond the end mouth to define an outlet aperture for permitting a coherent flowable material to leave the container through the closure device, and the closure device being slidable in contact with the outlet conduit between the closing position and the position for a pouring operation, and, when the closure device is positioned for a pouring operation, a venting passageway being established through which air can enter the container when coherent flowable material is poured out through the closure device, the venting passageway having an air inlet region substantially adjoining the outlet aperture, and having an air outlet port which is disposed at a position which is adjacent the open end of the device and displaced circumferentially of the hollow body from the position of the air inlet region, at least part of the venting passageway being a space between the hollow body and the outlet conduit, the said space being defined by the hollow body and the outlet conduit cooperating with one another when the closure device is positioned for a pouring operation.

2. A closure device for a container that includes an outlet conduit with an end mouth, the closure device having a closure end portion, an open end, and a hollow body extending from the closure end portion to the open end, and the hollow body defining a side outlet opening, the closure device being arranged at least partly within the outlet conduit and being settable in a closing position in which the closure end portion seals the outlet conduit, and the closure device being positionable for a pouring operation with the closure end portion spaced away from the end mouth of the outlet conduit and at least part of the side outlet opening exposed beyond the end mouth to define an outlet aperture for permitting a coherent flowable material to leave the container through the closure device and, when the closure device is positioned for a pouring operation, a venting passageway being established, through which air can enter the container when coherent flowable material is poured out through the closure device, the venting passageway having an air inlet region substantially adjoining the outlet aperture, and having an air outlet port which is disposed within the container at a position which is displaced circumferentially of the hollow body from the position of the air inlet region, at least part of the venting passageway being defined by the hollow body and the outlet conduit cooperating with one another when the closure device is positioned for a pouring operation.

3. A closure device according to claim 2, wherein the air outlet port is defined by the hollow body.

4. A closure device according to claim 2, wherein the side outlet opening of the hollow body is separated from the open end of the hollow body by a wall of the hollow body which bounds the said air inlet region of the venting passageway when the closure device is in a position for a pouring operation, and the air inlet region and the air outlet port are in communication through two branches of the venting passageway, the two branches being disposed at opposite sides of the hollow body.

5. A closure device according to claim 2, wherein when the closure device is positioned for a pouring operation the hollow body cooperates with the outlet conduit in forming inner and outer barrier means defining the at least part of the venting passageway, in that the outer barrier means extend from the air inlet region to the air outlet port and block a direct path for coherent flowable material between the air outlet port and the end mouth of the outlet conduit.

6. A closure device according to claim 5, characterized in that the inner barrier means extend from the air inlet region to the air outlet port.

7. A closure device according to claim 6, characterized in that the inner barrier means define an inner boundary of the air inlet region.

8. A closure device according to claim 2, wherein the hollow body is shaped to set back at least part of the periphery of the side outlet opening radially relative to the end mouth when the closure device is positioned for a pouring operation.

9. A closure device according to claim 2, wherein the hollow body and the outlet conduit are adapted to cooperate to locate the closure device in a position for a pouring operation.

10. A closure device according to claim 2, wherein the hollow body tapers inwardly adjacent to the open end thereof to facilitate initial insertion of the closure device into the outlet conduit.

11. A closure device according to claim 2, wherein the hollow body and the outlet conduit cooperate, when the closure device is positioned for a pouring operation, to define at least part of a further venting passageway for air to enter when coherent flowable material is poured out through the closure device, the further venting passageway having an air inlet region substantially adjoining the outlet aperture, and having an air outlet port which is disposed within the container at a position which is displaced circumferentially of the hollow body from the position of the air inlet region of the further venting passageway.

12. A closure device according to claim 11, characterized in that the air outlet ports of the venting passageways form a common air outlet port on the opposite side of the hollow body from the outlet aperture.

13. A closure device according to claim 12, characterized in that the ports of the venting passageways are arcuate and extend around respective diametrically opposite extents of a circumference of the hollow body.

14. A closure device according to claim 13, characterized in that each air inlet region extends in the axial direction of the hollow body from an end of the respective arcuate part of the venting passageway.

15. A closure device according to claim 14, characterized in that the respective inlet regions of the passageways are disposed at opposite sides of the side outlet opening in the circumferential sense of the hollow body.

16. A closure device according to claim 12, wherein the common air outlet port is in the form of a cut out in the hollow body, the cut out merging with the open end of the.hollow body.

17. A closure device according to claim 2, wherein the side outlet opening merges with the open end of the hollow body.

18. A closure device according to claim 4, characterized in that the hollow body and the outlet conduit cooperate, when the closure device is positioned for a pouring operation, to form inner and outer barrier means, the inner barrier means bounding the air inlet region and the two branches of the venting passageway, and the outer barrier means bounding the air outlet port and the two branches of the venting passageway.

19. A closure device according to claim 18, characterized in that the inner and outer barrier means extend circumferentially around the hollow body in such a manner that the two branches of the venting passageway are arcuate.

20. A closure device according to claim 18, wherein at least part of the wall is set back radially from the inner periphery of the outlet conduit, and the side outlet opening of the hollow body is wholly exposed beyond the end mouth when the closure device is in the position for a pouring operation.

21. A closure device according to claim 2, wherein the air outlet port is separated from the open end of the closure device by a wall of the hollow body.

22. A closure device according to claim 4, characterized in what the hollow body of the closure device includes a skirt that defines the open end of the hollow body an the air outlet port, and, when the closure device is positioned for a pouring operation, cooperates with an internal surface of the conduit to establish a barrier to coherent flowable material, the said barrier completing the branches of the venting passageway.

23. A closure device according to claim 22, characterized in that the hollow body has a substantially radially extending deflector fin at each side of the air outlet port circumferentially of the hollow body, each deflector fin being disposed to partially obstruct a respective one of the branches of the venting passageway when the closure device is positioned for a pouring operation.

24. A closure device according to claim 22, wherein the air outlet port is separated from the open end of the hollow body by a portion of the skirt, the portion of the skirt being shaped to deflect coherent flowable material which enters the hollow body from its open end during a pouring operation away from an adjacent portion of the internal surface of the conduit.

25. A closure device according to claim 2, wherein the closure end portion of the closure device presents within the hollow body an internal end stop surface that is curved to direct coherent flowable material into the side outlet opening during a pouring operation.

26. A closure device according to claim 8, characterized in that the hollow body includes a drip apron, the drip apron having a lip for defining the lower edge of the outlet aperture during a pouring operation and a barrier portion shaped and arranged for engaging the interior of the outlet conduit during a pouring operation with the hollow body, including the drip apron, cooperating with the outlet conduit to form a temporary reservoir for collecting drips of coherent flowable material during a pouring operation, and the barrier portion being positioned out of contact with the interior of the outlet conduit when the closure device is in the closing position, whereby coherent flowable material collected in the temporary reservoir is released to the interior of the container.

27. A closure device according to claim 26, characterized in that the inlet region of the venting passageway is partitioned from the outlet conduit by the drip apron.

28. A closure device according to claim 2, wherein the container is provided with an external screw thread at the end mouth, characterized in that the closure end portion of the device comprises a cap with an internally screw-threaded skirt for cooperation with the external screw thread when the closure device is in the closing position.

29. A closure device according to claim 2, wherein an edge of the side outlet opening is provided with a radially outwardly projecting lip, the edge bounding the side outlet opening adjacent the closure end portion.

30. A closure device according to claim 2, wherein for a container that can be held in one hand leaving the thumb of the hand free to act on the closure end portion of the device, the closure end portion has means projecting radially relative to the hollow body and adapted to be urged away from the end mouth of the outlet conduit by a first force exerted by the thumb to position the closure device for a pouring or other discharging operation, the closure device being returnable from the position for a pouring or other discharging operation to set in the closing position by a second force exerted on the closure end portion by the thumb in the opposite direction to the first force.

31. A closure device for a container that includes an outlet conduit with an end mouth, the closure device having a closure end portion, an open end, and a hollow body extending from the closure end portion to the open end, and the device being adapted to cooperate with the outlet conduit with the device disposed at least partly within the outlet conduit both for closing the outlet conduit and for permitting a coherent flowable material to leave the container through the closure device, the hollow body defining a side outlet opening, and the closure device being settable in a closing position in which the closure end portion seals the outlet conduit and being positionable with the closure end portion spaced away from the end mouth of the outlet conduit and at least part of the side outlet opening exposed beyond the end mouth of the outlet conduit to define an outlet aperture for the coherent flowable material to leave the container through the closure device, and the hollow body and the outlet conduit cooperating to define therebetween a venting passageway through which air can enter the container when coherent flowable material is poured out through the outlet aperture, the venting passageway having an air outlet port which is disposed adjacent the open end of the device and an air inlet region substantially adjoining the outlet aperture, the venting passageway comprising inner and outer barrier means spaced apart and arranged to direct coherent flowable material that enters the venting passageway from the air outlet port towards the air inlet region when the coherent flowable material is poured out through the outlet aperture, the inner barrier means being disposed to prevent coherent flowable material from flowing directly into the air inlet region from within the container, and the outer barrier means being disposed to prevent coherent flowable material from escaping from the venting passageway except through the air inlet region.

32. A closure device according to claim 31, characterized in that the inner and outer barrier means and the air inlet region are established when the closure device is in a position for a pouring operation, the inner and outer barrier means being spaced apart axially of the hollow body, with the inner barrier means defining an inner boundary of the air inlet region, and the outer barrier means defining an outer boundary between the air outlet port, which is disposed at a position displaced circumferentially of the hollow body from the position of the air inlet region and the end mouth.

33. A closure device according to claim 31, characterized in that at least the hollow body is shaped to define between the hollow body and the outlet conduit the venting passageway, the hollow body cooperating with the outlet conduit to provide the barrier means spaced apart along the outlet conduit, and the air outlet port being provided at a position which is displaced circumferentially of the hollow body from the position of the air inlet region.

34. A closure device according to claim 31, characterized in that the air outlet port is disposed on the opposite side of the hollow body from the outlet aperture, and the hollow body and the outlet conduit are shaped to cooperate and provide when the device is positioned for a pouring operation the barrier means spaced apart along the outlet conduit, the inner barrier means defining an inner boundary of the air inlet region, and the outer barrier means defining an outer boundary of the air outlet port.

35. A closure device according to claim 31, wherein a further venting passageway through which air can enter the container when coherent flowable material is poured out through the outlet aperture is provided, the further venting passageway extending between the air outlet port and a further air inlet region substantially adjoining the outlet aperture, and in that each venting passageway is disposed circumferentially about the hollow body between its air inlet region and the air outlet port.

36. A closure device according to claim 31, wherein the side outlet opening is bounded by a periphery that is set back radially relative to the inner periphery of the mouth.

37. A closure device according to claim 31, wherein the side outlet opening merges with the open end of the hollow body.

38. A container that includes an outlet conduit with an end mouth, and has a closure device having a closure end portion, an open end, and a hollow body extending from the closure end portion to the open end, the hollow body defining a side outlet opening, and the closure device being arranged at least partly within the outlet conduit and being settable in a closing position in which the closure end portion seals the outlet conduit and being positionable for a pouring operation with the closure end portion spaced away from the end mouth of the outlet conduit and at least part of the side outlet opening exposed beyond the end mouth to define an outlet aperture for permitting a coherent flowable material to leave the container through the closure device and, when the closure device is positioned for a pouring operation, a venting passageway being established, through which air can enter the container when coherent flowable material is poured out through the closure device, the venting passageway having an air inlet region substantially adjoining the outlet aperture, and having an air outlet port which is disposed within the container at a position which is displaced circumferentially of the hollow body from the position of the air inlet region, at least part of the venting passageway being defined by the hollow body and the outlet conduit cooperating with one another when the closure device is positioned for a pouring operation.

39. A container according to claim 38, characterized in that the venting passageway is defined between barrier means spaced apart along the outlet conduit.

40. A container according to claim 38, characterized in that the outlet conduit comprises a neck with a hollow insert located therein and defining the end mouth.

41. A container according to claim 40, characterized in that the insert includes interior annular means for cooperating with the hollow body to form the venting passageway.

42. A container according to claim 41, characterized in that the end mouth of the outlet conduit is defined by an annular portion of the insert extending axially beyond the position of a radially outwardly directed locating flange of the insert bearing on a rim at the end of the neck, the annular portion being spaced radially inwardly from the flange by an annular trough formed in the insert.

43. A container according to claim 38, wherein the interior of the outlet conduit is provided with annular means for cooperating with the closure device.

44. A container according to claim 43, characterized in that the annular means includes at least one annular recess.

45. A container according to claim 43, wherein the annular means includes an annular projection.

46. A container according to claim 38, wherein the outlet conduit includes an end-piece that defines the end mouth.

47. A container according to claim 46, characterized in that a portion of the end-piece provides an internal surface which, when the closure device is positioned for a pouring operation, cooperates with a portion of the hollow body of the closure device in completing two branches of the venting passageway, the two branches being disposed at opposite sides of the hollow body and each establishing communication between the air inlet region and the air outlet port.

48. A container according to claim 38, wherein the outlet conduit comprises a neck with an end-piece secured thereto and defining the end mouth.

49. A container according to claim 48, characterized in that the end-piece includes interior annular means for cooperating with the hollow body in forming the venting passageway.

50. A container according to claim 48, wherein the end mouth of the outlet conduit is defined by an annular portion of the end-piece extending axially beyond the position of a radially inwardly directed sealing flange of the end-piece bearing on a rim at the end of the neck.

51. A container according to claim 48, characterized in that the neck has external engagement means at its free end, and the end-piece has internal engagement means, the end-piece being secured to the neck at the free end by engagement of the external and internal engagement means.

52. A container according to claim 51, characterized in that the at least part of the venting passageway is defined by cooperation between the hollow body and a tubular portion of the end-piece.

53. A container according to claim 52, characterized in that the tubular portion of the end-piece projects coaxially into the neck from the free end of the neck.

54. A container according to claim 52, characterized in that the tubular portion of the end-piece projects coaxially away from the free end of the neck.

55. A container according to claim 51, characterized in that the at least part of the venting passageway is defined by co-operation between the hollow body and an annular portion of the end-piece, the annular portion defining the end mouth of the outlet conduit, and by cooperation between the hollow body and the internal surface of the neck.

56. A container that includes an outlet conduit with an end mouth and a closure device, the closure device having a closure end portion, an open end, and a hollow body extending from the closure end portion to the open end and defining a side outlet opening, the closure device being arranged at least partly within the outlet conduit and being settable in a closing position in which the closure end portion seals the outlet conduit, the closure device being positionable for a pouring operation with the closure end portion spaced away from the end mouth of the outlet conduit and at least part of the side outlet opening exposed beyond the end mouth to define an outlet aperture for permitting a coherent flowable material to leave the container through the closure device and the closure device being slidable in contact with the outlet conduit between the closing position and the position for a pouring operation, and, when the closure device is positioned for a pouring operation, a venting passageway being established through which air can enter the container when coherent flowable material is poured out through the closure device, the venting passageway having an air inlet region substantially adjoining the outlet aperture, and having an air outlet port which is disposed within the container at a position which is displaced circumferentially of the hollow body from the position of the air inlet region, at least part of the venting passageway being a space between the hollow body and the outlet conduit, the space being defined by the hollow body and the outlet conduit cooperating with one another when the closure device is positioned for a pouring operation.

57. A container according to claim 56, characterized in that the hollow body and the outlet conduit cooperate, when the closure device is positioned for a pouring operation, to form inner and outer barrier means defining the at least part of the venting passageway.

58. A container according to claim 56, wherein the hollow body and the outlet conduit are adapted to cooperate to locate the closure device in a position for a pouring operation.

59. A container according to claim 56, characterized in that the hollow body and the outlet conduit cooperate, when the closure device is positioned for a pouring operation, to define at least part of a further venting passageway for air to enter when coherent flowable material is poured out through the closure device, the further venting passageway having an air inlet region substantially adjoining the outlet aperture, and having an air outlet port which is disposed within the container at a position which is displaced circumferentially of the hollow body from the position of the air inlet region of the further venting passageway.

60. A container according to claim 56, characterized in that the hollow body and the outlet conduit cooperate, when the closure device is positioned for a pouring operation, to form inner and outer barrier means, the inner barrier means bounding the air inlet region and two branches of the venting passageway, and the outer barrier means bounding the two branches of the venting passageway, each branch providing communication between the air inlet region and the air outlet port.

61. A container according to claim 60, characterized in that the inner and outer barrier means extend circumferentially around the hollow body in such a manner that the two branches of the venting passageway are arcuate.

62. A container that includes an outlet conduit with an end mouth, and a closure device having a closure end portion, an open end, and a hollow body extending from the closure end portion to the open end, the device being adapted to cooperate with the outlet conduit with the device disposed at least partly within the outlet conduit both for closing the outlet conduit and for permitting a coherent flowable material to leave the container through the closure device, the hollow body defining a side outlet opening, and the closure device being settable in a closing position in which the closure end portion seals the outlet conduit and being positionable for a pouring operation with the closure end portion spaced away from the end mouth of the outlet conduit and at least part of the side outlet opening exposed beyond the end mouth of the outlet conduit to define an outlet aperture for the coherent flowable material from the container, and the hollow body and the outlet conduit cooperating to define therebetween a venting passageway through which air can enter the container when coherent flowable material is poured out through the outlet aperture, the venting passageway having an air outlet port which is disposed within the container, and an air inlet region substantially adjoining the outlet aperture, the hollow body and the outlet conduit cooperating to provide inner and outer barrier means spaced apart and arranged to direct coherent flowable material that enters the air outlet port towards the air inlet region when the coherent flowable material is poured out through the outlet aperture, the inner barrier means being disposed to prevent coherent flowable material from flowing directly into the air inlet region from within the container during a pouring operation, and the outer barrier means being disposed to prevent coherent flowable material from escaping from the venting passageway except through the air inlet region.

63. A container according to claim 62, characterized in that the hollow body and the outlet conduit are shaped to define therebetween the venting passageway, the air outlet port being disposed adjacent the open end of the device, and the hollow body and the outlet conduit being shaped to cooperate and provide the inner and outer barrier means spaced apart along the outlet conduit, the inner barrier means defining an inner boundary of the air inlet region, and the outer barrier means defining an outer boundary of the air outlet port, the air outlet port being provided at a position which is displaced circumferentially of the hollow body from the position of the inlet region.

64. A container according to claim 62, wherein a further venting passageway through which air can enter the container when coherent flowable material is poured through the outlet aperture is provided, the further passageway having an air inlet region adjoining the outlet aperture, and the air outlet port serving as an outlet port for the further venting passageway.

65. A container according to claim 62, wherein the barrier means include an internal annular groove in an end-piece defining the said end mouth, and at least one external annular projection provided on the hollow body and arranged to engage with the outlet conduit of the container when the closure device is in a position for a pouring operation.

66. A closure device for a container that includes an outlet conduit with an end mouth, the closure device having a closure end portion, an open end, and a hollow body extending from the closure end portion to the open end, and the hollow body defining a side outlet opening, the closure device being arranged at least partly within the outlet conduit and being settable in a closing position in which the closure end portion seals the outlet conduit, and the closure device being positionable for a discharging operation with the closure end portion spaced away from the end mouth of the outlet conduit and the side outlet opening exposed beyond the end mouth to define an outlet aperture for permitting a coherent flowable material to leave the container through the closure device, a catcher space being established by cooperation of the closure device and the outlet conduit when the closure device is positioned for a discharging operation, the catcher space having an inlet region disposed to receive coherent flowable material descending from the outlet aperture, at least when the outlet conduit is substantially upright, and being formed with inner barrier means to retain such received material within the catcher space until the closure device is returned to the closing position, the inner barrier means being opened by return of the closure device to the closing position to release such retained material to the interior of the container.

67. A combination of a closure device and a bottle neck end piece, the end-piece comprising a collar portion, and an end mouth portion defining an end mouth, and the closure device having a closure end portion, an open end, and a hollow body extending from the closure end portion to the open end and defining a side outlet opening, the closure device being arranged at least partly within the end-piece and being settable in a closing position in which the closure end portion seals the end-mouth, the closure device being positionable with the closure end portion spaced away from the end mouth and at least part of the side outlet opening exposed beyond the end mouth to define an outlet aperture in communication with the open end of the hollow body, and the closure device and the end-piece cooperating to provide at least part of a venting passageway when the closure device is positioned to define the outlet aperture, the venting passageway having an inlet region substantially adjoining the outlet aperture, and an outlet port provided at a position which is displaced circumferentially of the hollow body from the position of the inlet region.

68. A combination according to claim 67, characterized in that the closure device and the end-piece cooperate to provide at least part of a further venting passageway when the closure device is positioned to define the outlet aperture, the further venting passageway having an inlet region substantially adjoining the outlet aperture, and an outlet port provided at a position which is displaced circumferentially of the hollow body from the position of the inlet region of the further passageway.

69. A combination according to claim 68, characterized in that the end-piece includes interior annular means for cooperating with the hollow body in forming the venting passageways.

70. A combination according to claim 67, wherein the hollow body is shaped to set back at least part of the periphery of the side outlet opening radially relative to the periphery of the end mouth of the end-piece when the closure device is positioned to define the outlet aperture.

71. A combination according to claim 67, wherein the at least part of a venting passageway comprises the inlet region thereof.

72. A combination of a closure device and a bottle neck insert, the insert comprising a bung having an axial through passage, an insertion portion, and a head portion, and the closure device having a closure end portion, and open end, and a hollow body extending from the closure end portion to the open end and defining a side outlet opening, the closure device being arranged at least partly within the axial through passage of the bung and being settable in a closing position in which the closure end portion seals the axial through passage, the closure device being positionable with the closure end portion spaced away from the head portion of the bung and at least part of the side outlet opening exposed beyond the head portion of the bung to define an outlet aperture in communication with the open end of the hollow body, and the closure device and the insert cooperating to provide at least part of a venting passageway when the closure device is positioned to define the outlet aperture, the venting passageway having an inlet region substantially adjoining the outlet aperture, and an outlet port provided at a position which is displaced circumferentially of the hollow body from the position of the inlet region.

73. A combination according to claim 72, characterized in that the closure device and the insert cooperate to provide at least part of a further venting passageway when the closure device is positioned to define the outlet aperture, the further venting passageway having an inlet region substantially adjoining the outlet aperture, and an outlet port provided at a position which is displaced circumferentially of the hollow body from the position of the inlet region of the further passageway.

74. A combination according to claim 73, characterized in that the insert includes interior annular means for cooperating with the hollow body to form the venting passageways.

75. A combination according to claim 72, wherein the hollow body is shaped to set back at least part of the periphery of the side outlet opening radially relative to the periphery of the axial through passage at the head portion of the bung when the closure device is positioned to define the outlet aperture.

76. A combination according to claim 72, wherein the side outlet opening merges with the open end of the closure device.

77. A combination according to claim 72, wherein the or each outlet port comprises a cut out in the hollow body at the open end of the closure device.

78. A container that includes an outlet neck with an end mouth, and a closure device having a closure end portion, an open end, and a hollow body extending from the closure end portion to the open end, the device being adapted to cooperate with the outlet neck with the device disposed at least partly within the neck both for closing the outlet neck and for permitting a coherent flowable material to leave the container through the closure device, the hollow body defining a side outlet opening, and the closure device being settable in a closing position in which the closure end portion seals the outlet neck and being positionable for a pouring operation with the closure end portion spaced away from the end mouth of the outlet neck and at least part of the side outlet opening exposed beyond the end mouth of the outlet neck to define an outlet aperture for the coherent flowable material from the container and the hollow body and the outlet neck cooperating to define a venting passageway for air to enter when coherent flowable material is poured out through the outlet aperture, the venting passageway having an inlet region substantially adjoining the outlet aperture and communicating with an outlet port disposed within the container and at a position which is displaced circumferentially of the hollow body from the position of the inlet region.

79. A container according to claim 78, characterized in that the venting passageway is defined between barrier means spaced apart along the outlet neck.

* * * * *